US010537161B1

(12) United States Patent
Volin

(10) Patent No.: US 10,537,161 B1
(45) Date of Patent: Jan. 21, 2020

(54) WIND-LIFT-ELIMINATING UMBRELLA

(71) Applicant: Dee Volin, Gresham, OR (US)

(72) Inventor: Dee Volin, Gresham, OR (US)

( * ) Notice: Subject to any disclaimer, the term of this patent is extended or adjusted under 35 U.S.C. 154(b) by 0 days.

(21) Appl. No.: 16/517,564

(22) Filed: Jul. 20, 2019

(51) Int. Cl.
*A45B 25/22* (2006.01)
*A45B 23/00* (2006.01)
(Continued)

(52) U.S. Cl.
CPC ..... *A45B 25/22* (2013.01); *A45B 17/00* (2013.01); *A45B 23/00* (2013.01); *A45B 25/02* (2013.01);
(Continued)

(58) Field of Classification Search
CPC ..... A45B 25/22; A45B 2019/001
See application file for complete search history.

(56) References Cited

U.S. PATENT DOCUMENTS 2,767,723 A 10/1956 Sears, Jr.
3,383,814 A 5/1968 Rowe
(Continued)

*Primary Examiner* — Noah Chandler Hawk

(57) ABSTRACT

A wind-lift-eliminating self-adjusting self-stabilizing arthritic-aiding umbrella comprises: a flow-directing chapeau attached to a chapeau crown, an upper cone rotatably attached to a cable conduit for preventing the umbrella from radially twisting clockwise and counterclockwise out of shape, a lower tube for centering the upper cone, a stanchion, an intersector bolted to the stanchion, a supporting-arm intersector, a top-hub, a canopy-height-and-tilt-adjusting arthritic-hand-aiding handle slidably connected to the stanchion, a height-adjusting arthritic-hand-aiding trigger springably and pivotably attached to the handle for providing aid to arthritic hands to operate the handle without discomfort and for providing means to slidably lower and raise the handle to adjust the umbrella, a supporting arm pivotably attached to the lifting-arm intersector and the supporting-arm intersector, a lifting arm pivotably attached to the handle and the top-hub intersector, the supporting-arm intersector pivotably attached to the lifting arm, a deploying cable, a cable spool molded into the handle and attached to the cable, an arthritic-hand-aiding crank, an arthritic-hand-aiding-crank paddle rotatably connected to the crank for providing aid to arthritic hands to operate the crank providing means to deploy and retract the umbrella without discomfort, a reversible wind-pressure-releasing and cooling-funnel canopy for providing a cover to protect users from weather elements and for releasing air pressure below the umbrella, an opening is cut into the canopy, a top-hub-ring, the cable conduit rotatably attached to the top-hub-ring, the top-hub intersector pivotably attached to the top-hub-ring, a bottom-shuttle-hub-ring, the lower cone rotatably attached to the bottom-shuttle-hub-ring, the cable connected to the bottom hub-ring, upper-ribs, wind-lift-eliminating self-adjusting funnel-and-canopy-tension-adjusting springs for adjustably tensioning the canopy and for customizingly relieving air pressure below the umbrella to stabilize and to eliminate lift and vibration from wind gusts, adjustable-tension-canopy-spring brackets springably securing the wind-lift-eliminating self-adjusting funnel-and-canopy-tension-adjusting springs to the upper-ribs, lower-ribs pivotably screwed to the bottom-shuttle-hub-ring and the upper-ribs, a stanchion base-mounting plate attached to the stanchion, and base-stabilizing feet bolted to the base-mounting-plate.

20 Claims, 54 Drawing Sheets

(51) Int. Cl.

| | |
|---|---|
| ***A45B 25/10*** | (2006.01) |
| ***A45B 25/18*** | (2006.01) |
| ***A45B 17/00*** | (2006.01) |
| ***A45B 25/14*** | (2006.01) |
| ***A45B 25/02*** | (2006.01) |

(52) U.S. Cl.

CPC ..... *A45B 25/10* (2013.01); *A45B 25/14* (2013.01); *A45B 25/18* (2013.01); *A45B 2023/0012* (2013.01); *A45B 2023/0037* (2013.01); *A45B 2023/0081* (2013.01)

(56) References Cited

U.S. PATENT DOCUMENTS

| | | | | |
|---|---|---|---|---|
| 3,765,434 | A | 10/1973 | Riggs | |
| 4,284,095 | A | 8/1981 | Norton | |
| 4,606,366 | A | 8/1986 | Collet | |
| 5,601,103 | A | 2/1997 | Dubinsky | |
| 5,785,069 | A | 7/1998 | Glatz | |
| D398,443 | S | 9/1998 | Bolle | |
| 5,937,882 | A | 8/1999 | Harbaugh | |
| 6,401,739 | B1 | 6/2002 | Bright | |
| 6,588,438 | B1 | 6/2003 | Steiner | |
| 6,662,815 | B2 | 12/2003 | Tung | |
| 6,662,816 | B1 | 12/2003 | Cunningham | |
| 6,988,504 | B1 | 1/2006 | Goldwitz | |
| 7,134,442 | B2 | 11/2006 | Ma | |
| 7,156,114 | B2 | 1/2007 | Lo | |
| 7,398,790 | B2 | 7/2008 | Glatz | |
| 7,401,618 | B2 | 7/2008 | Caldwell | |
| D621,600 | S | 8/2010 | He | |
| 8,104,492 | B2 | 1/2012 | Dan | |
| 8,360,080 | B2 | 10/2013 | Liu | |
| 8,544,489 | B2 | 10/2013 | Choi | |
| 8,590,554 | B2 | 11/2013 | Choi | |
| 8,985,129 | B2 | 3/2015 | Wang | |
| 9,220,325 | B2 | 12/2015 | Ma | |
| 9,237,785 | B2 | 1/2016 | Ma | |
| 9,243,422 | B2 | 1/2016 | Hunt | |
| 9,289,038 | B2 | 3/2016 | Ma | |
| 9,340,992 | B2 | 5/2016 | Huang | |
| 9,565,907 | B2 | 2/2017 | Ma | |
| D785,201 | S | 4/2017 | Hassman | |
| 9,642,421 | B2 | 5/2017 | Ma | |
| 10,107,005 | B2 | 10/2018 | Song | |
| 10,136,709 | B2 | 11/2018 | Ma | |
| D848,139 | S | 4/2019 | Ma | |
| 2003/0019511 | A1 | 1/2003 | Liu | |
| 2003/0192580 | A1 | 10/2003 | Tung | |
| 2005/0155637 | A1 | 7/2005 | Kim | |
| 2006/0260666 | A1 | 11/2006 | Choi | |
| 2007/0215191 | A1 | 9/2007 | Huang | |
| 2013/0098409 | A1* | 4/2013 | Harbaugh | A45B 11/00 135/16 |
| 2014/0069476 | A1 | 3/2014 | Zimmer | |
| 2014/0261603 | A1 | 9/2014 | LeBlanc | |

* cited by examiner

110

110

WIND-LIFT-ELIMINATING UMBRELLA

1) FIELD OF THE INVENTION

The present invention relates to a folding umbrella, which is economical to produce, is easy to ship as one unit, requires no tools, and can be quickly and easily folded and unfolded. particularly, the present invention relates to an wind-lift-eliminating self-adjusting self-stabilizing reversible-canopy arthritic-aiding umbrella, having:

1) Customizable-wind-flow-directing chapeau system,
2) Self-centering spiral-cone-locking cable-tube system,
3) Arthritic-aiding and canopy-deploying system,
4) Wind-lift-eliminating self-adjusting funnel-and-canopy-tension-adjusting spring system, and
5) Multi-base-connecting canopy base system.

2) DESCRIPTION OF THE PRIOR ART

A number of folding umbrellas have been introduced.

U.S. Pat. No. 2,767,723, issued 1956 Oct. 23, to Isaac Weir Sears Jr., demonstrates the present invention relating to improvements in that type of construction known as a tractor umbrella. One purpose of this invention is to suspend the umbrella from the top, in order to avoid hitting the head of the user, as is common with umbrellas suspended from underneath, as shown by the patent to Ellis, U.S. Pat. No. 2,493,121, issued Jan. 3, 1950. In this prior construction, the umbrella support must be extended far enough below the cover to permit said cover to close, which makes quite a little space below the umbrella top and, additionally, the drivers head is struck by the horizontal support, unless the umbrella top is raised considerably. With my present construction, there is very little projection below the top to interfere with the head of the driver.

U.S. Pat. No. 3,383,814, issued 1968 May 21, to Blaine F Rowe, demonstrates a sunshade utilizing an umbrella supported by a standard having an outwardly extending arm carrying a vertically adjustable cord to which the umbrella is attached. A brace having two parts relatively rotatable about a longitudinal axis, one part being pivoted to the standard and the other part to the umbrella, together with locking means for locking said parts from movement relative to the standard and the umbrella and clamping means for restraining relative rotation between the parts and operating means for the same.

U.S. Pat. No. 3,765,434, issued 1976 Feb. 3, to Helen Cohen, demonstrates an umbrella assembly comprising a generally cylindrical housing, open at its top and closed at its bottom, a removable cover for closing the top of said housing, and a collapsible umbrella within said housing, said umbrella comprising a handle having extensible sections, the bottom of which is swivelly secured to the inner surface of the bottom wall of the housing, whereby when said umbrella is collapsed and the handle sections retracted the entire umbrella fits within said housing and when said cover is removed and said handle sections extended, the handle extends upwardly from said housing whereby when the umbrella is opened it is located substantially above the top edge of the housing, and means permanently securing the housing to any desired article, such as a chair or the like, whereby said assembly is permanently associated with said article so that the umbrella may be completely housed when not in use.

U.S. Pat. No. 4,284,095, issued 1981 Aug. 18, to Don S. Norton, demonstrates an umbrella canopy of flexible sheet material mounted to an umbrella frame having a plurality of ribs radiating from pivotal connection to a frame ring; the umbrella canopy having an apical opening in axial superimposed alignment with the frame ring; an anchor tube under said canopy in axial alignment with said frame ring; the umbrella frame further having a plurality of radiating stretchers, each having one end pivotally mounted to the anchor tube and another end pivotally mounted to a respective rib, so that moving the anchor tube axially towards the frame ring will cause the canopy to be raised to an erected condition from a collapsed condition.

U.S. Pat. No. 4,606,366, issued 1986 Aug. 19, to Jean Collet, demonstrates an umbrella with offset mast, comprising a fixed support structure and at least one fabric cover maintained in position by at least one frame formed of radial ribs hinged to a first hub and counter ribs hinged to a second hub and to the ribs, at least one radial arm hinged to said fixed structure and able to open out between a first position in which the arm is folded against the support structure and an opened out position in which it is held stretched substantially horizontally, locking means for selectively maintaining the radial arm in one or the other of the endmost position, the frame comprising a central truncated mast integral with said one of the hubs, said mast to receive the other hub, further comprising a cable fixed to the mobile hub, which passes into the tubular central mast, is guided by a pulley along the radial arm.

U.S. Pat. No. 5,601,103, issued 1997 Feb. 11, to Emanuel Dubinsky, demonstrates a garden umbrella with a partial top canopy covering the central area of the umbrella and located on the upper side of the canopy ribs, and an underside outer canopy secured to the underside of the canopy ribs and covering at least the outer ring portion of the canopy ribs not covered by such partial top canopy. The underside outer canopy has canopy rib sleeves formed on its top side and adapted for receiving therein the middle and end tip portions of the canopy ribs. The partial top canopy is secured at its outer ends to the upper side of the canopy ribs and the canopy sleeves such that a deep vent is formed between the partial top canopy and the underside outer canopy for venting wind through the space between the two canopies. In one embodiment, the underside outer canopy has a general ring shape with an opening in the center for further venting of wind and updrafts through the center of the umbrella.

U.S. Pat. No. 5,785,069, issued 1998 Jul. 28, to Gustav Adolf Glatz, demonstrates a standing umbrella having a mast on which the inner end of an outwardly and inwardly movable carrier beam is guided with the outer end of the beam carrying an umbrella stick of a collapsible umbrella and with the carrier beam being held by a connecting strut linkedly arranged between the upper end of the mast the carrier beam. A drive mechanism shifts the inner end of the carrier beam along the length of the mast and the mast has two guide tracks spaced from one another and so profiled that guide elements running there along and carried by the inner end of the mast are held by the shape of the tracks against movement transversely to the direction in which the inner end of the carrier beam is shifted; and the drive mechanism for shifting the inner end of the carrier beam and a drive mechanism for opening and closing the umbrella are so combined with one another that they operate simultaneously in common.

U.S. Pat. No. 5,937,882 issued 1999 Aug. 17, to Kenneth A. Harbaugh, demonstrates an umbrella supported by a mast located alongside the umbrella canopy. The umbrella canopy includes a radial arm connected to an element slidably mounted along the mast. A brace pivotably attaches to the arm and extends to the top of the mast. A flexible line extends from a winder within the mast, over a fixed pulley located at the top of a mast, a second pulley mounted on the sliding element, and then travels through the arm and around a third pulley located at the central region of the umbrella. This line operates the opening mechanism of the umbrella, and also selectively moves the slider element along the mast to adjust the tilt of the canopy assembly.

U.S. Pat. No. 6,401,739 issued 2002 Jun. 11, to Robert G. Bright, and John S. Lazarone demonstrates a cantilever umbrella characterized by a folding canopy which is mounted in cantilever fashion on a support post rotatably mounted in a base and can be positioned at a selected location in the orbit of the canopy around the support post for shelter against rain or sunlight. In a preferred embodiment a support arm extends in angular relationship from the support post. A canopy support sleeve is mounted on a descending segment of the support arm, and multiple canopy support ribs which support the canopy are pivotally mounted on the canopy support sleeve in radially-extending relationship therefrom. The canopy of the umbrella is deployed in the open configuration by winding the cable on the winch and thus causing the cable to lift the pulley and attached strut support sleeve as the spreader struts pivot outwardly on the strut support sleeve.

U.S. Pat. No. 6,588,438 issued 2003 Jun. 8, to Walter Steiner, demonstrates a free-arm shade having radial shade ribs, support ribs attached to the latter, and a shade rod slide that is freely attached to support ribs. It also has a decentral pole standing outside the shade. One of the shade ribs is vertically displaceably attached to pole by its outer end, and functions as a side arm, on its top side it is connected to pole tip via an articulated rib, with this shade rib having a pivot joint between the edge of the shade fabric and the pole. Articulated rib is connected to shade rib via a pivot hinge. Shade rib can therefore be pivoted around the axis between pivot joint and pivot hinge so that the entire shade can be tilted sideways in relation to pole.

U.S. Pat. No. 6,662,815 issued 2003 Dec. 16, to Benson Tung, demonstrates a sunshade comprises a supporting rod, a tube supported by the supporting rod, an elbow connected to an end of the tube, and a canopy support frame. A vertical section of the elbow includes two spaced lugs having a space therebetween, an upper wall defining the space including a toothed section. The canopy support frame includes an upper support base having ribs attached thereto for supporting a canopy, a lower support base having stretchers attached thereto for supporting the ribs, and a suspension member fixed to the upper support base to move therewith. The suspension member includes a toothed portion for releasable engagement with the toothed section of the elbow. The toothed portion of the suspension member is engaged with the toothed section of the elbow when the canopy reaches a fully open state.

U.S. Pat. No. 6,662,816 issued 2003 Dec. 16, to George C. Cunningham, demonstrates a covered vent for a tent or canopy consisting of a series of cutouts along the ridge line of a canopy and having a screen fastened to cover the cutouts, a flap fastened to the canopy at one side by stitching and covering the cutouts, and having a series of ties fastened along the length of the second side of the flap, the ties being fastened to the canopy to provide a limited opening to permit air flow when large gusts of air are present and closing when the air gusts are diminished.

U.S. Pat. No. 6,988,504 issued 2006 Jan. 6, to Brian L. Goldwitz, demonstrates an umbrella assembly comprising a base, a pole mounted on the base extending upwardly and outwardly from the base, a carriage slidably mounted on the pole, and an umbrella frame including an adapter releasably engagable with the carriage. A handle is rotatably mounted on the pole, and a cable is coupled at one end to the handle and coupled at another end to the umbrella frame such that by rotating the handle, the cable is retracted and the umbrella is opened, and by rotating the handle in the opposite direction, the cable is released, the umbrella is collapsed, and the carriage is slidable along the pole. The cable is coupled to the adapter such that the adapter may be releasably secured to the umbrella frame to allow the umbrella frame to be tilted and secured in an inclined position.

U.S. Pat. No. 7,134,442 issued 2006 Nov. 14, to Oliver Joen-an Ma, demonstrates an umbrella assembly that comprises a canopy frame, a support pole, an extension mechanism, and a canopy deployment mechanism. The support pole has a first member that has a first end and a second end and a second member. The second member is coupled with the canopy frame and with the first member and is movable relative to the first member between a retracted position and an extended position. The extension mechanism is configured to be driven by a crank handle to move the second member between the retracted position and the extended position. The canopy deployment mechanism is configured to be driven by a crank handle independently of the extension mechanism to open and close the canopy frame.

U.S. Pat. No. 7,156,114 issued 2007 Jan. 2, to Chong-Yi Lo, demonstrates an angle-adjusting device for the canopy of a hang umbrella includes a cantilever divided into a left-sectional cantilever and a right-sectional cantilever, with a connecting plug inserted in between the interiors of the left-sectional and the right-sectional cantilever. The left-sectional cantilever is secured with one end of the connecting plug and the right-sectional cantilever fitted around the other end of the connecting plug by a tightening bolt. By so designing, the outer portion of the cantilever, which is connected with the canopy, can be rotated and adjusted in different angles. Thus, the canopy of the hang umbrella can be adjusted and turned forward and backward as well as leftward and rightward.

U.S. Pat. No. 7,398,790 issued 2008 Jul. 15, to Gustav Adolf Glatz, demonstrates an invention relating to an extension arm that is arranged on a carrier in such a way that it can pivot about the axis thereof by means of a steering rod, and can be blocked in the pivoted position. Said steering rod is arranged on a sleeve that can be pivoted about the extension arm (6), can engage with the extension arm in different rotational angle positions, and can be directly or indirectly blocked on the carrier. According to the invention, a first coupling part fixed to the extension arm co-operates with a second coupling part arranged on the sleeve and acting in the axial direction. Furthermore, the steering rod comprises a supporting element that co-operates with a counterpart arranged on the extension arm, in order to displace the second coupling part in the axial direction by means of the steering rod.

U.S. Pat. No. 7,401,618 issued 2008 Jul. 22, to John W. Caldwell, demonstrates a retractable and deployable umbrella assembly, comprising: a flexible canopy which when flat has a generally rectangular perimeter and a central vent port having a perimeter; a flexible vent cover which when flat has a perimeter that overhangs the perimeter of the vent port; a central upright pole which passes through said vent port said pole having an axis; and an actuator to support, deploy, and retract said canopy and vent cover, the canopy is formed as a dihedral, stretched by said canopy rods over said ridge former rods, said vent covers being attached to said canopy at said ridge and stretched to overhang the vent port, with the vent cover tilted above said canopy, thus with said second hub and third hub raised together, the said dihedral angle will be less than 180 degrees; and with said second and third hubs fully lowered, said struts retract all of said rods and collapse the umbrella to a retracted condition.

U.S. Pat. No. 8,104,492 issued 2012 Jan. 31, to Wu We Dan, demonstrates an adjustable offset umbrella having a generally vertical main pole and a sliding member slidably mounted to the main pole. The sliding member includes a locking mechanism for securing it at a desired location along the main pole. One end of an arm is associated with the sliding member, and the other end supports an umbrella canopy. A winding mechanism is associated with the sliding member and moves with it. A line extends from the winding mechanism to the umbrella canopy. Operating the winding mechanism opens and closes the umbrella canopy, and moving the sliding member up or down the main pole adjusts the angle of the canopy with respect to the main pole.

U.S. Pat. No. 8,360,080 issued 2013 Jan. 29, to Kai Liu and Zhonglin Wang demonstrates an invention relating to an umbrella, particularly a sun umbrella or rain umbrella, comprising a holding structure and an umbrella roof attached thereto by means of a joint, the joint being able to be locked by means of a cable or Bowden wire running through at least one part of the holding structure, characterized in that the joint is designed as a purely rotating joint, wherein an engagement element located on the umbrella roof is connected to the cable or Bowden wire or is otherwise mechanically operationally connected thereto, in order to releaseably engage in a segment of the joint associated with the holding structure to lock the joint.

U.S. Pat. No. 8,544,489 issued 2013 Oct. 1, to Kwan Jun Choi, demonstrates a collapsible tent structure including a plurality of poles coupled with a plurality of linkages. The tent structure also includes a plurality of rods where each rod is pivotally coupled to each pole on one end and pivotally coupled to a hub on an opposite end. A plurality of struts are further included in the tent structure and each strut is pivotally coupled to each rod on one end and pivotally coupled to each pole on an opposite end, and a locking mechanism is coupled to each of the rods. A plurality of eaves, each pivotally coupled to a locking mechanism, extend radially outward beyond the poles when in an extended position and retracted radially inward of the poles when in a retracted position while the tent is in an open configuration.

U.S. Pat. No. 8,590,554 issued 2013 Nov. 26, to Kwan Jun Choi, and Jin Ki Ho demonstrates the present invention providing an instant tent with an integral vent and corresponding rain fly for providing the tent with continuous ventilation while protecting the vent and interior of the tent from adverse weather conditions. The frame of the tent includes a hub, a plurality of roof poles and eave poles pivotally coupled to the hub, and a plurality of leg poles coupled to the corresponding roof poles. Coupled to the frame is an enclosed canopy which includes the vent at a top portion of the canopy to allow air from continuously entering and exiting the interior of the tent. The rain fly is attached to the canopy and corresponding eave pole, and is disposed proximate the vent. Thus, the instant tent of the present invention is provided with secure and continuous ventilation, and is opened and closed without requiring additional assembly of components.

U.S. Pat. No. 8,985,129 issued 2015 Mar. 24, to Ren Li, and Yunsheng Wang, demonstrates the present invention disclosing a sunshade umbrella capable of adjusting umbrella surface angle, including an upright rod and an upright rod handle which moves up and down along the upright rod, wherein one end of the upright rod is connected with umbrella base, the other end of the upright rod is hinged with the connecting rod, the other end of the connecting rod is hinged with a circumferential fixed hanger rod, the hanger rod is hinged with the upright rod handle, an umbrella surface angle adjusting device is mounted on one end of the hanger rod, an executing device that takes the circumferential movement around the hanger rod is mounted on the other end of the hanger rod, and the executing device is connected with an upper umbrella plate. This umbrella has the following advantages: increased overall firmness of the sunshade umbrella, simple structure, and is convenient to operate.

U.S. Pat. No. 9,220,325 issued 2015 Dec. 29, to Oliver Joen-an Ma, demonstrates an umbrella provided herein having a transverse member mounted canopy control module. The umbrella has a support structure and a canopy. The support structure has a first support member having an upper end and a second support member. The second support member has a first end disposed adjacent to the first support member and a second end disposed away from the first end. The second support member extending along a longitudinal axis disposed transverse to the first support member. The canopy has an upper hub. The upper hub is pivotally coupled with the second support member. The umbrella also has an enclosure disposed at the first end of the second support member. A canopy control mechanism is disposed in the enclosure to alter the configuration of the canopy.

U.S. Pat. No. 9,237,785 issued 2016 Jan. 19, to Oliver Joen-an Ma, demonstrates an umbrella assembly comprising: an upright pole; a cantilevered beam having a first end disposed away from the upright pole and a second end disposed adjacent to the upright pole; a canopy frame coupled with the first end of the cantilevered beam; a tilt mechanism operable to rotate the canopy frame about an axis extending through the cantilevered beam, the tilt mechanism including a rotatable shaft disposed in the cantilevered beam; and a clutch mechanism including a first component fixed to the cantilevered beam adjacent to the first end and a second component, the clutch mechanism having an engaged configuration and a disengaged configuration such that when the clutch mechanism is in the disengaged configuration the second component is disposed closer to the upright pole.

U.S. Pat. No. 9,243,422 issued 2016 Jan. 26, to David Lewis Hunt, Gilbert Carl Schmidt, Sean Michael Banal, and Lianzhang Pan, demonstrates a portable shelter framing system disclosed herein. The portable shelter framing system includes a plurality of vertical support members; a plurality of crossbeam members, each of the crossbeam members configured to be connected between a pair of the plurality of vertical support members without the use of tools; and a plurality of roof frame members, each of the roof frame members configured to be coupled to one of the plurality of vertical support members or one of the plurality of crossbeam members without the use of tools. In one or more embodiments, the portable shelter framing system further includes a plurality of connecting members, each of the connecting members configured to couple a respective one of the plurality of roof frame members to a respective one of the plurality of vertical support members or to a respective one of the plurality of crossbeam members without the use of tools.

U.S. Pat. No. 9,289,038 issued 2016 Mar. 22, to Oliver Joen-an Ma, demonstrates an umbrella having a transverse member mounted canopy control module. The umbrella has a support structure and a canopy. The support structure has a first support member having an upper end and a second support member. The second support member has a first end disposed adjacent to the first support member and a second end disposed away from the first end. The second support member extending along a longitudinal axis disposed transverse to the first support member. The canopy has an upper hub. The upper hub is coupled with the second support member. The umbrella also has an enclosure disposed at the first end of the second support member. A canopy control mechanism is at least partially disposed in the enclosure to alter the configuration of the canopy.

U.S. Pat. No. 9,340,992 issued 2016 May 16, to Changjiu Huang, demonstrates the present invention with a collapsible mechanism at the top of a collapsible tent, which comprises a top base and at least two sets of supporting pole sets. The top base comprises an upper pivot base, a lower pivot base and a vertical pole to fix the upper pivot base and the lower pivot base; at least two sets of supporting pole sets are connected to the top base and arranged annularly; each of the supporting pole set comprises a sub-pole, a connecting base and a supporting pole, a first end of the sub-pole is pivot joint with the lower pivot base, a second end of the sub-pole is pivot joint with the supporting pole, the connecting base is pivot joint with the upper pivot base, the connecting base is slidably connected to the sub-pole and form a flexible structure.

U.S. Pat. No. 9,565,907 issued 2017 Feb. 17, to Mark J. S Ma, demonstrates an umbrella having an support arm, a canopy having a support hub defining a first axis, and a pivot joint coupling the support hub to the support structure. The pivot joint is rotatable with respect to the support structure, about a second axis at a fixed angle with respect to the support structure. The pivot joint has a rotatable joint axle rotatably coupled to the support structure, and a tilt joint axle having a first end rotatably coupled to the rotatable joint axle along an interface plane at an angle, and a second end coupled to the support hub, wherein the tilt joint axle defines a longitudinal third axis. The orientation of the canopy can be changed with respect to the support structure by rotating the rotatable joint axle about the second axis.

U.S. Pat. No. 9,642,421 issued 2017 May 9, to Oliver Joen-an Ma, demonstrates an umbrella canopy tilt mechanism provided that can include a crank mechanism and an automatic bending mechanism. The crank mechanism includes a crank and a rope. The crank is configured to be swivel-mounted on one end of the curved cantilever of a sunshade umbrella. The automatic bending mechanism is configured to be installed in a shaft of the sunshade umbrella. One end of the rope is configured to connect to the crank. The other end of the rope is configured to extend along the curved cantilever to reach the other end of the curved cantilever. The rope is configured to extend through the shaft and automatic bending mechanism to connect to a lower runner. The lower runner is held and slides on the shaft. An upper runner is fixedly secured to the shaft. The umbrella canopy tilt mechanism can further be provided with a rotation mechanism.

U.S. Pat. No. 10,107,005 issued 2018 Oct. 23, to Li Bo Song, demonstrates a snap-in and support structure of a tent support is disclosed that includes a tube piece, a tube holder, a handle, a stop piece, and a locking sleeve. A handle slides in an axial direction opposite to that of the tube holder. A locking sleeve includes a boss integrally formed on an inner circumferential wall. The boss has a slidably coupled inner surface and a top surface. The slidably coupled inner surface on a first side ascends from a bottom to a top of the inner circumferential wall. The tube piece is vertically slidable in an axial direction opposite to that of the tube holder and the handle. A first locking pin transversely slides against the slidably coupled inner surface and stops above the top surface and is proximal to a second side of the slidably coupled inner surface in a locking state.

U.S. Pat. No. 10,136,709 issued 2018 Nov. 27, to Oliver Joen-an Ma, demonstrates a cantilever umbrella assembly that includes an upright pole, a runner, a transverse pole, and a canopy. The upright pole includes an upright guide surface. The runner is coupled with the upright pole and has a bearing coupled with the guide surface for guiding the runner along the upright pole. The cantilever umbrella assembly includes a deployable tension member with a first end disposed in the transverse pole and a second end coupled with the canopy.

U.S. Pat. No. D398,443 issued 1998 Sep. 22, to Bernfried Bolle, depicts the ornamental design for an umbrella cap, as shown described.

U.S. Pat. No. D621,600 issued 2010 Aug. 17, to Jianfeng He, depicts the ornamental design for an umbrella cap, as shown described.

U.S. Pat. No. D785,201, issued 2017 Apr. 25, to Ellen Hassman, depicts the ornamental design for an umbrella cap, as shown described.

U.S. Pat. No. D848,139, issued 2019 Apr. 14, to Oliver Joen-an Ma, depicts the ornamental design for an umbrella cap, as shown described.

U.S. Publication No 20030019511, issued 2003 Jan. 30, to Liu Lausan Chung-Hsin, describes an angle adjusting mechanism for hanging parasols being located between a supporting bracket of a hanging parasol and a central shaft of the parasol for adjusting the angle of the parasol to block sunshine, comprising: a hollow housing member having one end opening engaged with an adjusting element which has an anchor strut fastened to the supporting bracket and a turning member located at a lower end thereof capable of turning a selected displacement in the housing member, and an anchor means located in the housing member including a displacement element fastening to the central shaft of the parasol, wherein the turning member is turnable for the selected displacement in the housing member to change the angle of the parasol relative the supporting bracket to block sunshine, and the displacement element being turnable for moving upwards to push the harness element bucking against the adjusting element to keep the hanging parasol stationary at the selected angle.

U.S. Publication No 20030192580, issued 2003 Oct. 16, to Benson Tung, describes a sunshade comprising a supporting rod, a tube supported by the supporting rod, an elbow connected to an end of the tube, and a canopy support frame. A vertical section of the elbow includes two spaced lugs having a space therebetween, an upper wall defining the space including a toothed section. The canopy support frame includes an upper support base having ribs attached thereto for supporting a canopy, a lower support base having stretchers attached thereto for supporting the ribs, and a suspension member fixed to the upper support base to move therewith. The suspension member includes a toothed portion for releasable engagement with the toothed section of the elbow. The toothed portion of the suspension member is engaged with the toothed section of the elbow when the canopy reaches a fully open state.

U.S. Publication No 20050155637A1, issued 2005 Jul. 21, to Kim Dae-Hwan, describes a structure of a canopy including a plurality of pillars, an end portion connection block fixed to an end portion of the pillar, a slide connection block capable of sliding along the pillar, a plurality of roof edge frames, a plurality of roof center frames, a rod connection block connecting the roof edge frame and the roof center frame, an upper head connection block pivoting with respect to the first rod of each of the roof center frames to form an outer top end of the roof, a lower head connection block pivoting with respect to the second rod of each of the roof center frames to form an inner top end of the roof, the roof end connection block and the upper head connection, and a roof cloth covering the roof edge frame and the roof center frame.

U.S. Publication No 20060260666, issued 2006 Nov. 23, to Kwan-Jun Choi, describes the present invention providing a foldable tent frame with a double-roof vent typically comprised of poles, stay bars and roof cross braces hinged on a tip hub, all of them construct the main body of the tent, a small ventilation roof-boom frame connected on the top center of the main body of the tent; said ventilation roof-boom frame is consisted of a central stem, side struts, upper bracing ribs and central rib-hub; said central stem is fastened on the up side of the tip hub with the low end vertically, and fastened on the bottom side of the rib-hub with the top end; each side strut is hinged on one side of the corresponded roof brace with the low end, and hinged on the same side of the coordinated upper bracing rib with the top end.

U.S. Publication No 20070215191, issued 2007 Sep. 20, to Yunshi Huang, Zhu Peixin, and Lee Yul, describes a coupling system for a structure including a frame assembly and a collapsible roof assembly removably coupled to the frame assembly includes a plurality of coupling units. Each coupling unit includes a bracket defining a channel configured to facilitate coupling each coupling unit to the frame assembly and a receptacle configured to receive a member of the roof assembly.

U.S. Publication No 201400694761, issued 2014 Mar. 13, to Zach Zimmer and Brian Cox, describes a tent frame including an upper hub with a plurality of ribs intended to extend outwardly and a lower hub having an equal number of stretchers. The ends of the stretchers are pivotally connected to the ribs. As the lower hub moves upwardly, the stretchers force the ribs outwardly to erect the tent. Flexible cords extend down from the upper hub through the lower hub and out apertures in the bottom of the lower hub. Pulling the cords apart from within the tent causes the lower hub to move upwardly toward the upper hub to erect the tent. Alternatively, the cords can be passed around pulleys in the lower hub and upwardly through apertures in the top of the upper hub.

U.S. Publication No 20140261603, issued 2014 Sep. 18, to Jeffrey J. LeBlanc, and Eva Jean Austin, describes a frame assembly for a flexible structure includes a plurality of leg assemblies and a hub assembly. Each leg assembly includes a longer leg portion and a shorter leg portion that is hingedly connected at one end of the longer leg portion. The hub assembly includes an upper hub hingedly secured to the longer leg portions of the plurality of leg assemblies, a lower hub hingedly secured to the shorter leg portions of the plurality of leg assemblies and configured to be releasably secured to the upper hub, and a cam release secured to the upper hub and configured to release the lower hub. Other embodiments and methods are further disclosed.

Disadvantages of the Prior Art

The prior art have failed to solve many problems associated with such folding umbrellas as follows:

1) No prior art mention or disclose any folding umbrella, having customizable-flow-directing chapeau 103*a*.
   Therefore, the prior art of folding umbrellas:
   a) Can not provide a cover to protect users from weather elements and reduce air pressure, thereby stabilizing the wind-lift-eliminating self-adjusting self-stabilizing reversible-canopy arthritic-aiding umbrella;
   b) Can not redirect wind-flow above customizable-flow-directing chapeau 103*a* to the inside of the wind-lift-eliminating self-adjusting self-stabilizing reversible-canopy arthritic-aiding umbrella;
      in the directions of arrows 142*a*, 142*b*, 143*a*, 143*b*, 144*a*, 144*b*, 145*a*, 145*b*, 145*c*, and 145*d*
      (see FIG. 13A, FIG. 13B, FIG. 13C, FIG. 13D, FIG. 13E, and FIG. 13F).
   c) Can not redirect hot air to flow out and away from underside of the wind-lift-eliminating self-adjusting self-stabilizing reversible-canopy arthritic-aiding umbrella, thereby cooling the environment for the occupants;
      in the directions of arrows 142*a*, 142*b*, 143*a*, 143*b*, 144*a*, 144*b*, 145*c*, and 145*d*
      (see FIG. 13A, FIG. 13B, FIG. 13E, and FIG. 13F);
   d) Can not customize wind-flow direction and pattern from above customizable-flow-directing chapeau 103*a* to the inside of the wind-lift-eliminating self-adjusting self-stabilizing reversible-canopy arthritic-aiding umbrella
      in the directions of arrows 142*a*, 142*b*, 144*a*, 144*b*, 145*c*, and 145*d* (see FIG. 13A, FIG. 13C, FIG. 13E, and FIG. 13F);
   e) Can not release air pressure below the wind-lift-eliminating self-adjusting self-stabilizing reversible-canopy arthritic-aiding umbrella
      in the directions of arrows 142*a*, 142*b*, 143*a*, 143*b*, 144*a*, 144*b*, 145*a*, 145*b*, 145*c*, and 145*d*
      (see FIG. 13C, FIG. 13B, FIG. 13C, FIG. 13D, and FIG. 13F); and
   f) Can not customize volume of air pressure below the wind-lift-eliminating self-adjusting self-stabilizing reversible-canopy arthritic-aiding umbrella
      in the directions of arrows 142*a*, 142*b*, 143*a*, 143*b*, 144*a*, 144*b*, 145*a*, 145*b*, 145*c*, and 145*d*
      (see FIG. 13C, FIG. 13B, FIG. 13C, FIG. 13D, and FIG. 13F).

2) No prior art mention or disclose any folding umbrella, having customizable-flow-directing chapeau control levers 104.
   Therefore, the prior art of folding umbrellas:
   a) Can not control air pressure and the effects of wind-flow under the wind-lift-eliminating self-adjusting self-stabilizing reversible-canopy arthritic-aiding umbrella thereby stabilizing the wind-lift-eliminating self-adjusting self-stabilizing reversible-canopy arthritic-aiding umbrella
      in the directions of arrows 142*a*, 142*b*, 143*a*, 143*b*, 144*a*, 144*b*, 145*a*, 145*b*, 145*c*, and 145*d*
      (see FIG. 13A, FIG. 13B, FIG. 13C, FIG. 13D, FIG. 13E, and FIG. 13F);

b) Can not control to redirect wind-flow above wind-pressure-releasing and cooling-funnel canopy 127 to the inside of the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*c*, and 145*d*
(see FIG. 13A, FIG. 13B, FIG. 13E, and FIG. 13F);

c) Can not control to redirect hot air to flow out and away from underside of the wind-lift-eliminating self-adjusting self-stabilizing reversible-canopy arthritic-aiding umbrella, thereby cooling the environment for the occupants
in the directions of arrows 142*a*, 142*b*, 144*a*, 144*b*, 145*c*, and 145*d* (see FIG. 13A, FIG. 13C, FIG. 13E, and FIG. 13F);

d) Can not control to customize wind-flow direction and pattern from above wind-pressure-releasing and cooling-funnel canopy 127 to the inside of the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*a*, 145*b*, 145*c*, and 145*d*
(see FIG. 13C, FIG. 13B, FIG. 13C, FIG. 13D, and FIG. 13F);

e) Can not control to release the air pressure below the wind-lift-eliminating self-adjusting self-stabilizing reversible-canopy arthritic-aiding umbrella
in the directions of arrows 143*a*, and 143*b*
(see FIG. 13B); and f) Can not control to customize the volume of air pressure below the wind-lift-eliminating self-adjusting self-stabilizing reversible-canopy arthritic-aiding umbrella
in the directions of arrows 145*c* and 145*d*
(see FIG. 13D and FIG. 13F).

3) No prior art mention or disclose any folding umbrella, having arthritic-aiding control tabs 105.
Therefore, the prior art of folding umbrellas:
Can not medicinally beneficially aid a person with an arthritic hand to keep his/her hand straight to eliminate the need for bending his/her fingers and wrist when holding and operating customizable-flow-directing chapeau control levers 104
to require less effort to deploy canopy for those with limited hand mobility due to arthritis.

4) No prior art mention or disclose any folding umbrella, having upper self-centering inverted spiral-locking cone 108.
Therefore, the prior art of folding umbrellas:

a) Can not center upper self-centering inverted spiral-locking cone 108 with lower self-centering spiral-locking cone 109 during deployment of the wind-lift-eliminating self-adjusting self-stabilizing reversible-canopy arthritic-aiding umbrella;

b) Can not prevent the wind-lift-eliminating self-adjusting self-stabilizing reversible-canopy arthritic-aiding umbrella from radially twisting clockwise out of its desired shape;

c) Can not prevent the wind-lift-eliminating self-adjusting self-stabilizing reversible-canopy arthritic-aiding umbrella from radially twisting counterclockwise out of its desired shape; and d) Can not twist-lock upper self-centering inverted spiral-locking cone 108 with lower self-centering spiral-locking cone, thereby preventing easy dislodging of their union and connection.

5) No prior art mention or disclose any folding umbrella, having lower self-centering spiral-locking cone 109.
Therefore, the prior art of folding umbrellas:

a) Can not center lower self-centering spiral-locking cone 109 with upper self-centering inverted spiral-locking cone 108 during deployment of the wind-lift-eliminating self-adjusting self-stabilizing reversible-canopy arthritic-aiding umbrella
in the direction of arrow 146
(see FIG. 5, and FIG. 14);

b) Can not prevent the wind-lift-eliminating self-adjusting self-stabilizing reversible-canopy arthritic-aiding umbrella from radially twisting clockwise out of its desired fit while fully deployed
in the direction of arrow 146
(see FIG. 14);

c) Can not prevent the wind-lift-eliminating self-adjusting self-stabilizing reversible-canopy arthritic-aiding umbrella from radially twisting counterclockwise out of desired fit while fully deployed; and
in the direction of arrow 146
(see FIG. 11, and FIG. 14); and d) Can not twist-lock lower self-centering spiral-locking cone 109 with upper self-centering inverted spiral-locking cone 108, thereby preventing easy dislodging of their union and connection
in the direction of arrow 146
(see FIG. 14).

6) No prior art mention or disclose any folding umbrella, having canopy height-adjusting arthritic-aiding trigger 116.
Therefore, the prior art of folding umbrellas:

a) Can not aid those with arthritic conditions in their hands to operate canopy-height-and-tilt-adjusting arthritic-aiding handle 115 without discomfort
(see FIGS. 6A and 6B);

b) Can not provide means to engage arthritic-aiding and canopy-deploying system 110 to slidably lower and higher canopy-height-and-tilt-adjusting arthritic-aiding handle 115 thereby adjusting the height and tilt of canopy-lifting arm 120
(see FIG. 6A); and c) Can not engage arthritic-aiding trigger pin 117
to predeterminedly and lockably engage to arthritic-aiding-trigger-pin holes 118
(see FIGS. 6A and 6B).

7) No prior art mention or disclose any folding umbrella, having removable arthritic-aiding-canopy-deploying-crank paddle 124.
Therefore, the prior art of folding umbrellas:

a) Can not aid to those with arthritic conditions in their hands
to operate removable arthritic-aiding-canopy-deploying crank 123 without discomfort
in the directions of arrows 147
(see FIG. 15);

b) Can not provide means to engage arthritic-aiding handles and canopy-deploying system 110
to deploy and retract wind-pressure-releasing and cooling-funnel canopy system 126
in the directions of arrows 147
(see FIG. 10 and FIG. 15);

c) Can not provide a paddle-like, flatter, enlarged surface area to be in contact with an arthritic hand
to reduce concentrated pressure areas and to thereby reduce pain and discomfort, such as is not possible with prior art
in the directions of arrows 147
(see FIG. 15);

d) Can not provide ridges at the front and back
to aid those with arthritic hand conditions by helping to easily position and maintain their hands in the center of removable arthritic-aiding-canopy-deploying-crank paddle 124, without slipping off, as prior art would naturally promote
in the directions of arrows 147
(see FIG. 6A, 6B, and FIG. 15); and e) Can not provide ridges at the top and bottom
to aid those with arthritic hand conditions by helping them easily position and maintain their hands in the center of removable arthritic-aiding-canopy-deploying-crank paddle 124, while pushing upwards or downwards
in the directions of arrows 147
(see FIG. 15).

8) No prior art mention or disclose any folding umbrella, having wind-pressure-releasing and cooling-funnel canopy 127.
Therefore, the prior art of folding umbrellas:

a) Can not cover to protect users from weather elements b) Can not release air pressure below the wind-lift-eliminating self-adjusting self-stabilizing reversible-canopy arthritic-aiding umbrella
in the directions of arrows 157*a*, 157*b*, 158*a*, and 158*b* (see FIG. 20C and FIG. 20D);

c) Can not stabilize side-to-side movement from wind gusts, by relieving air pressure from below cooling-funnels 128 of the wind-lift-eliminating self-adjusting self-stabilizing reversible-canopy arthritic-aiding umbrella
in the directions of arrows 150*a*, 150*b*, 150*c*, 150*d*, 151 and 152
(see FIG. 17, 18A, FIG. 18B, and FIG. 18C);

d) Can not eliminate lift from wind gusts of by relieving air pressure from below cooling-funnels 128 of the wind-lift-eliminating self-adjusting self-stabilizing reversible-canopy arthritic-aiding umbrella
in the directions of arrows 157*a*, 157*b*, 158*a*, and 158*b*
(see FIG. 20C and FIG. 20B);

e) Can not eliminate vibration from wind by relieving air pressure from below cooling-funnels 128 of the wind-lift-eliminating self-adjusting self-stabilizing reversible-canopy arthritic-aiding umbrella
in the directions of arrows 148*a*, 148*b*, 149*a* and 149*b*
(see FIG. 16A, FIG. 16B, FIG. 16C, FIG. 16D, and FIG. 16E);

f) Can not customize wind-flow direction and pattern from the sides to the inside of the wind-lift-eliminating self-adjusting self-stabilizing reversible-canopy arthritic-aiding umbrella by adjusting tension of wind-lift-eliminating self-adjusting funnel-and-canopy-tension-adjusting springs 135
in the directions of arrows 148*a*, 148*b*, 149*a*, 148*a*, and 149*b*
(see FIG. 16A, FIG. 16B, FIG. 16C, FIG. 16D, and FIG. 16E); and g) Can not customize the volume of air pressure below the wind-lift-eliminating self-adjusting self-stabilizing reversible-canopy arthritic-aiding umbrella by adjusting tension of wind-lift-eliminating self-adjusting funnel-and-canopy-tension-adjusting springs 135
in the directions of arrows 148*a*, 148*b*, 149*a* and 149*b*
(see FIG. 16A, FIG. 16B, FIG. 16C, FIG. 16D, and FIG. 16E).

9) No prior art mention or disclose any folding umbrella, having cooling-funnels 128.
Therefore, the prior art of folding umbrellas:

a) Can not provide respective wind scoops, guiding the wind-flow inward and downward through the directional cooling-funnels 128
in the directions of arrows 162, 163*b*, and 163*b*
(see FIGS. 21A, and 21B);

b) Can not cool the environment for the occupants under cooling-funnels 128 by adjusting the tilt, and tension of wind-lift-eliminating self-adjusting funnel-and-canopy-tension-adjusting springs 135
in the directions of arrows 162
(see FIG. 21A);

c) Can not release the air pressure from below respective cooling-funnels 128;

d) Can not automatically adjust the air pressure from below by lifting and curling respective cooling-funnels 128 in locations where the wind and pressure are greatest;

e) Can not stabilize side-to-side movement from wind gusts, by the cooling-funnels 128 relieving air pressure by respectively lifting and curling;

f) Can not eliminate umbrella lift from wind gusts by neutralizing and relieving air pressure from below cooling-funnels 128
in the directions of arrows 162*a*, 163*a*, and 163*b*
(see FIGS. 2IA, and 21B);

g) Can not eliminate vibration from wind by relieving air pressure from below cooling-funnels 128
in the directions of arrows 162*a*, 163*a*, and 163*b*
(see FIGS. 21A, and 21B);

h) Can not customize the wind-flow direction and pattern from the sides to the inside of the wind-lift-eliminating self-adjusting self-stabilizing reversible-canopy arthritic-aiding umbrella by adjusting tension of wind-lift-eliminating self-adjusting funnel-and-canopy-tension-adjusting springs 135; and i) Can not adjust the tension of wind-lift-eliminating self-adjusting funnel-and-canopy-tension-adjusting springs 135 to customizing volume of air pressure
in the directions of arrows 162*a*, 163*a*, and 163*b*
(see FIG. 21B).

10) No prior art mention or disclose any folding umbrella, having wind-lift-eliminating self-adjusting funnel-and-canopy-tension-adjusting springs 135.
Therefore, the prior art of folding umbrellas:

a) Can not adjust to customize amount of tension
in the directions of arrows 150*a*, 150*b*, 150*c*, and 150*d*
(see FIG. 17);

b) Can not release the air pressure below the wind-lift-eliminating self-adjusting self-stabilizing reversible-canopy arthritic-aiding umbrella
in the directions of arrows 150*a*, 150*b*, 150*c*, 150*d*, 157*a*, and 157*b*
(see FIGS. 17 and 20C);

c) Can not stabilize the side-to-side movement from wind gusts, by relieving air pressure from below cooling-funnels 128 of the wind-lift-eliminating self-adjusting self-stabilizing reversible-canopy arthritic-aiding umbrella in the directions of arrows 150*a*, 150*b*, 150*c*, 150*d*, 151, 152, 153, and 154
(see FIG. 17, FIG. 18A FIG. 18B, FIG. 19A, FIG. 19B, and FIG. 19C);

d) Can not eliminate lift from wind gusts of by relieving air pressure from below cooling-funnels 128 of the wind-lift-eliminating self-adjusting self-stabilizing reversible-canopy arthritic-aiding umbrella
in the directions of arrows 151, 152, 153, and 154
(see FIG. 18A FIG. 18B, FIG. 19A, FIG. 19B, and FIG. 19C);

e) Can not eliminate vibration from wind by relieving air pressure from below cooling-funnels 128 of the wind-lift-eliminating self-adjusting self-stabilizing reversible-canopy arthritic-aiding umbrella
in the directions of arrows 148*a*, 148*b*, 151, 152, 153, and 154
(see FIG. 16A, 16B, 18A, FIG. 18B, FIG. 19A, FIG. 19B, and FIG. 19C); and f) Can not customize the volume of air pressure below the wind-lift-eliminating self-adjusting self-stabilizing reversible-canopy arthritic-aiding umbrella
in the directions of arrows 149*a*, 149*b*, 156*a*, 156*b*, 156*c*, 156*d*, 156*e*, 156*f*, 156*g*, and 156*h*
(see FIG. 16D, FIG. 16E, and FIG. 20B).

11) No prior art mention or disclose any folding umbrella, having automatic-canopy-spring-centering crescents 136*c*.

Therefore, the prior art of folding umbrellas:

a) Can not protect painted or powder-coated surface of lower-ribs 138
in the directions of arrows 148*a* and 148*b*
(see FIG. 16A and FIG. 16B);

b) Can not re-center reversible wind-lift-eliminating self-adjusting funnel-and-canopy-tension-adjusting springs 135 in respect to the positioning of lower-ribs 138
in the directions of arrows 148*a*
(see FIG. 16A);

c) Can not provide predetermined spacing for reversible wind-lift-eliminating self-adjusting funnel-and-canopy-tension-adjusting springs 135 to rest upon lower-ribs 138
in the directions of arrows 148*a* and 148*b*
(see FIG. 16A and FIG. 16B);

d) Can not eliminate shock for reversible wind-lift-eliminating self-adjusting funnel-and-canopy-tension-adjusting springs 135 when impacting lower-ribs 138
in the directions of arrows 148*a*, 148*b*, 149*a*, 148*a*, and 149*b*
(see FIG. 16A, FIG. 16B, and FIG. 16C);

e) Can not eliminate vibration from reversible wind-lift-eliminating self-adjusting funnel-and-canopy-tension-adjusting springs 135
in the directions of arrows 148*a*
(see FIG. 16A); and f) Can not eliminate noise from reversible wind-lift-eliminating self-adjusting funnel-and-canopy-tension-adjusting springs 135 from impact against lower-ribs 138
in the directions of arrows 148*a*, 148*b*, 149*a*, 148*a*, and 149*b*
(see FIG. 16A, FIG. 16B, and FIG. 16C).

12) No prior art mention or disclose any folding umbrella, having multi-base-connecting canopy-base plates 141*b*.

Therefore, the prior art of folding umbrellas:

a) Can not connect multiple multi-base-connecting canopy-base plates 141*b* of other wind-lift-eliminating self-adjusting self-stabilizing reversible-canopy arthritic-aiding umbrellas
to secure multiple wind-lift-eliminating self-adjusting self-stabilizing reversible-canopy arthritic-aiding umbrellas together
in the directions of arrows 167*a*, 167*b*, 168*a*, 168*a*, 169*a*, and 169*b*
(see FIG. 23A, FIG. 23B, and FIG. 23C);

b) Can not connect multiple multi-base-connecting canopy-base plates 141*b* of other wind-lift-eliminating self-adjusting self-stabilizing reversible-canopy arthritic-aiding umbrellas
to increase the footprint thereof, thereby providing greater stability from the effects of winds and rain
(see FIG. 24A);

c) Can not connect multiple multi-base-connecting canopy-base plates 141*b* of other wind-lift-eliminating self-adjusting self-stabilizing reversible-canopy arthritic-aiding umbrellas
to provide connected combinations of wind-lift-eliminating self-adjusting self-stabilizing reversible-canopy arthritic-aiding umbrellas for saving space when configured on decks, patios, pool-sides, balconies, verandas, sidewalks, food courts, and in restaurants
(see FIG. 24A, FIG. 24B, FIG. 24C, and FIG. 24D); and d) Can not connect multiple multi-base-connecting canopy-base plates 141*b* of other wind-lift-eliminating self-adjusting self-stabilizing reversible-canopy arthritic-aiding umbrellas
to provide connected combinations of wind-lift-eliminating self-adjusting self-stabilizing reversible-canopy arthritic-aiding umbrellas to provide many variable aesthetic and design configurations to table and lounge chair configurations on decks, patios, pool-sides, balconies, verandas, sidewalks, food courts, and in restaurants
(see FIG. 24A, FIG. 24B, FIG. 24C, and FIG. 24D).

13) No prior art mention or disclose any folding umbrella, having multi-base-connecting locking slots 141*c*.

Therefore, the prior art of folding umbrellas:

a) Can not connect multiple multi-base-connecting canopy-base plates 141*b* of other wind-lift-eliminating self-adjusting self-stabilizing reversible-canopy arthritic-aiding umbrellas
to secure multiple wind-lift-eliminating self-adjusting self-stabilizing reversible-canopy arthritic-aiding umbrellas together
in the directions of arrows 167*a*, 167*b*, 168*a*, 168*a*, 169*a*, and 169*b*
(see FIG. 23A, FIG. 23B, and FIG. 23C);

b) Can not connect multiple multi-base-connecting canopy-base plates 141*b* of other wind-lift-eliminating self-adjusting self-stabilizing reversible-canopy arthritic-aiding umbrellas
to increase the footprint thereof, thereby providing greater stability from the effects of winds and rain
(see FIG. 24A);

c) Can not connect multiple multi-base-connecting canopy-base plates 141*b* of other wind-lift-eliminating self-adjusting self-stabilizing reversible-canopy arthritic-aiding umbrellas
to provide connected combinations of wind-lift-eliminating self-adjusting self-stabilizing reversible-canopy arthritic-aiding umbrellas for saving space when configured on decks, patios, pool-sides, balconies, verandas, sidewalks, food courts, and in restaurants (see FIG. 24A, FIG. 24B, FIG. 24C, and FIG. 24D); and d) Can not connect multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas to provide many variable aesthetic and design configurations to table and lounge chair configurations on decks, patios, pool-sides, balconies, verandas, sidewalks, food courts, and in restaurants (see FIG. 24A, FIG. 24B, FIG. 24C, and FIG. 24D).

Objects and Advantages of the Invention

The present invention substantially departs from the conventional concepts and designs of the prior art. In doing so, the present invention provides a wind-lift-eliminating self-adjusting self-stabilizing reversible-canopy arthritic-aiding umbrella (having: a) Customizable-wind-flow-directing chapeau system, b) Self-centering spiral-cone-locking cable-tube system, c) Arthritic-aiding and canopy-deploying system, d) Wind-pressure-releasing and cooling-funnel canopy system, and f) Canopy base system), having many new and significant features, functions, and advantages, which overcome all the disadvantages of the prior art, as follows:

1) It is an object of the new invention to provide a wind-lift-eliminating self-adjusting self-stabilizing reversible-canopy arthritic-aiding umbrella, having customizable-flow-directing chapeau 103*a*.

Therefore, the wind-lift-eliminating self-adjusting self-stabilizing reversible-canopy arthritic-aiding umbrella:

a) Can provide a cover to protect users from weather elements and reduce air pressure, thereby stabilizing the wind-lift-eliminating self-adjusting self-stabilizing reversible-canopy arthritic-aiding umbrella;

b) Can redirect wind-flow above customizable-flow-directing chapeau 103*a* to the inside of the wind-lift-eliminating self-adjusting self-stabilizing reversible-canopy arthritic-aiding umbrella;

in the directions of arrows 142*a*, 142*b*, 143*a*, 143*b*, 144*a*, 144*b*, 145*a*, 145*b*, 145*c*, and 145*d*

(see FIG. 13A, FIG. 13B, FIG. 13C, FIG. 13D, FIG. 13E, and FIG. 13F).

c) Can redirect hot air to flow out and away from underside of the wind-lift-eliminating self-adjusting self-stabilizing reversible-canopy arthritic-aiding umbrella, thereby cooling the environment for the occupants;

in the directions of arrows 142*a*, 142*b*, 143*a*, 143*b*, 144*a*, 144*b*, 145*c*, and 145*d*

(see FIG. 13A, FIG. 13B, FIG. 13E, and FIG. 13F);

d) Can customize wind-flow direction and pattern from above customizable-flow-directing chapeau 103*a* to the inside of the wind-lift-eliminating self-adjusting self-stabilizing reversible-canopy arthritic-aiding umbrella in the directions of arrows 142*a*, 142*b*, 144*a*, 144*b*, 145*c*, and 145*d*

(see FIG. 13A, FIG. 13C, FIG. 13E, and FIG. 13F);

e) Can release air pressure below the wind-lift-eliminating self-adjusting self-stabilizing reversible-canopy arthritic-aiding umbrella in the directions of arrows 142*a*, 142*b*, 143*a*, 143*b*, 144*a*, 144*b*, 145*a*, 145*b*, 145*c*, and 145*d*

(see FIG. 13C, FIG. 13B, FIG. 13C, FIG. 13D, and FIG. 13F); and f) Can customize volume of air pressure below the wind-lift-eliminating self-adjusting self-stabilizing reversible-canopy arthritic-aiding umbrella in the directions of arrows 142*a*, 142*b*, 143*a*, 143*b*, 144*a*, 144*b*, 145*a*, 145*b*, 145*c*, and 145*d*

(see FIG. 13C, FIG. 13B, FIG. 13C, FIG. 13D, and FIG. 13F).

2) It is another object of the new invention to provide a wind-lift-eliminating self-adjusting self-stabilizing reversible-canopy arthritic-aiding umbrella, having customizable-flow-directing chapeau control levers 104.

Therefore, the wind-lift-eliminating self-adjusting self-stabilizing reversible-canopy arthritic-aiding umbrella:

a) Can control air pressure and the effects of wind-flow under the wind-lift-eliminating self-adjusting self-stabilizing reversible-canopy arthritic-aiding umbrella thereby stabilizing the wind-lift-eliminating self-adjusting self-stabilizing reversible-canopy arthritic-aiding umbrella in the directions of arrows 142*a*, 142*b*, 143*a*, 143*b*, 144*a*, 144*b*, 145*a*, 145*b*, 145*c*, and 145*d*

(see FIG. 13A, FIG. 13B, FIG. 13C, FIG. 13D, FIG. 13E, and FIG. 13F);

b) Can control to redirect wind-flow above wind-pressure-releasing and cooling-funnel canopy 127 to the inside of the wind-lift-eliminating self-adjusting self-stabilizing reversible-canopy arthritic-aiding umbrella in the directions of arrows 142*a*, 142*b*, 143*a*, 143*b*, 144*a*, 144*b*, 145*c*, and 145*d*

(see FIG. 13A, FIG. 13B, FIG. 13E, and FIG. 13F);

c) Can control to redirect hot air to flow out and away from underside of the wind-lift-eliminating self-adjusting self-stabilizing reversible-canopy arthritic-aiding umbrella, thereby cooling the environment for the occupants in the directions of arrows 142*a*, 142*b*, 144*a*, 144*b*, 145*c*, and 145*d*

(see FIG. 13A, FIG. 13C, FIG. 13E, and FIG. 13F);

d) Can control to customize wind-flow direction and pattern from above wind-pressure-releasing and cooling-funnel canopy 127 to the inside of the wind-lift-eliminating self-adjusting self-stabilizing reversible-canopy arthritic-aiding umbrella in the directions of arrows 142*a*, 142*b*, 143*a*, 143*b*, 144*a*, 144*b*, 145*a*, 145*b*, 145*c*, and 145*d*

(see FIG. 13C, FIG. 13B, FIG. 13C, FIG. 13D, and FIG. 13F);

e) Can control to release the air pressure below the wind-lift-eliminating self-adjusting self-stabilizing reversible-canopy arthritic-aiding umbrella in the directions of arrows 143*a*, and 143*b*

(see FIG. 13B); and f) Can control to customize the volume of air pressure below the wind-lift-eliminating self-adjusting self-stabilizing reversible-canopy arthritic-aiding umbrella in the directions of arrows 145*c* and 145*d*

(see FIG. 13D and FIG. 13F).

3) It is another object of the new invention to provide a wind-lift-eliminating self-adjusting self-stabilizing reversible-canopy arthritic-aiding umbrella, having arthritic-aiding control tabs 105.
Therefore, the wind-lift-eliminating self-adjusting self-stabilizing reversible-canopy arthritic-aiding umbrella:
Can medicinally beneficially aid a person with an arthritic hand to keep his/her hand straight to eliminate the need for bending his/her fingers and wrist when holding and operating customizable-flow-directing chapeau control levers 104
to require less effort to deploy canopy for those with limited hand mobility due to arthritis.

4) It is a further object of the new invention to provide a wind-lift-eliminating self-adjusting self-stabilizing reversible-canopy arthritic-aiding umbrella, having upper self-centering inverted spiral-locking cone 108.
Therefore, the wind-lift-eliminating self-adjusting self-stabilizing reversible-canopy arthritic-aiding umbrella:
a) Can center upper self-centering inverted spiral-locking cone 108 with lower self-centering spiral-locking cone 109 during deployment of the wind-lift-eliminating self-adjusting self-stabilizing reversible-canopy arthritic-aiding umbrella;
b) Can prevent the wind-lift-eliminating self-adjusting self-stabilizing reversible-canopy arthritic-aiding umbrella from radially twisting clockwise out of its desired shape;
c) Can prevent the wind-lift-eliminating self-adjusting self-stabilizing reversible-canopy arthritic-aiding umbrella from radially twisting counterclockwise out of its desired shape; and
d) Can twist-lock upper self-centering inverted spiral-locking cone 108 with lower self-centering spiral-locking cone, thereby preventing easy dislodging of their union and connection.

5) It is an even further object of the new invention to provide a wind-lift-eliminating self-adjusting self-stabilizing reversible-canopy arthritic-aiding umbrella, having lower self-centering spiral-locking cone 109.
Therefore, the wind-lift-eliminating self-adjusting self-stabilizing reversible-canopy arthritic-aiding umbrella:
a) Can center lower self-centering spiral-locking cone 109 with upper self-centering inverted spiral-locking cone 108 during deployment of the wind-lift-eliminating self-adjusting self-stabilizing reversible-canopy arthritic-aiding umbrella
in the direction of arrow 146
(see FIG. 5, and FIG. 14);
b) Can prevent the wind-lift-eliminating self-adjusting self-stabilizing reversible-canopy arthritic-aiding umbrella from radially twisting clockwise out of its desired fit while fully deployed
in the direction of arrow 146
(see FIG. 14);
c) Can prevent the wind-lift-eliminating self-adjusting self-stabilizing reversible-canopy arthritic-aiding umbrella from radially twisting counterclockwise out of desired fit while fully deployed; and
in the direction of arrow 146
(see FIG. 11, and FIG. 14); and
d) Can twist-lock lower self-centering spiral-locking cone 109 with upper self-centering inverted spiral-locking cone 108, thereby preventing easy dislodging of their union and connection
in the direction of arrow 146
(see FIG. 14).

6) It is another object of the new invention to provide a wind-lift-eliminating self-adjusting self-stabilizing reversible-canopy arthritic-aiding umbrella, having canopy height-adjusting arthritic-aiding trigger 116.
Therefore, the wind-lift-eliminating self-adjusting self-stabilizing reversible-canopy arthritic-aiding umbrella:
a) Can aid those with arthritic conditions in their hands
to operate canopy-height-and-tilt-adjusting arthritic-aiding handle 115 without discomfort
(see FIGS. 6A and 6B);
b) Can provide means to engage arthritic-aiding and canopy-deploying system 110 to slidably lower and higher canopy-height-and-tilt-adjusting arthritic-aiding handle 115 thereby adjusting the height and tilt of canopy-lifting arm 120
(see FIG. 6A); and
c) Can engage arthritic-aiding trigger pin 117
to predeterminedly and lockably engage to arthritic-aiding-trigger-pin holes 118
(see FIGS. 6A and 6B).

7) It is yet another object of the new invention to provide a wind-lift-eliminating self-adjusting self-stabilizing reversible-canopy arthritic-aiding umbrella, having removable arthritic-aiding-canopy-deploying-crank paddle 124.
Therefore, the wind-lift-eliminating self-adjusting self-stabilizing reversible-canopy arthritic-aiding umbrella:
a) Can aid to those with arthritic conditions in their hands
to operate removable arthritic-aiding-canopy-deploying crank 123 without discomfort
in the directions of arrows 147
(see FIG. 15);
b) Can provide means to engage arthritic-aiding handles and canopy-deploying system 110
to deploy and retract wind-pressure-releasing and cooling-funnel canopy system 126
in the directions of arrows 147
(see FIG. 10 and FIG. 15);
c) Can provide a paddle-like, flatter, enlarged surface area to be in contact with an arthritic hand
to reduce concentrated pressure areas and to thereby reduce pain and discomfort, such as is not possible with prior art
in the directions of arrows 147
(see FIG. 15);
d) Can provide ridges at the front and back
to aid those with arthritic hand conditions by helping to easily position and maintain their hands in the center of removable arthritic-aiding-canopy-deploying-crank paddle 124, without slipping off, as prior art would naturally promote
in the directions of arrows 147
(see FIG. 6A, 6B, and FIG. 15); and
e) Can provide ridges at the top and bottom
to aid those with arthritic hand conditions by helping them easily position and maintain their hands in the center of removable arthritic-aiding-canopy-deploying-crank paddle 124, while pushing upwards or downwards
in the directions of arrows 147
(see FIG. 15).

8) It is still yet another object of the new invention to provide a wind-lift-eliminating self-adjusting self-stabilizing reversible-canopy arthritic-aiding umbrella, having wind-pressure-releasing and cooling-funnel canopy 127.

Therefore, the wind-lift-eliminating self-adjusting self-stabilizing reversible-canopy arthritic-aiding umbrella:

a) Can cover to protect users from weather elements b) Can release air pressure below the wind-lift-eliminating self-adjusting self-stabilizing reversible-canopy arthritic-aiding umbrella
in the directions of arrows 157*a*, 157*b*, 158*a*, and 158*b*
(see FIG. 20C and FIG. 20D);

c) Can stabilize side-to-side movement from wind gusts, by relieving air pressure from below cooling-funnels 128 of the wind-lift-eliminating self-adjusting self-stabilizing reversible-canopy arthritic-aiding umbrella
in the directions of arrows 150*a*, 150*b*, 150*c*, 150*d*, 151 and 152
(see FIG. 17, 18A, FIG. 18B, and FIG. 18C);

d) Can eliminate lift from wind gusts of by relieving air pressure from below cooling-funnels 128 of the wind-lift-eliminating self-adjusting self-stabilizing reversible-canopy arthritic-aiding umbrella
in the directions of arrows 157*a*, 157*b*, 158*a*, and 158*b*
(see FIG. 20C and FIG. 20B);

e) Can eliminate vibration from wind by relieving air pressure from below cooling-funnels 128 of the wind-lift-eliminating self-adjusting self-stabilizing reversible-canopy arthritic-aiding umbrella
in the directions of arrows 148*a*, 148*b*, 149*a* and 149*b*
(see FIG. 16A, FIG. 16B, FIG. 16C, FIG. 16D, and FIG. 16E);

f) Can customize wind-flow direction and pattern from the sides to the inside of the wind-lift-eliminating self-adjusting self-stabilizing reversible-canopy arthritic-aiding umbrella by adjusting tension of wind-lift-eliminating self-adjusting funnel-and-canopy-tension-adjusting springs 135
in the directions of arrows 148*a*, 148*b*, 149*a*, 148*a*, and 149*b*
(see FIG. 16A, FIG. 16B, FIG. 16C, FIG. 16D, and FIG. 16E); and g) Can customize the volume of air pressure below the wind-lift-eliminating self-adjusting self-stabilizing reversible-canopy arthritic-aiding umbrella by adjusting tension of wind-lift-eliminating self-adjusting funnel-and-canopy-tension-adjusting springs 135
in the directions of arrows 148*a*, 148*b*, 149*a* and 149*b*
(see FIG. 16A, FIG. 16B, FIG. 16C, FIG. 16D, and FIG. 16E).

9) It is still yet another object of the new invention to provide a wind-lift-eliminating self-adjusting self-stabilizing reversible-canopy arthritic-aiding umbrella, having cooling-funnels 128.

Therefore, the wind-lift-eliminating self-adjusting self-stabilizing reversible-canopy arthritic-aiding umbrella:

a) Can provide respective wind scoops, guiding the wind-flow inward and downward through the directional cooling-funnels 128
in the directions of arrows 162, 163*b*, and 163*b*
(see FIGS. 21A, and 21B);

b) Can cool the environment for the occupants under cooling-funnels 128 by adjusting the tilt, and tension of wind-lift-eliminating self-adjusting funnel-and-canopy-tension-adjusting springs 135
in the directions of arrows 162
(see FIG. 21A);

c) Can release the air pressure from below respective cooling-funnels 128;

d) Can automatically adjust the air pressure from below by lifting and curling respective cooling-funnels 128 in locations where the wind and pressure are greatest;

e) Can stabilize side-to-side movement from wind gusts, by the cooling-funnels 128 relieving air pressure by respectively lifting and curling;

f) Can eliminate umbrella lift from wind gusts by neutralizing and relieving air pressure from below cooling-funnels 128
in the directions of arrows 162*a*, 163*a*, and 163*b*
(see FIGS. 2IA, and 21B);

g) Can eliminate vibration from wind by relieving air pressure from below cooling-funnels 128
in the directions of arrows 162*a*, 163*a*, and 163*b*
(see FIGS. 21A, and 21B);

h) Can customize the wind-flow direction and pattern from the sides to the inside of the wind-lift-eliminating self-adjusting self-stabilizing reversible-canopy arthritic-aiding umbrella by adjusting tension of wind-lift-eliminating self-adjusting funnel-and-canopy-tension-adjusting springs 135; and i) Can adjust the tension of wind-lift-eliminating self-adjusting funnel-and-canopy-tension-adjusting springs 135 to customizing volume of air pressure
in the directions of arrows 162*a*, 163*a*, and 163*b*
(see FIG. 21B).

10) It is still yet another object of the new invention to provide a wind-lift-eliminating self-adjusting self-stabilizing reversible-canopy arthritic-aiding umbrella, having wind-lift-eliminating self-adjusting funnel-and-canopy-tension-adjusting springs 135.

Therefore, the wind-lift-eliminating self-adjusting self-stabilizing reversible-canopy arthritic-aiding umbrella:

a) Can adjust to customize amount of tension
in the directions of arrows 150*a*, 150*b*, 150*c*, and 150*d*
(see FIG. 17);

b) Can release the air pressure below the wind-lift-eliminating self-adjusting self-stabilizing reversible-canopy arthritic-aiding umbrella
in the directions of arrows 150*a*, 150*b*, 150*c*, 150*d*, 157*a*, and 157*b* (see FIGS. 17 and 20C);

c) Can stabilize the side-to-side movement from wind gusts, by relieving air pressure from below cooling-funnels 128 of the wind-lift-eliminating self-adjusting self-stabilizing reversible-canopy arthritic-aiding umbrella
in the directions of arrows 150*a*, 150*b*, 150*c*, 150*d*, 151, 152, 153, and 154
(see FIG. 17, FIG. 18A FIG. 18B, FIG. 19A, FIG. 19B, and FIG. 19C);

d) Can eliminate lift from wind gusts of by relieving air pressure from below cooling-funnels 128 of the wind-lift-eliminating self-adjusting self-stabilizing reversible-canopy arthritic-aiding umbrella
in the directions of arrows 151, 152, 153, and 154
(see FIG. 18A FIG. 18B, FIG. 19A, FIG. 19B, and FIG. 19C);

e) Can eliminate vibration from wind by relieving air pressure from below cooling-funnels 128 of the wind-lift-eliminating self-adjusting self-stabilizing reversible-canopy arthritic-aiding umbrella in the directions of arrows 148*a*, 148*b*, 151, 152, 153, and 154
(see FIG. 16A, 16B, 18A, FIG. 18B, FIG. 19A, FIG. 19B, and FIG. 19C); and f) Can customize the volume of air pressure below the wind-lift-eliminating self-adjusting self-stabilizing reversible-canopy arthritic-aiding umbrella
in the directions of arrows 149*a*, 149*b*, 156*a*, 156*b*, 156*c*, 156*d*, 156*e*, 156*f*, 156*g*, and 156*h*
(see FIG. 16D, FIG. 16E, and FIG. 20B).

11) It is still another object of the new invention to provide a wind-lift-eliminating self-adjusting self-stabilizing reversible-canopy arthritic-aiding umbrella, having automatic-canopy-spring-centering crescents 136*c*.

Therefore, the wind-lift-eliminating self-adjusting self-stabilizing reversible-canopy arthritic-aiding umbrella:

a) Can protect painted or powder-coated surface of lower-ribs 138
in the directions of arrows 148*a* and 148*b*
(see FIG. 16A and FIG. 16B);

b) Can re-center reversible wind-lift-eliminating self-adjusting funnel-and-canopy-tension-adjusting springs 135 in respect to the positioning of lower-ribs 138
in the directions of arrows 148*a*
(see FIG. 16A);

c) Can provide predetermined spacing for reversible wind-lift-eliminating self-adjusting funnel-and-canopy-tension-adjusting springs 135 to rest upon lower-ribs 138
in the directions of arrows 148*a* and 148*b*
(see FIG. 16A and FIG. 16B);

d) Can eliminate shock for reversible wind-lift-eliminating self-adjusting funnel-and-canopy-tension-adjusting springs 135 when impacting lower-ribs 138
in the directions of arrows 148*a*, 148*b*, 149*a*, 148*a*, and 149*b*
(see FIG. 16A, FIG. 16B, and FIG. 16C);

e) Can eliminate vibration from reversible wind-lift-eliminating self-adjusting funnel-and-canopy-tension-adjusting springs 135
in the directions of arrows 148*a*
(see FIG. 16A); and f) Can eliminate noise from reversible wind-lift-eliminating self-adjusting funnel-and-canopy-tension-adjusting springs 135 from impact against lower-ribs 138
in the directions of arrows 148*a*, 148*b*, 149*a*, 148*a*, and 149*b*
(see FIG. 16A, FIG. 16B, and FIG. 16C).

12) It is another object of the new invention to provide a wind-lift-eliminating self-adjusting self-stabilizing reversible-canopy arthritic-aiding umbrella, having multi-base-connecting canopy-base plates 141*b*.

Therefore, the wind-lift-eliminating self-adjusting self-stabilizing reversible-canopy arthritic-aiding umbrella:

a) Can connect multiple multi-base-connecting canopy-base plates 141*b* of other wind-lift-eliminating self-adjusting self-stabilizing reversible-canopy arthritic-aiding umbrellas
to secure multiple wind-lift-eliminating self-adjusting self-stabilizing reversible-canopy arthritic-aiding umbrellas together
in the directions of arrows 167*a*, 167*b*, 168*a*, 168*a*, 169*a*, and 169*b*
(see FIG. 23A, FIG. 23B, and FIG. 23C);

b) Can connect multiple multi-base-connecting canopy-base plates 141*b* of other wind-lift-eliminating self-adjusting self-stabilizing reversible-canopy arthritic-aiding umbrellas
to increase the footprint thereof, thereby providing greater stability from the effects of winds and rain
(see FIG. 24A);

c) Can connect multiple multi-base-connecting canopy-base plates 141*b* of other wind-lift-eliminating self-adjusting self-stabilizing reversible-canopy arthritic-aiding umbrellas
to provide connected combinations of wind-lift-eliminating self-adjusting self-stabilizing reversible-canopy arthritic-aiding umbrellas for saving space when configured on decks, patios, pool-sides, balconies, verandas, sidewalks, food courts, and in restaurants
(see FIG. 24A, FIG. 24B, FIG. 24C, and FIG. 24D); and d) Can connect multiple multi-base-connecting canopy-base plates 141*b* of other wind-lift-eliminating self-adjusting self-stabilizing reversible-canopy arthritic-aiding umbrellas
to provide connected combinations of wind-lift-eliminating self-adjusting self-stabilizing reversible-canopy arthritic-aiding umbrellas to provide many variable aesthetic and design configurations to table and lounge chair configurations on decks, patios, pool-sides, balconies, verandas, sidewalks, food courts, and in restaurants
(see FIG. 24A, FIG. 24B, FIG. 24C, and FIG. 24D).

13) It is another object of the new invention to provide a wind-lift-eliminating self-adjusting self-stabilizing reversible-canopy arthritic-aiding umbrella, having multi-base-connecting locking slots 141*c*.

Therefore, the wind-lift-eliminating self-adjusting self-stabilizing reversible-canopy arthritic-aiding umbrella:

a) Can connect multiple multi-base-connecting canopy-base plates 141*b* of other wind-lift-eliminating self-adjusting self-stabilizing reversible-canopy arthritic-aiding umbrellas
to secure multiple wind-lift-eliminating self-adjusting self-stabilizing reversible-canopy arthritic-aiding umbrellas together
in the directions of arrows 167*a*, 167*b*, 168*a*, 168*a*, 169*a*, and 169*b*
(see FIG. 23A, FIG. 23B, and FIG. 23C);

b) Can connect multiple multi-base-connecting canopy-base plates 141*b* of other wind-lift-eliminating self-adjusting self-stabilizing reversible-canopy arthritic-aiding umbrellas
to increase the footprint thereof, thereby providing greater stability from the effects of winds and rain
(see FIG. 24A);

c) Can connect multiple multi-base-connecting canopy-base plates 141*b* of other wind-lift-eliminating self-adjusting self-stabilizing reversible-canopy arthritic-aiding umbrellas
to provide connected combinations of wind-lift-eliminating self-adjusting self-stabilizing reversible-canopy arthritic-aiding umbrellas for saving space when configured on decks, patios, pool-sides, balconies, verandas, sidewalks, food courts, and in restaurants
(see FIG. 24A, FIG. 24B, FIG. 24C, and FIG. 24D); and d) Can connect multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas to provide many variable aesthetic and design configurations to table and lounge chair configurations on decks, patios, pool-sides, balconies, verandas, sidewalks, food courts, and in restaurants (see FIG. 24A, FIG. 24B, FIG. 24C, and FIG. 24D).

Other objects and advantages of the present invention will become apparent from a consideration of the accompanying drawings and ensuing description.

BRIEF SUMMARY OF THE INVENTION

A wind-lift-eliminating self-adjusting self-stabilizing arthritic-aiding umbrella comprises: a flow-directing chapeau attached to a chapeau crown, an upper cone rotatably attached to a cable conduit for preventing the umbrella from radially twisting clockwise and counterclockwise out of shape, a lower tube for centering the upper cone, a stanchion, an intersector bolted to the stanchion, a supporting-arm intersector, a top-hub, a canopy-height-and-tilt-adjusting arthritic-hand-aiding handle slidably connected to the stanchion, a height-adjusting arthritic-hand-aiding trigger springably and pivotably attached to the handle for providing aid to arthritic hands to operate the handle without discomfort and for providing means to slidably lower and raise the handle to adjust the umbrella, a supporting arm pivotably attached to the lifting-arm intersector and the supporting-arm intersector, a lifting arm pivotably attached to the handle and the top-hub intersector, the supporting-arm intersector pivotably attached to the lifting arm, a deploying cable, a cable spool molded into the handle and attached to the cable, an arthritic-hand-aiding crank, an arthritic-hand-aiding-crank paddle rotatably connected to the crank for providing aid to arthritic hands to operate the crank providing means to deploy and retract the umbrella without discomfort, a reversible wind-pressure-releasing and cooling-funnel canopy for providing a cover to protect users from weather elements and for releasing air pressure below the umbrella, an opening is cut into the canopy, a top-hub-ring, the cable conduit rotatably attached to the top-hub-ring, the top-hub intersector pivotably attached to the top-hub-ring, a bottom-shuttle-hub-ring, the lower cone rotatably attached to the bottom-shuttle-hub-ring, the cable connected to the bottom hub-ring, upper-ribs, wind-lift-eliminating self-adjusting funnel-and-canopy-tension-adjusting springs for adjustably tensioning the canopy and for customizingly relieving air pressure below the umbrella to stabilize and to eliminate lift and vibration from wind gusts, adjustable-tension-canopy-spring brackets springably securing the wind-lift-eliminating self-adjusting funnel-and-canopy-tension-adjusting springs to the upper-ribs, lower-ribs pivotably screwed to the bottom-shuttle-hub-ring and the upper-ribs, a stanchion base-mounting plate attached to the stanchion, and base-stabilizing feet bolted to the base-mounting-plate.

BRIEF DESCRIPTION OF THE DRAWINGS

FIG. 9 illustrates a perspective view of the wind-lift-eliminating self-adjusting self-stabilizing reversible-canopy arthritic-aiding umbrella and the canopy-spring mounting holes punched there through.

DETAILED DESCRIPTION OF THE INVENTION

Figure 1A:
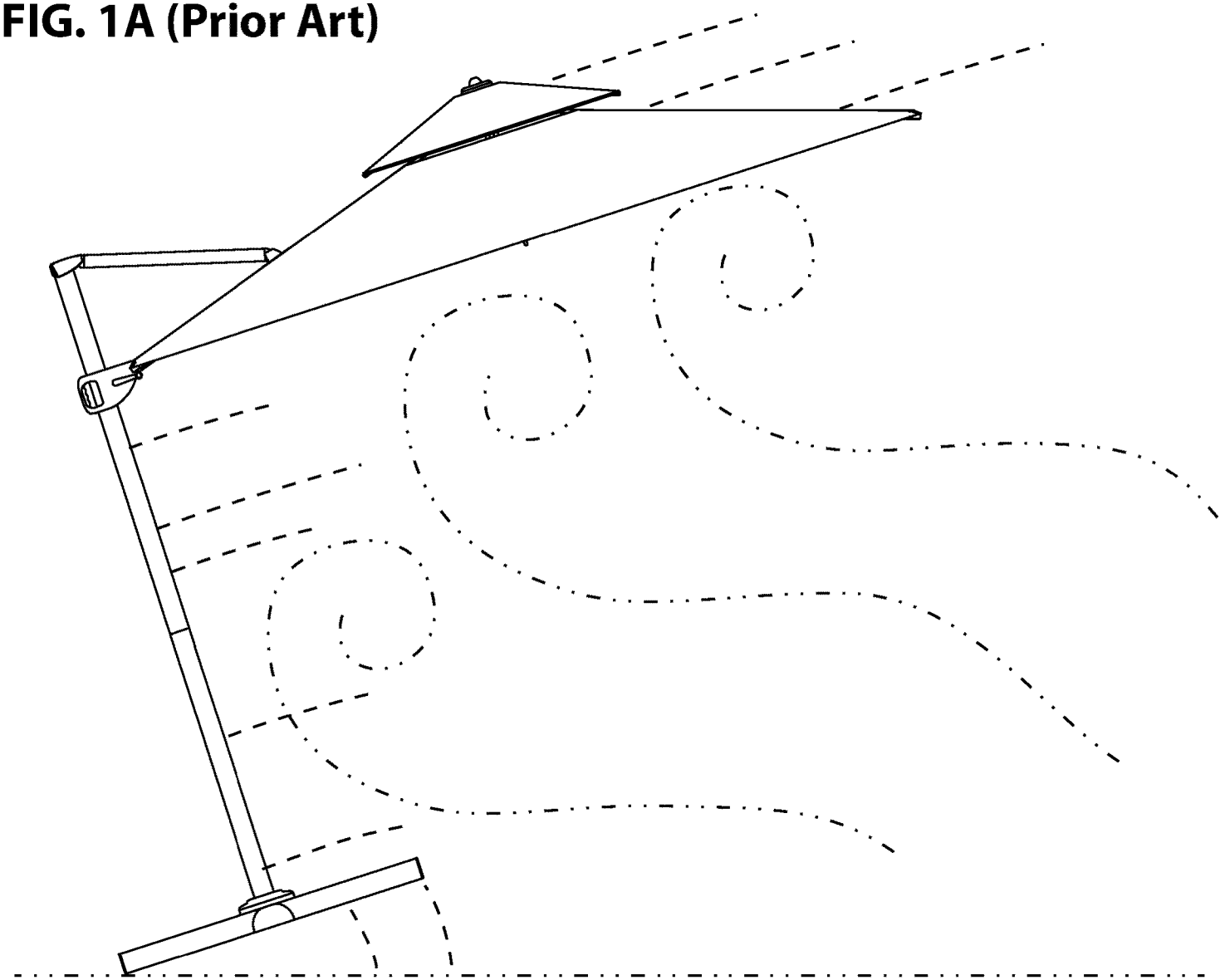
FIG. 1A (Prior Art)
FIG. 1A (Prior Art), FIG. 1B (Prior Art), and FIG. 1C (Prior Art) illustrate side views of prior art umbrella systems which are easily lifted, blown over, and damaged by the force and effects of strong winds, specifically as a result of the wind-pressure build-up in the underside of the canopy.
Figure 1B:
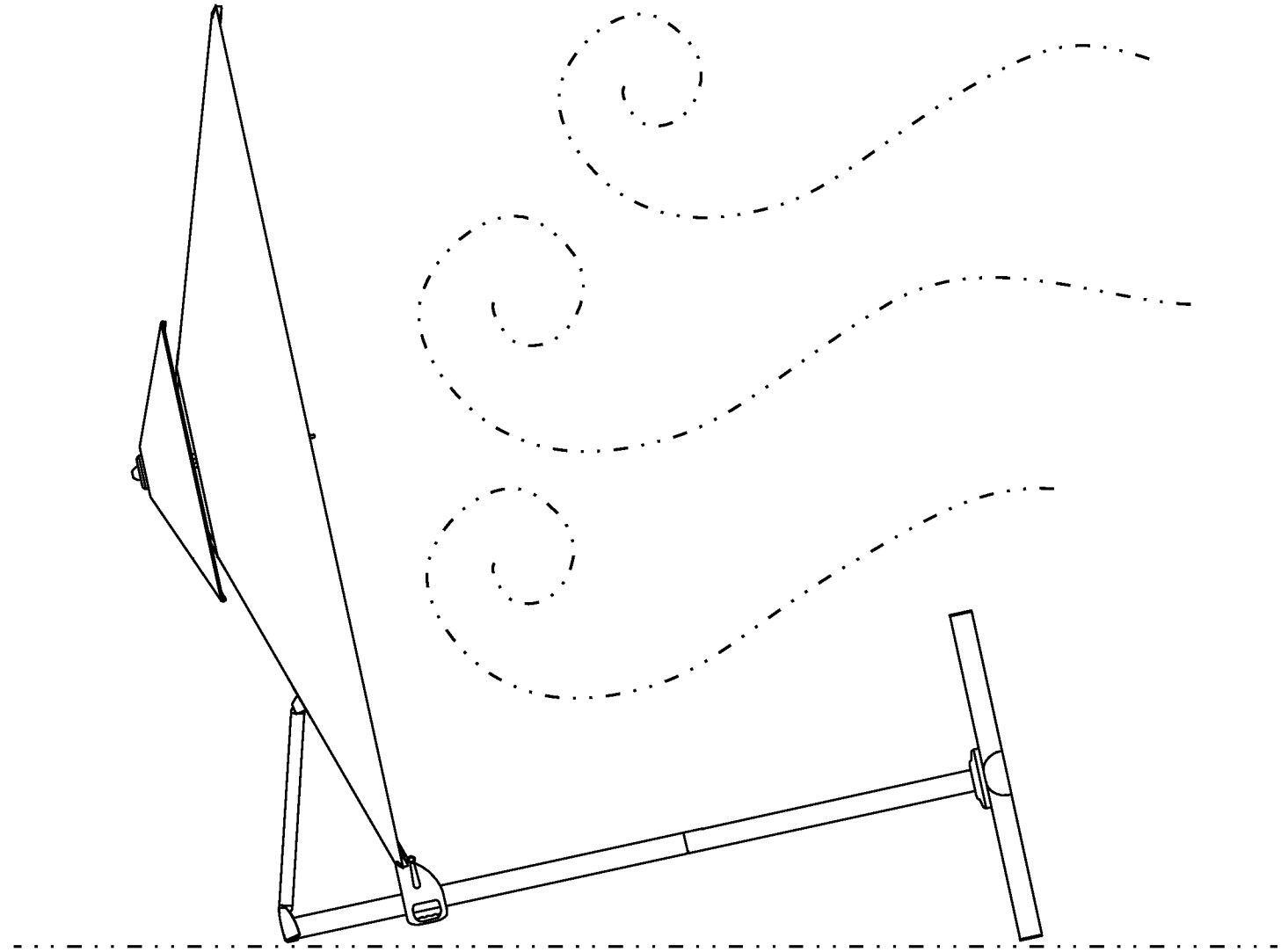
FIG. 1B (Prior Art)
Figure 1C:
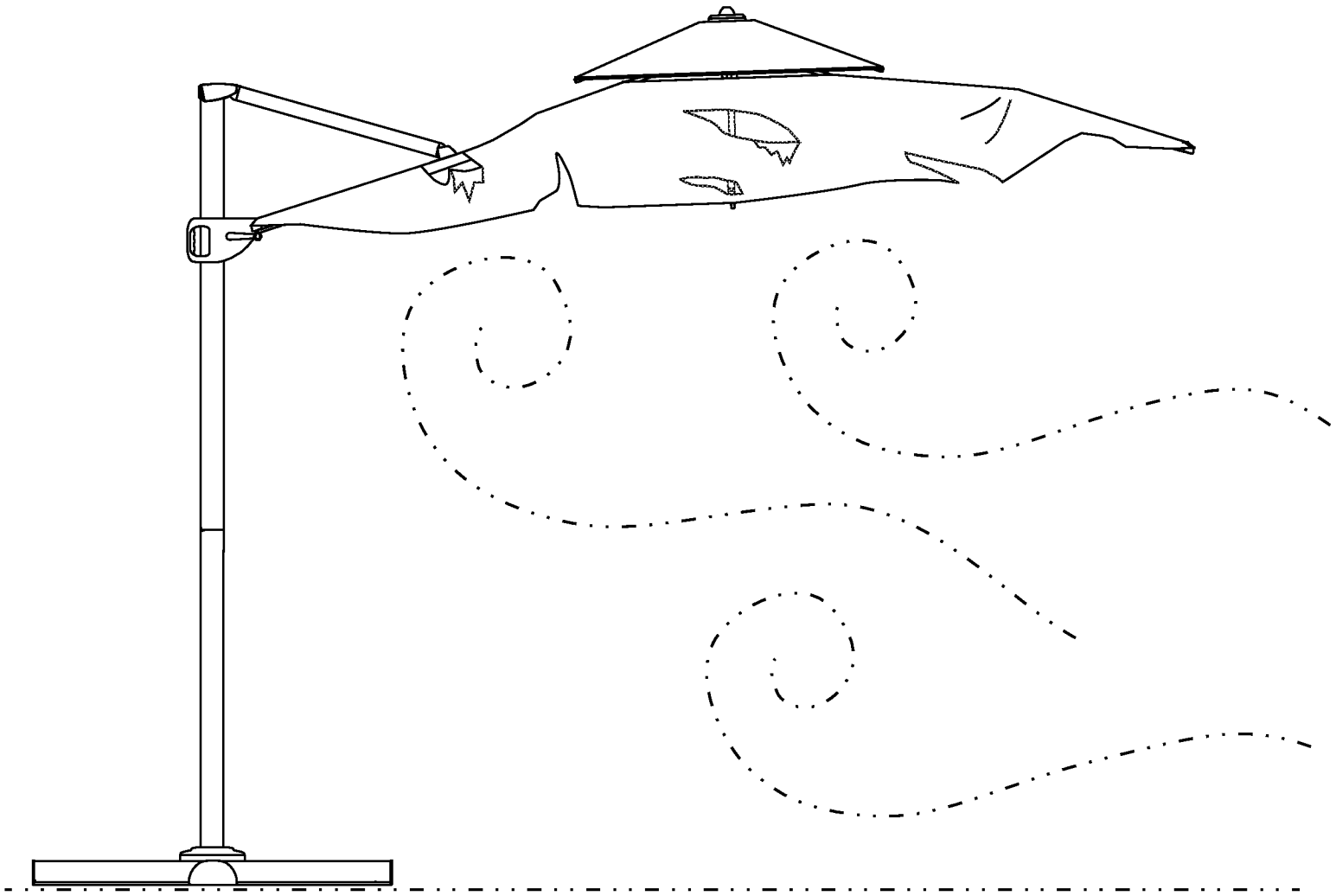
FIG. 1C (Prior Art)
Figure 2A:
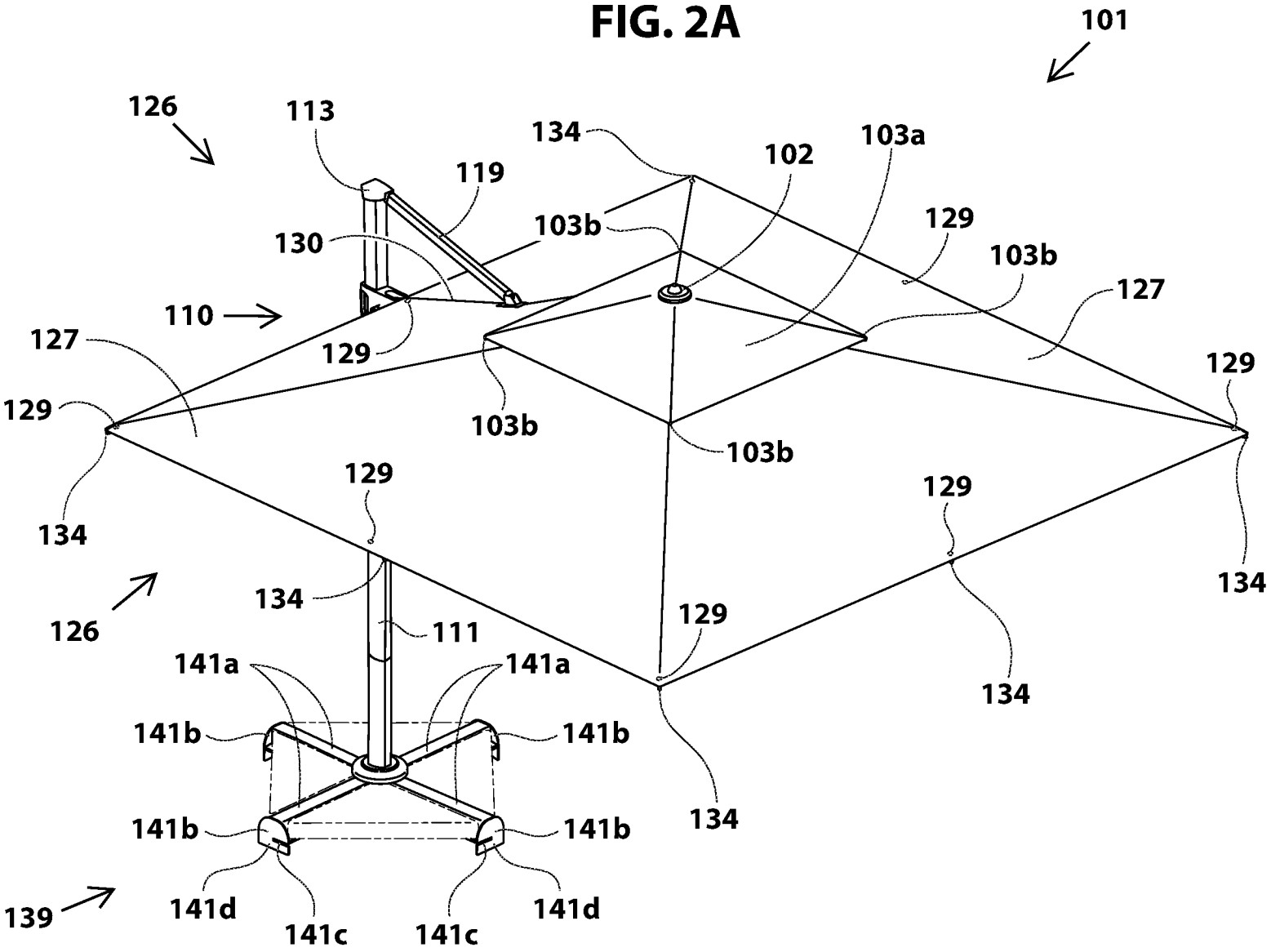
FIG. 2A, FIG. 2B, FIG. 2C, FIG. 2D, and FIG. 2E illustrate perspective, top, and side views of the wind-lift-eliminating self-adjusting self-stabilizing reversible-canopy arthritic-aiding umbrella, respectively.
Figure 2B:
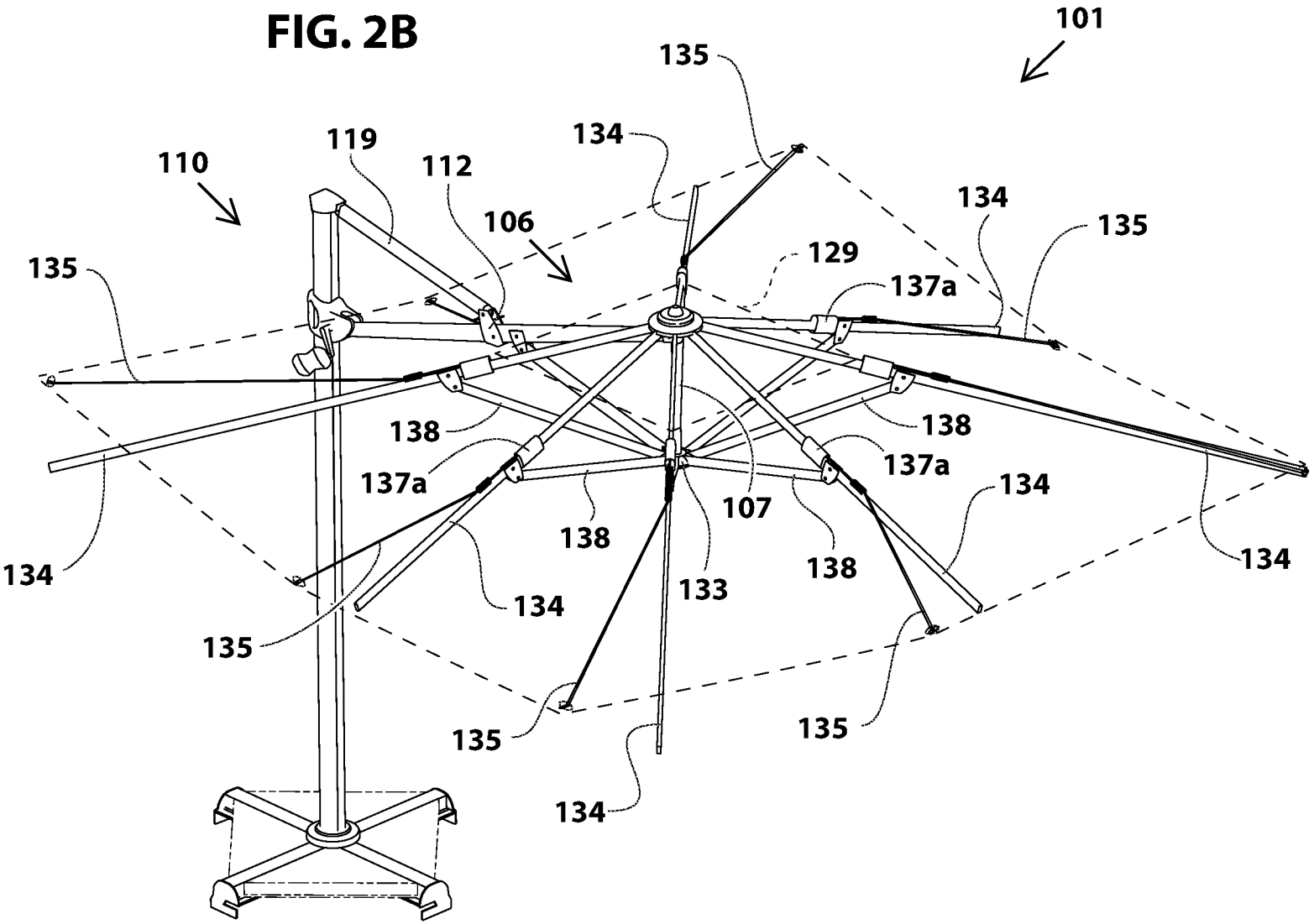
Figure 2C:
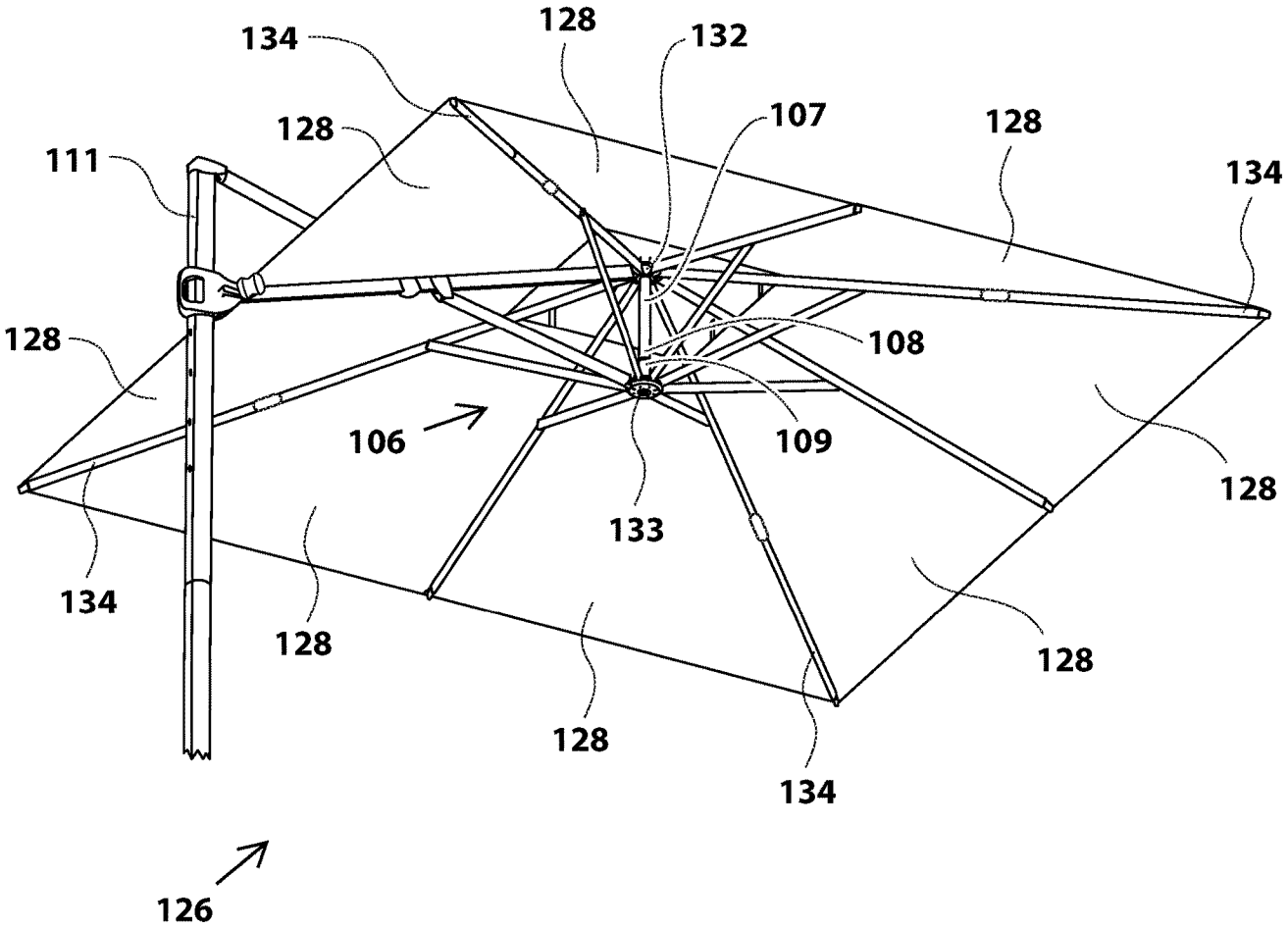
Figure 2D:
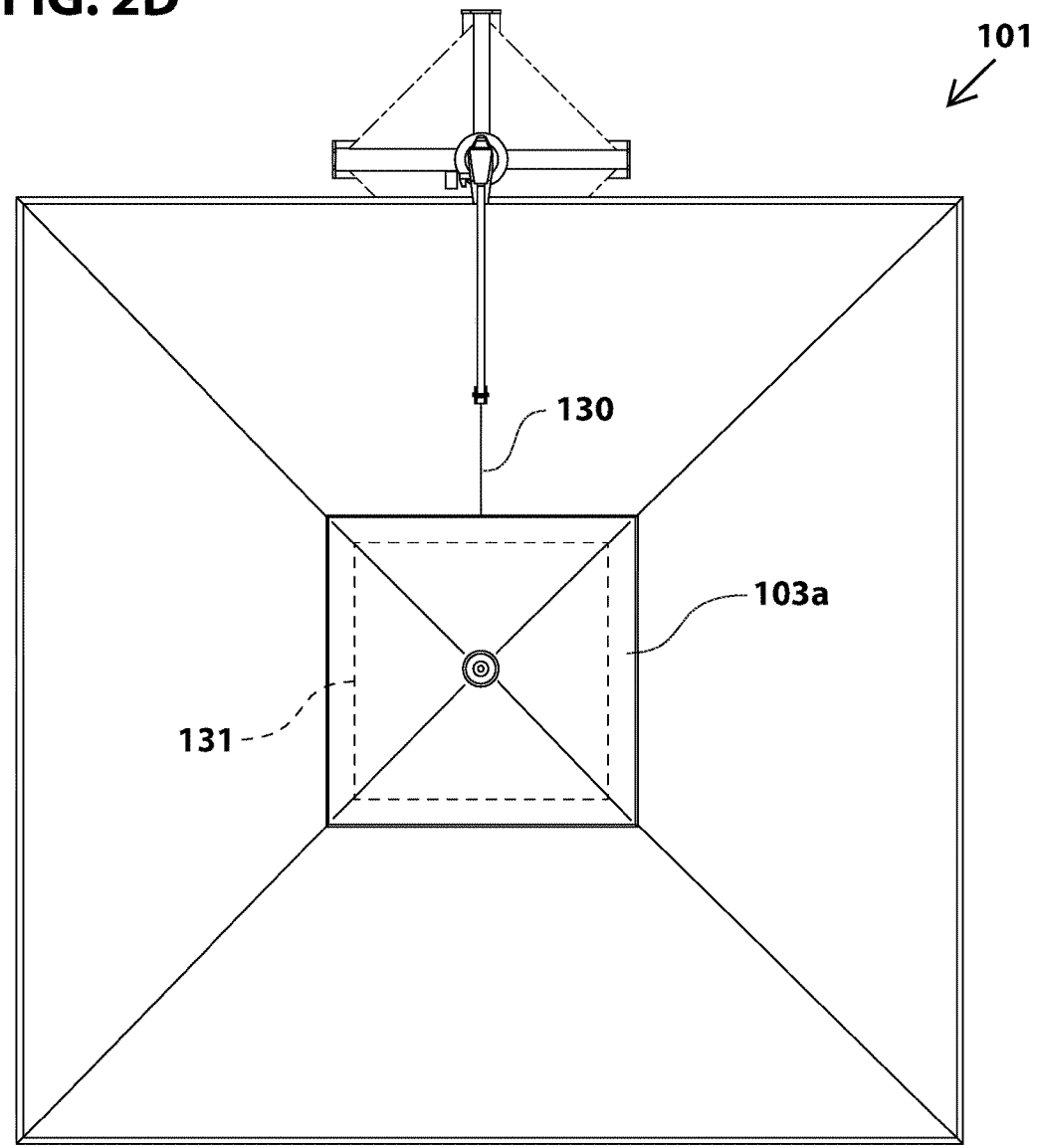
Figure 2E:
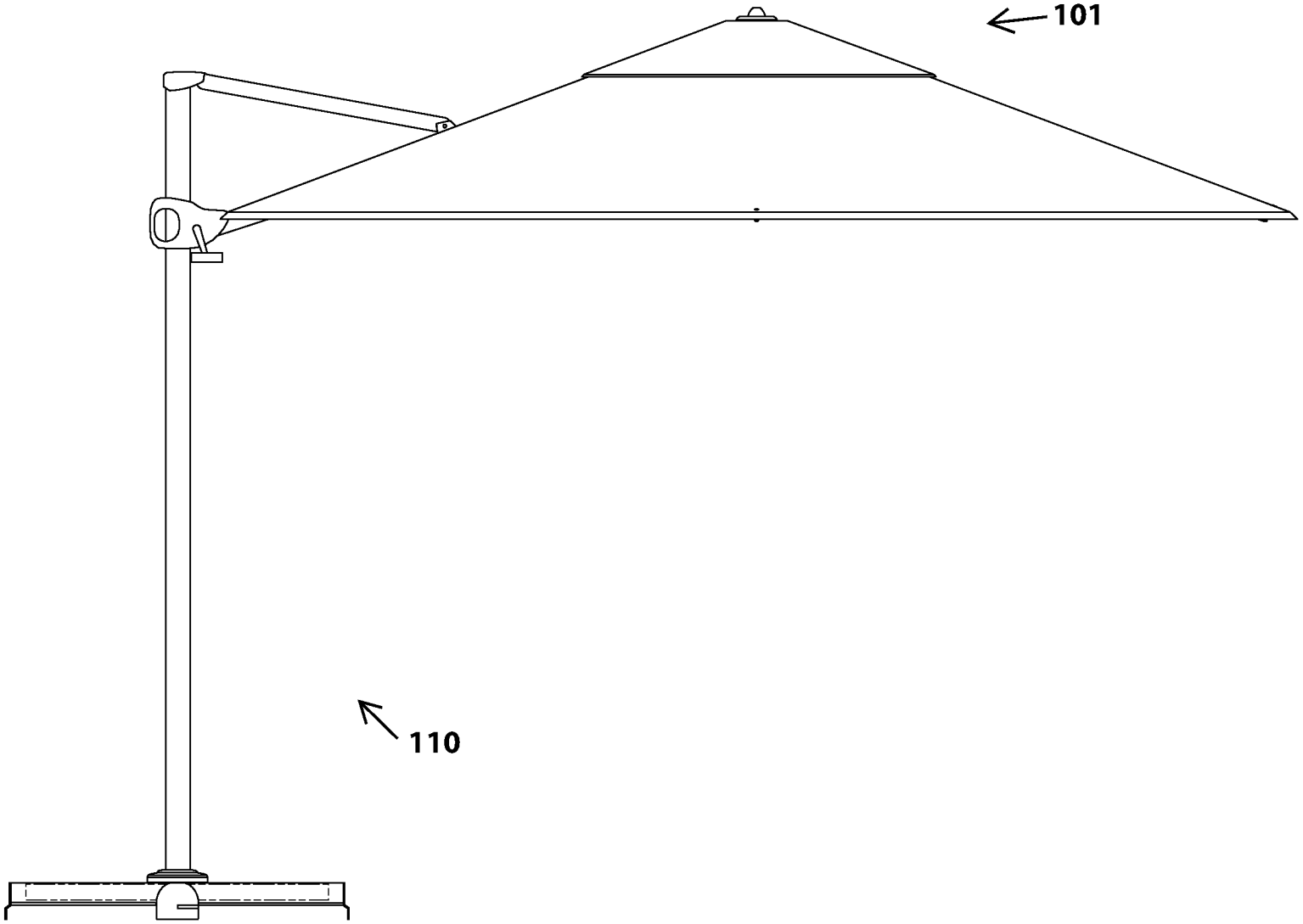
Figure 3A:
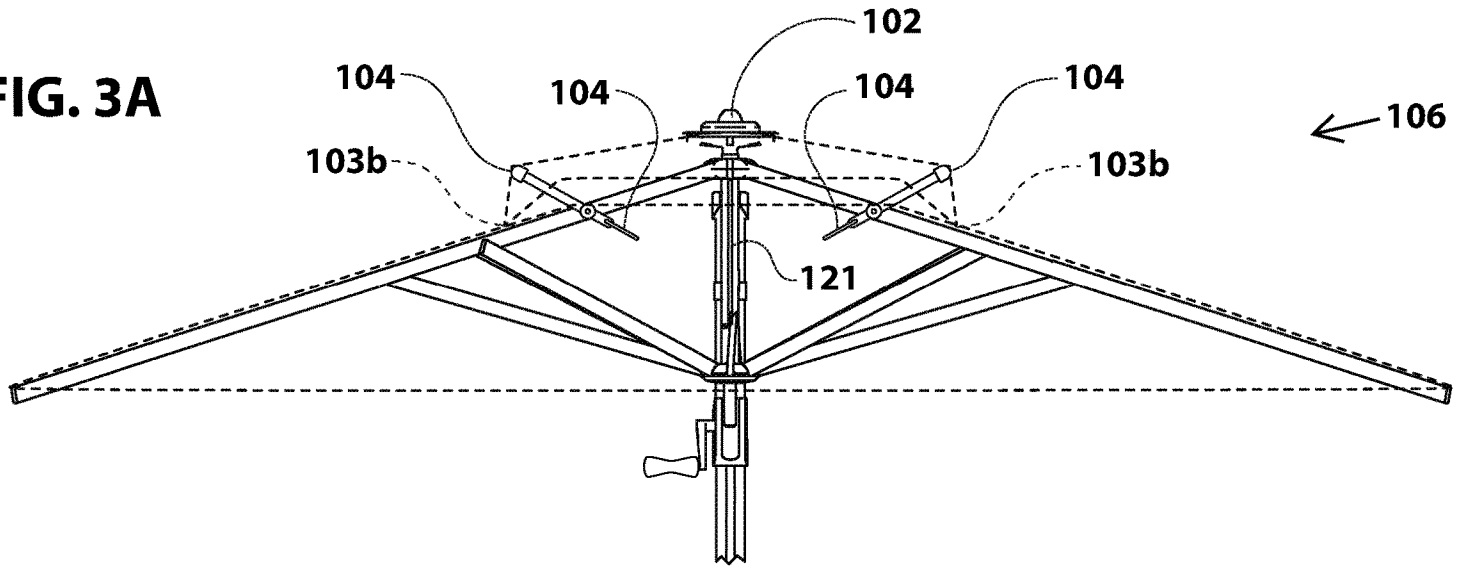
FIG. 3A, FIG. 3B, FIG. 3C, FIG. 3D, FIG. 3E, FIG. 3F, FIG. 3G, and FIG. 3H illustrate side, side hidden-component, and top views of the customizable-wind-flow-directing chapeau system, customizable-flow-directing chapeau, customizable-flow-directing chapeau control levers, and arthritic-aiding control tabs, respectively.
Figure 3B:
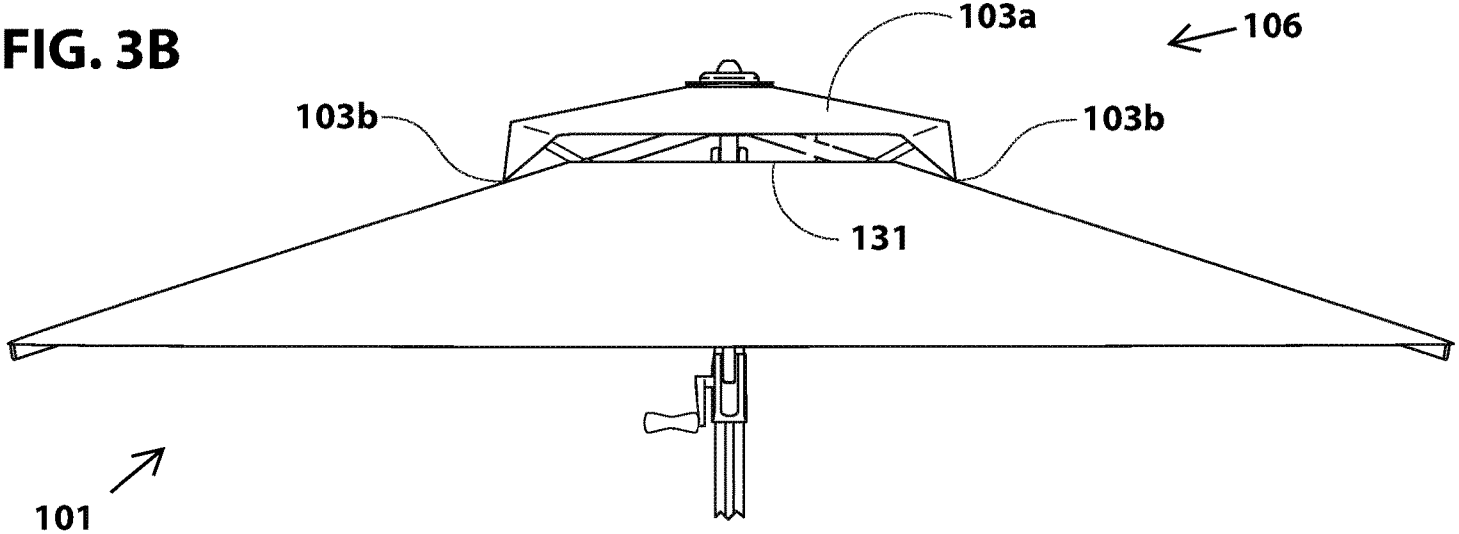
Figure 3C:
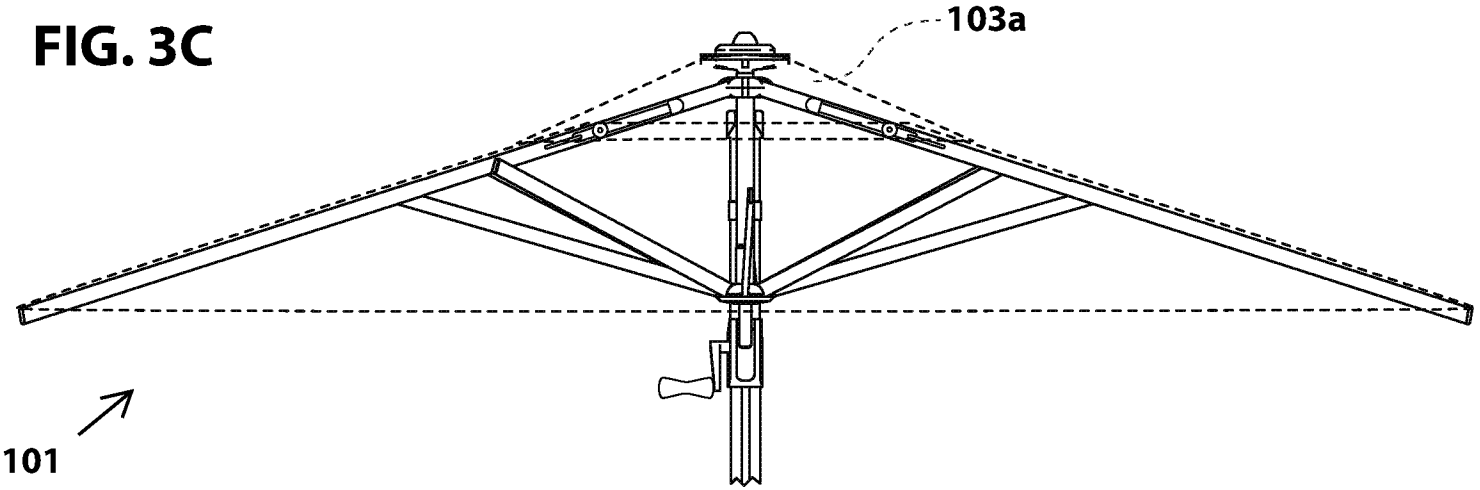
Figure 3D:
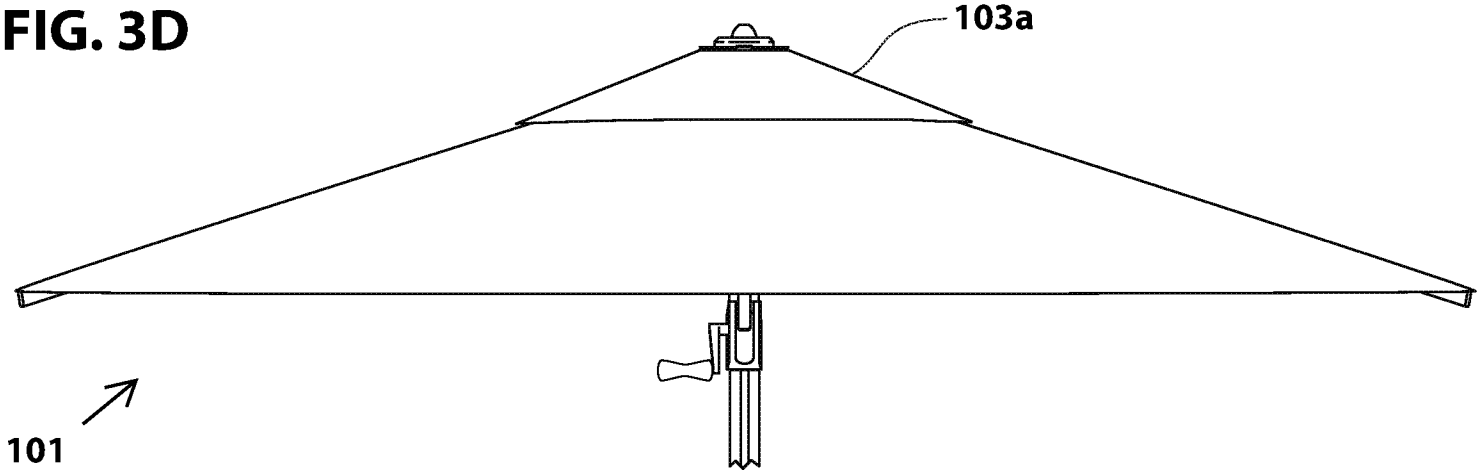
Figure 3E:
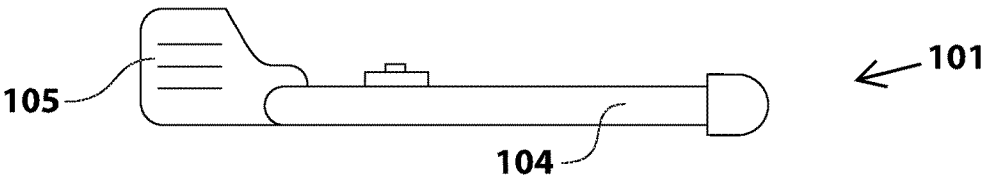
Figure 3F:
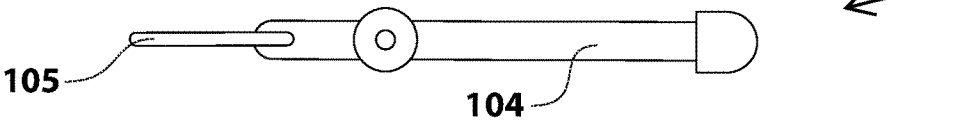
Figure 3H:
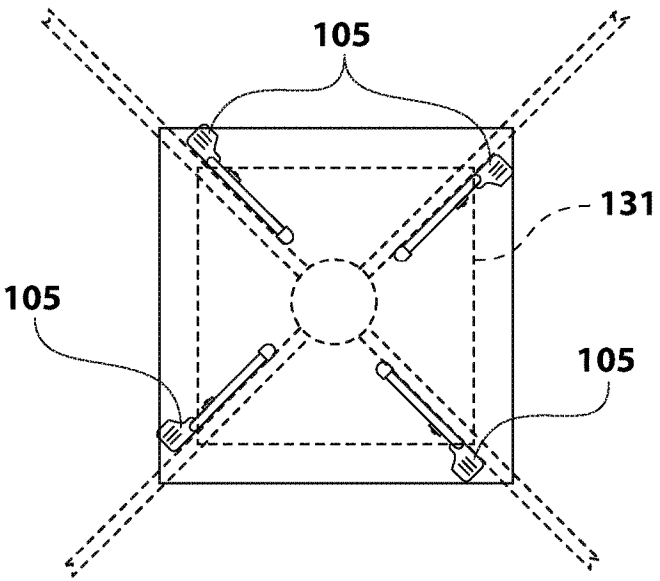
Figure 3G:
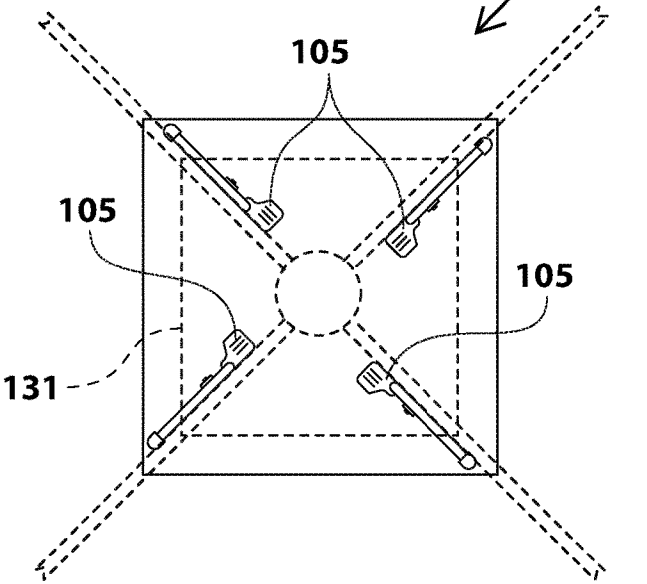
Figure 4:
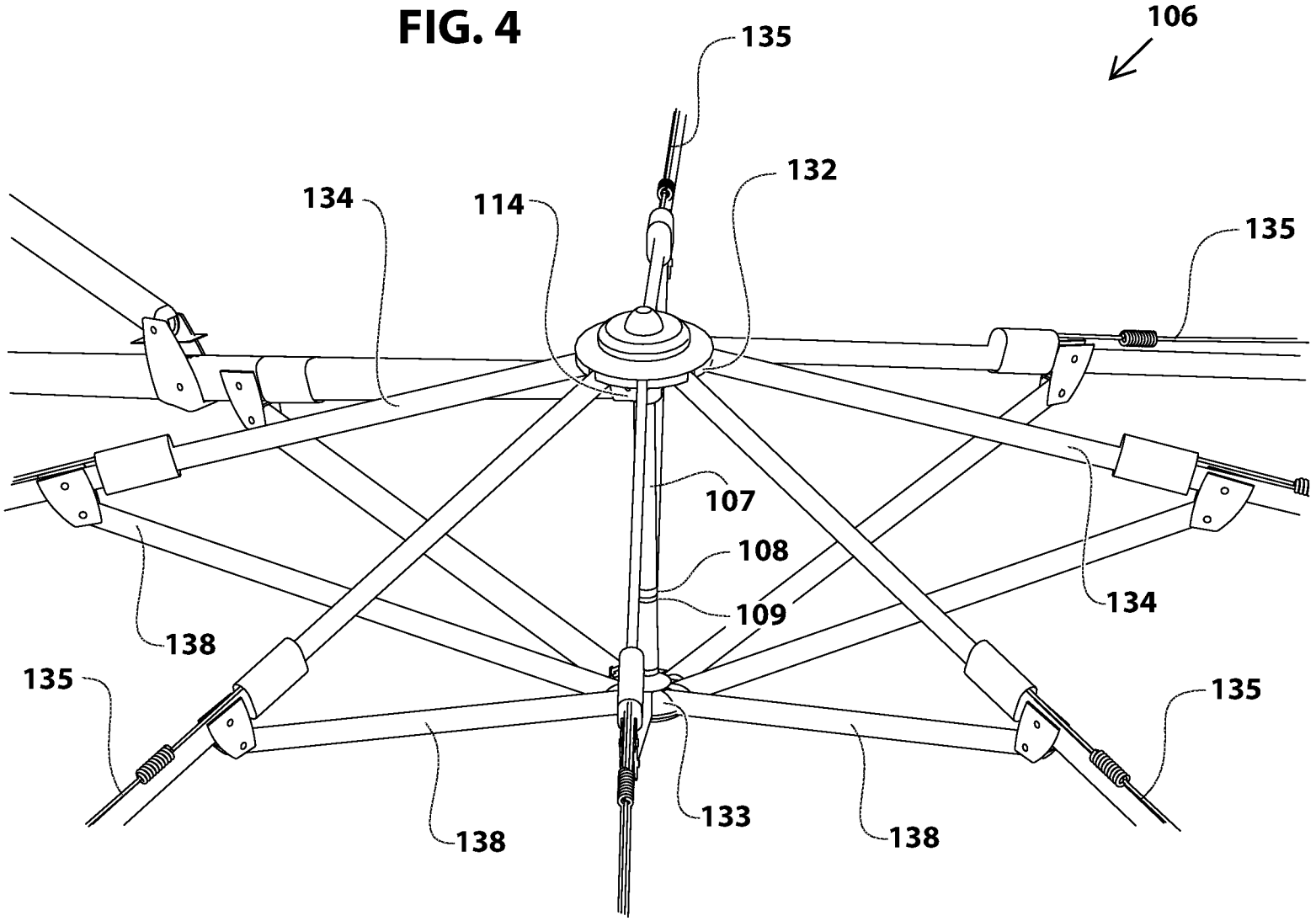
FIG. 4 illustrates an enlarged, partial, perspective view of the self-centering spiral-cone-locking cable-tube system and upper-ribs and lower-ribs.

The wind-lift-eliminating self-adjusting self-stabilizing reversible-canopy arthritic-aiding umbrella comprises:

1) Customizable-wind-flow-directing chapeau system,
2) Self-centering spiral-cone-locking cable-tube system,
3) Arthritic-aiding and canopy-deploying system,
4) Wind-lift-eliminating self-adjusting funnel-and-canopy-tension-adjusting spring system, and
5) Multi-base-connecting canopy base system.

Component

Referring to FIG. 2A, FIG. 2B, FIG. 2C, FIG. 2D, FIG. 2E, FIG. 3A, FIG. 3B, FIG. 3C, FIG. 3D, FIG. 3E, FIG. 3F, FIG. 3G, FIG. 311, FIG. 4, FIG. 5, FIG. 6A, FIG. 6B, FIG. 7A, FIG. 7B, FIG. 8A, FIG. 8B, FIG. 8C, FIG. 9, FIG. 10, FIG. 11A, FIG. 11B, FIG. 12, FIG. 13A, FIG. 13B, FIG. 13C, FIG. 13D, FIG. 13E, and FIG. 13F, the wind-lift-eliminating self-adjusting self-stabilizing reversible-canopy arthritic-aiding umbrella comprises:

1) Customizable-wind-flow-directing chapeau system 101, comprising:
2) Customizable-flow-directing chapeau crown 102,
3) Customizable-flow-directing chapeau 103*a*, Chapeau attachment stitching strips 103*b*,
4) Customizable-flow-directing chapeau control levers 104,
5) Arthritic-aiding control tabs 105;
6) Self-centering spiral-cone-locking cable-tube system 106, comprising:
7) Cable conduit 107,
8) Upper self-centering inverted spiral-locking cone 108,
9) Lower self-centering spiral-locking cone 109;
10) Arthritic-aiding and canopy-deploying system 110, comprising:
11) Canopy-height-adjusting stanchion 111,
12) Canopy-lifting-arm intersector 112,
13) Canopy-supporting-arm intersector 113,
14) Canopy top-hub intersector 114,
15) Canopy-height-and-tilt-adjusting arthritic-aiding handle 115,
16) Canopy height-adjusting arthritic-aiding trigger 116,
17) Arthritic-aiding trigger pin 117,
18) Arthritic-aiding canopy-angle-locking holes 118,
19) Canopy-supporting arm 119,
20) Canopy-lifting arm 120,
21) Canopy-deploying cable 121,
22) Canopy-deploying-cable spool 122,
23) Removable arthritic-aiding-canopy-deploying crank 123,
24) Removable arthritic-aiding-canopy-deploying-crank paddles 124,
25) Removable-crank insertion hole 125;
26) Wind-lift-eliminating self-adjusting funnel-and-canopy-tension-adjusting spring system 126, comprising:
27) Reversible wind-pressure-releasing and cooling-funnel canopy 127,
28) Down-force cooling-funnels 128,
29) Canopy-spring mounting holes 129,
30) Canopy hook-and-loop closure slit 130, 31) Customizable-flow-directing-chapeau opening 131,
32) Canopy top-hub-ring 132,
33) Canopy bottom-shuttle-hub-ring 133,
34) Upper-ribs 134,
35) Wind-lift-eliminating self-adjusting funnel-and-canopy-tension-adjusting springs 135,
36) Wind-lift-eliminating-self-adjusting-funnel-and-canopy-tension-adjusting-spring eyelets 136*a*,
Adjustable-tension-canopy-spring-eyelet washer and screws 136*b*,
Automatic-canopy-spring-centering crescents 136*c*,
37) Adjustable-tension-canopy-spring brackets 137*a*,
Adjustable-tension screws 137*b*,
38) Lower-ribs 138; and
39) Multi-base-connecting canopy base system 139, comprising:
40) Canopy-stanchion base-mounting plate 140,
41) Canopy-base-stabilizing feet 141*a*,
Multi-base-connecting canopy-base plates 141*b*.
Multi-base-connecting locking slots 141*c*.
Multi-base-connecting heel-blades 141*d*.

Material

Referring to FIG. 2A, FIG. 2B, FIG. 2C, FIG. 2D, FIG. 2E, FIG. 3A, FIG. 3B, FIG. 3C, FIG. 3D, FIG. 3E, FIG. 3F, FIG. 3G, FIG. 311, FIG. 4, FIG. 5, FIG. 6A, FIG. 6B, FIG. 7A, FIG. 7B, FIG. 8A, FIG. 8B, FIG. 8C, FIG. 9, FIG. 10, FIG. 11A, FIG. 11B, FIG. 12, FIG. 13A, FIG. 13B, FIG. 13C, FIG. 13D, FIG. 13E, and FIG. 13F:

1) Customizable-wind-flow-directing chapeau system 101 is made of the combined materials of its components.
2) Customizable-flow-directing chapeau crown 102
is made of metal or plastic material.
3) Customizable-flow-directing chapeau 103*a*
is made canvas, fabric, nylon, the like, the equivalent, or flexible material.
Chapeau attachment stitching strips 103*b*
each are made of cotton, nylon, the like, or equivalent material.
4) Customizable-flow-directing chapeau control levers 104
each are made of metal or plastic material.
5) Arthritic-aiding control tabs 105
each are made of metal or plastic material.
6) Self-centering spiral-cone-locking cable-tube system 106 is made of the combined materials of its components.
7) Cable conduit 107
is made of metal or plastic material.
8) Upper self-centering inverted spiral-locking cone 108
is made of metal or plastic material.
9) Lower self-centering spiral-locking cone 109
is made of metal or plastic material.
10) Arthritic-aiding and canopy-deploying system 110 is made of the combined materials of its components.
11) Canopy-height-adjusting stanchion 111
is made of metal or plastic material.
12) Canopy-lifting-arm intersector 112
is made of metal or plastic material.
13) Canopy-supporting-arm intersector 113
is made of metal or plastic material.
14) Canopy top-hub intersector 114
is made of metal or plastic material.
15) Canopy-height-and-tilt-adjusting arthritic-aiding handle 115
is made of metal and/or plastic material.
16) Canopy height-adjusting arthritic-aiding trigger 116
is made of metal or plastic material.
17) Arthritic-aiding trigger pin 117
is made of metallic material.
18) Arthritic-aiding-trigger-pin holes 118
is made of empty space.
19) Canopy-supporting arm 119
is made of metallic material.
20) Canopy-lifting arm 120
is made of metallic material.
21) Canopy-deploying cable 121
is made of metal or synthetic material.
22) Canopy-deploying-cable spool 122
is made of metal and/or plastic material.
23) Removable arthritic-aiding-canopy-deploying crank 123
is made of metal and/or plastic material.
24) Removable arthritic-aiding-canopy-deploying-crank paddles 124
is made of metal or plastic material.
25) Removable-crank insertion hole 125 is made of empty space.
26) Wind-lift-eliminating self-adjusting self-stabilizing reversible-canopy arthritic-aiding umbrella 126 is made of the combined materials of its components.
27) Reversible wind-pressure-releasing and cooling-funnel canopy 127
is made of canvas, fabric, nylon, the like, the equivalent, or flexible material.
28) Cooling-funnels 128
each are made of canvas, fabric, nylon, the like, the equivalent, or flexible material.
29) Canopy-spring mounting holes 129
each are made of empty space.
30) Canopy hook-and-loop closure slit 130
is made of canvas, fabric, nylon, the like, the equivalent, or flexible material.
31) Customizable-flow-directing-chapeau opening 131
is made of empty space.
32) Canopy top-hub-ring 132
is made of metal or plastic material.
33) Canopy bottom-shuttle-hub-ring 133
is made of metal or plastic material.
34) Upper-ribs 134,
each are made of metal or plastic material.
35) Wind-lift-eliminating self-adjusting funnel-and-canopy-tension-adjusting springs 135
each are made of metallic material.
36) Wind-lift-eliminating-self-adjusting-funnel-and-canopy-tension-adjusting-spring eyelets 136*a*
is made of metal or plastic material.
Adjustable-tension-canopy-spring-eyelet washer and screws 136*b*
is made of metallic material.
Automatic-canopy-spring-centering crescents 136*c*
is made of metallic or plastic material.
37) Adjustable-tension-canopy-spring brackets 137*a*
is made of metal or plastic material.
Adjustable-tension screws 137*b*
is made of metal or plastic material.
38) Lower-ribs 138
is made of metallic material.
39) Multi-base-connecting canopy base system 139 is made of the combined materials of its components.
40) Canopy-stanchion base-mounting plate 140 is made of metal or plastic material.
42) Canopy-base-stabilizing feet 141*a*
are made of metallic material.
Multi-base-connecting canopy-base plates 141*b*
are made of metallic material.
Multi-base-connecting locking slots 141*c*
are made of metallic material.

Multi-base-connecting heel-blades 141*d*
are made of metallic material.

Shape

Referring to FIG. 2A, FIG. 2B, FIG. 2C, FIG. 2D, FIG. 2E, FIG. 3A, FIG. 3B, FIG. 3C, FIG. 3D, FIG. 3E, FIG. 3F, FIG. 3G, FIG. 3H, FIG. 4, FIG. 5, FIG. 6A, FIG. 6B, FIG. 7A, FIG. 7B, FIG. 8A, FIG. 8B, FIG. 8C, FIG. 9, FIG. 10, FIG. 11A, FIG. 11B, FIG. 12, FIG. 13A, FIG. 13B, FIG. 13C, FIG. 13D, FIG. 13E, and FIG. 13F:

1) Customizable-wind-flow-directing chapeau system 101 has the combined shapes of its components.
2) Customizable-flow-directing chapeau crown 102 is formed into a round shape.
3) Customizable-flow-directing chapeau 103*a* is formed into a square shape.
Chapeau attachment stitching strips 103*b* each are formed into a stitched-thread shape.
4) Customizable-flow-directing chapeau control levers 104 each are formed into a rod shape.
5) Arthritic-aiding control tabs 105 each are formed into a rounded rectangular shape with a flat cross-section.
6) Self-centering spiral-cone-locking cable-tube system 106 has the combined shapes of its components.
7) Cable conduit 107 is formed into a round tube shape.
8) Upper self-centering inverted spiral-locking cone 108 is formed into a cone shape.
9) Lower self-centering spiral-locking cone 109 is formed into a cone shape.
10) Arthritic-aiding and canopy-deploying system 110 has the combined shapes of its components.
11) Canopy-height-adjusting stanchion 111 is formed into a pole shape with an oval cross-section.
12) Canopy-lifting-arm intersector 112 is formed into a rectangular shape.
13) Canopy-supporting-arm intersector 113 is formed into a generally triangular shape.
14) Canopy top-hub intersector 114 is formed into a U shape.
15) Canopy-height-and-tilt-adjusting arthritic-aiding handle 115 is formed into a Z shape.
16) Canopy height-adjusting arthritic-aiding trigger 116 is formed into a teardrop shape with oval hole in the side-center.
17) Arthritic-aiding trigger pin 117 is formed into cylindrical shape.
18) Arthritic-aiding-trigger-pin holes 118 each are formed into a circular shape.
19) Canopy-supporting arm 119 is formed into a rectangular-or-oval-tube shape.
20) Canopy-lifting arm 120 is formed into a rectangular-or-oval-tube shape.
21) Canopy-deploying cable 121 is formed into a cable shape with a round cross-section.
22) Canopy-deploying-cable spool 122 is formed into a generally triangular shape.
23) Removable arthritic-aiding-canopy-deploying crank 123 is formed into a Z shape.
24) Removable arthritic-aiding-canopy-deploying-crank paddles 124 is formed into a generally rounded rectangular shape with a flat cross-section.
25) Removable-crank insertion hole 125 is formed into a circular shape.
26) Wind-lift-eliminating self-adjusting self-stabilizing reversible-canopy arthritic-aiding umbrella 126 has the combined shapes of its components.
27) Reversible wind-pressure-releasing and cooling-funnel canopy 127 is formed into a square shape.
28) Cooling-funnels 128 each are formed into a triangular shape.
29) Canopy-spring mounting holes 129 each are formed into a circular shape.
30) Canopy hook-and-loop closure slit 130 is formed into a square shape.
31) Customizable-flow-directing-chapeau opening 131 is each are formed into a circular shape.
32) Canopy top-hub-ring 132 is formed into a round shape with eight U-shaped arms.
33) Canopy bottom-shuttle-hub-ring 133 is formed into a round shape with eight U-shaped arms.
34) Upper-ribs 134, each are formed into a tube shape with an oval cross-section.
35) Wind-lift-eliminating self-adjusting funnel-and-canopy-tension-adjusting springs 135 each are formed into a rod shape.
36) Wind-lift-eliminating-self-adjusting-funnel-and-canopy-tension-adjusting-spring eyelets 136*a* each are formed into an O shape.
Adjustable-tension-canopy-spring-eyelet washer and screws 136*b* each are formed into an O and a circular shape respectively.
Automatic-canopy-spring-centering crescents 136*c* each are formed into an arc shape respectively.
37) Adjustable-tension-canopy-spring brackets 137*a* each are formed into a rectangular shape with an oval cross-section.
Adjustable-tension screws 137*b* each are formed into a screw shape.
38) Lower-ribs 138 each are formed into a tube shape with an oval cross-section.
39) Multi-base-connecting canopy base system 139 has the combined shapes of its components.
40) Canopy-stanchion base-mounting plate 140 is formed into a square shape.
41) Canopy-base-stabilizing feet 141*a* each are formed into an elongated rectangle shape with a T cross-section.
Multi-base-connecting canopy-base plates 141*b*. each are formed into a rounded-rectangle shape with a center slot.
Multi-base-connecting locking slots 141*c* each are a slot-shape with a rounded end.
Multi-base-connecting heel-blades 141*d* each are a rectangular shape.

Connection

Referring to FIG. 2A, FIG. 2B, FIG. 2C, FIG. 2D, FIG. 2E, FIG. 3A, FIG. 3B, FIG. 3C, FIG. 3D, FIG. 3E, FIG. 3F, FIG. 3G, FIG. 311, FIG. 4, FIG. 5, FIG. 6A, FIG. 6B, FIG. 7A, FIG. 7B, FIG. 8A, FIG. 8B, FIG. 8C, FIG. 9, FIG. 10, FIG. 11A, FIG. 11B, FIG. 12, FIG. 13A, FIG. 13B, FIG. 13C, FIG. 13D, FIG. 13E, and FIG. 13F:

1) Customizable-wind-flow-directing chapeau system 101 has the combined connections of its components.
2) Customizable-flow-directing chapeau crown 102 is attached to customizable-flow-directing chapeau 103*a*.

3) Customizable-flow-directing chapeau 103*a*
is attached to reversible wind-pressure-releasing and cooling-funnel canopy 127 by chapeau attachment stitching strips 103*b*
Chapeau attachment stitching strips 103*b*
respectively are stitching together customizable-flow-directing chapeau 103*a* and reversible wind-pressure-releasing and cooling-funnel canopy 127.
4) Customizable-flow-directing chapeau control levers 104
respectively and pivotably are screwed to upper-ribs 134.
5) Arthritic-aiding control tabs 105
respectively and pivotably are molded to customizable-flow-directing chapeau control levers 104.
6) Self-centering spiral-cone-locking cable-tube system 106
has the combined connections of its components.
7) Cable conduit 107
respectively and rotatably are attached to canopy top-hub-ring 132.
8) Upper self-centering inverted spiral-locking cone 108
respectively and rotatably are attached to cable conduit 107.
9) Lower self-centering spiral-locking cone 109
respectively and rotatably are attached to canopy bottom-shuttle-hub-ring 133.
10) Arthritic-aiding and canopy-deploying system 110 has the combined connections of its components.
11) Canopy-height-adjusting stanchion 111
is bolted to canopy-lifting-arm intersector 112, and canopy-stanchion base-mounting plate 140.
12) Canopy-lifting-arm intersector 112
is bolted to canopy-height-adjusting stanchion 111 and pivotably attached to are canopy-supporting arm 119.
13) Canopy-supporting-arm intersector 113
is pivotably attached to canopy-supporting arm 119 and pivotably attached to are canopy-lifting arm 120.
14) Canopy top-hub intersector 114
is molded to canopy-lifting arm 120, and is pivotably attached to canopy top-hub-ring 132.
15) Canopy-height-and-tilt-adjusting arthritic-aiding handle 115
is slidably connected to canopy-height-adjusting stanchion 111.
16) Canopy height-adjusting arthritic-aiding trigger 116
is springably and pivotably attached to canopy-height-and-tilt-adjusting arthritic-aiding handle 115.
17) Arthritic-aiding trigger pin 117
is molded to canopy height-adjusting arthritic-aiding trigger 116, and also lockably and unlockably inserts into arthritic-aiding-trigger-pin holes 118.
18) Arthritic-aiding-trigger-pin holes 118
are drilled into canopy-height-adjusting stanchion 111.
19) Canopy-supporting arm 119
is pivotably attached to both canopy-lifting-arm intersector 112 and canopy-supporting-arm intersector 113.
20) Canopy-lifting arm 120
is pivotably attached to both canopy-height-and-tilt-adjusting arthritic-aiding handle 115 and canopy top-hub intersector 114.
21) Canopy-deploying cable 121
is attached to both canopy-deploying-cable spool 122 and canopy bottom-shuttle-hub-ring 133.
22) Canopy-deploying-cable spool 122
is molded into canopy-height-and-tilt-adjusting arthritic-aiding handle 115.+
23) Removable arthritic-aiding-canopy-deploying crank 123
is detachably inserted into removable-crank insertion hole 125.
24) Removable arthritic-aiding-canopy-deploying-crank paddles 124
is rotatably connected to removable arthritic-aiding-canopy-deploying crank 123.
25) Removable-crank insertion hole 125
is connected to canopy-deploying-cable spool 122.
26) Wind-lift-eliminating self-adjusting self-stabilizing reversible-canopy arthritic-aiding umbrella 126 has the combined connections of its components.
27) Reversible wind-pressure-releasing and cooling-funnel canopy 127
is respectably molded to canopy-spring mounting holes 129.
28) Cooling-funnels 128
respectively are molded into reversible wind-pressure-releasing and cooling-funnel canopy 127.
29) Canopy-spring mounting holes 129
respectively are punched out of reversible wind-pressure-releasing and cooling-funnel canopy 127.
30) Canopy hook-and-loop closure slit 130
is molded into reversible wind-pressure-releasing and cooling-funnel canopy 127.
31) Customizable-flow-directing-chapeau opening 131
is cut into reversible wind-pressure-releasing and cooling-funnel canopy 127.
32) Canopy top-hub-ring 132
respectively and pivotably are screwed to upper-ribs 134.
33) Canopy bottom-shuttle-hub-ring 133
is respectively and pivotably screwed to lower-ribs 138.
34) Upper-ribs 134,
are respectively and pivotably screwed to lower-ribs 138 and canopy top-hub-ring 132
35) Wind-lift-eliminating self-adjusting funnel-and-canopy-tension-adjusting springs 135
are respectively and adjustably attached to adjustable-tension-canopy-spring brackets 137.
36) Wind-lift-eliminating-self-adjusting-funnel-and-canopy-tension-adjusting-spring eyelets 136*a*
are respectably molded to wind-lift-eliminating self-adjusting funnel-and-canopy-tension-adjusting springs 135.
Adjustable-tension-canopy-spring-eyelet washer and screws 136*b*
respectively are screwed through canopy-spring mounting holes 129 to automatic-canopy-spring-centering crescents 136*c*.
Automatic-canopy-spring-centering crescents 136*c*
are respectively screwed to wind-lift-eliminating self-adjusting funnel-and-canopy-tension-adjusting springs 135 and detachably, intermittently, and respectively rest against upper-ribs 134
37) Adjustable-tension-canopy-spring brackets 137*a*
springably and respectively secure wind-lift-eliminating self-adjusting funnel-and-canopy-tension-adjusting springs 135 to upper-ribs 134.
Adjustable-tension screws 137*b*
are respectively and adjustably screwed to adjustable-tension-canopy-spring brackets 137.
38) Lower-ribs 138
are respectively and pivotably screwed to canopy bottom-shuttle-hub-ring 133 and upper-ribs 134.
39) Multi-base-connecting canopy base system 139 has the combined connections of its components.
40) Canopy-stanchion base-mounting plate 140
respectively is bolted to both canopy-base-stabilizing feet 141*a*.

41) Canopy-base-stabilizing feet 141*a*
respectively are bolted to canopy-stanchion base-mounting plate 140. Multi-base-connecting canopy-base plates 141*b*
respectively are welded to canopy-base-stabilizing feet 141*a*.
Multi-base-connecting locking slots 141*c*
respectively are punched of multi-base-connecting canopy-base plates 141*b*.
Multi-base-connecting heel-blades 141*d*
respectively are molded to multi-base-connecting canopy-base plates 141*b*.

Function

Referring to FIG. 14, FIG. 15, FIG. 16A, FIG. 16B, FIG. 16C, FIG. 16D, FIG. 16E, FIG. 17, FIG. 18A, FIG. 18B, FIG. 18C, FIG. 19A, FIG. 19B, FIG. 19C, FIG. 20A, FIG. 20B, FIG. 20C, FIG. 20D, FIG. 20E, FIG. 20F, FIG. 20G, FIG. 21A, FIG. 21B, FIG. 22A, FIG. 22B, FIG. 22C, FIG. 23A, FIG. 23B, FIG. 23C, FIG. 24A, FIG. 24B, FIG. 24C, and FIG. 24D:

1) Customizable-wind-flow-directing chapeau system 101 is for performing the combined functions of its components:
2) Customizable-flow-directing chapeau crown 102 is for:
Provide a protective covering for attached to canopy top-hub-ring 132.
3) Customizable-flow-directing chapeau 103*a* is for:
a) Providing a cover to protect users from weather elements;
b) Redirecting hot air to flow out and away from underside of the wind-lift-eliminating self-adjusting self-stabilizing reversible-canopy arthritic-aiding umbrella, thereby cooling the environment for the occupants;
in the directions of arrows 142*a*, 142*b*, 143*a*, 143*b*, 144*a*, 144*b*, 145*a*, 145*b*, 145*c*, and 145*d*
(see FIG. 13A, FIG. 13B, FIG. 13C, FIG. 13D, FIG. 13E, and FIG. 13F);
c) Releasing air pressure below the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*c*, and 145*d*
(see FIG. 13A, FIG. 13B, FIG. 13E, and FIG. 13F);
d) Redirecting wind-flow above canopy top-hub-ring 132 to the inside of the wind-lift-eliminating self-adjusting self-stabilizing reversible-canopy arthritic-aiding umbrella
in the directions of arrows 142*a*, 142*b*, 144*a*, 144*b*, 145*c*, and 145*d*
(see FIG. 13A, FIG. 13C, FIG. 13E, and FIG. 13F);
e) Customizing wind-flow direction and pattern from above canopy top-hub-ring 132 to the inside of the wind-lift-eliminating self-adjusting self-stabilizing reversible-canopy arthritic-aiding umbrella;
in the directions of arrows 142*a*, 142*b*, 143*a*, 143*b*, 144*a*, 144*b*, 145*a*, 145*b*, 145*c*, and 145*d*
(see FIG. 13C, FIG. 13B, FIG. 13C, FIG. 13D, and FIG. 13F); and
f) Customizing volume of air pressure below the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*a*, 145*b*, 145*c*, and 145*d*
(see FIG. 13C, FIG. 13B, FIG. 13C, FIG. 13D, and FIG. 13F).

Figure 14:
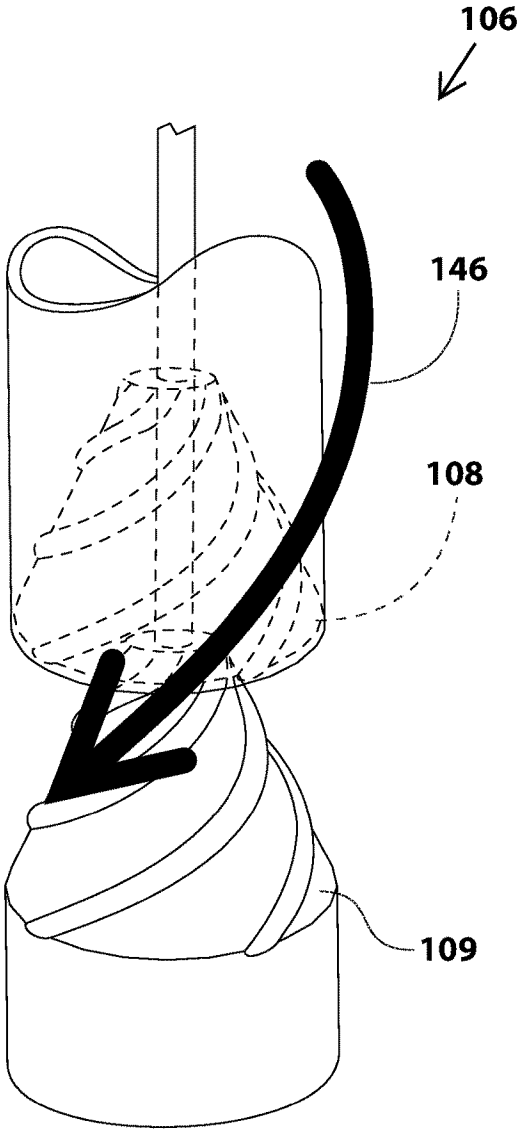
FIG. 14 illustrates a perspective partial view of the self-centering spiral-cone-locking cable-tube system demonstrating how the upper self-centering inverted spiral-locking cone spirally couples with lower self-centering spiral-locking cone.

Chapeau attachment stitching strips 103*b* are for:
Attaching customizable-flow-directing chapeau 103*a* to reversible wind-pressure-releasing and cooling-funnel canopy 127.
4) Customizable-flow-directing chapeau control levers 104 are for:
a) Providing means to control air pressure and the effects of wind-flow under the wind-lift-eliminating self-adjusting self-stabilizing reversible-canopy arthritic-aiding umbrella thereby stabilizing the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*a*, 145*b*, 145*c*, and 145*d*
(see FIG. 13A, FIG. 13B, FIG. 13C, FIG. 13D, FIG. 13E, and FIG. 13F);
b) Providing controls to open, close, and regulate the four corners of customizable-flow-directing chapeau 103*a* in multiple configurations
in the directions of arrows 142*a*, 142*b*, 143*a*, 143*b*, 144*a*, 144*b*, 145*c*, and 145*d*
(see FIG. 13A, FIG. 13B, FIG. 13E, and FIG. 13F);
c) Providing controls to redirect hot air to flow out and away from underside of the wind-lift-eliminating self-adjusting self-stabilizing reversible-canopy arthritic-aiding umbrella, thereby cooling the environment for the occupants
in the directions of arrows 142*a*, 142*b*, 144*a*, 144*b*, 145*c*, and 145*d*
(see FIG. 13A, FIG. 13C, FIG. 13E, and FIG. 13F);
d) Providing controls to customize wind-flow direction and pattern from above canopy top-hub-ring 132 to the inside of the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*a*, 145*b*, 145*c*, and 145*d*
(see FIG. 13C, FIG. 13B, FIG. 13C, FIG. 13D, and FIG. 13F);
e) Providing controls to release air pressure below the wind-lift-eliminating self-adjusting self-stabilizing reversible-canopy arthritic-aiding umbrella
in the directions of arrows 143*a*, and 143*b*
(see FIG. 13B); and
f) Providing controls to customize volume of air pressure below the wind-lift-eliminating self-adjusting self-stabilizing reversible-canopy arthritic-aiding umbrella by regulating the degree in which four corners of customizable-flow-directing chapeau 103*a* are opened or closed
in the directions of arrows 145*c* and 145*d*
(see FIG. 13D and FIG. 13F).
5) Arthritic-aiding control tabs 105 are for:
Helping those afflicted with arthritic conditions in their hands to operate customizable-flow-directing chapeau control levers 104.
6) Self-centering spiral-cone-locking cable-tube system 106 is for performing the combined functions of its components.
7) Cable conduit 107 is for:
Enclosing and protecting canopy-deploying cable 121.
8) Upper self-centering inverted spiral-locking cone 108 is for:
a) Centering upper self-centering inverted spiral-locking cone 108 with lower self-centering spiral-locking cone 109 during deployment of the wind-lift-eliminating self-adjusting self-stabilizing reversible-canopy arthritic-aiding umbrella
in the direction of arrow 146
(see FIG. 5, and FIG. 14);

b) Preventing the wind-lift-eliminating self-adjusting self-stabilizing reversible-canopy arthritic-aiding umbrella from radially twisting clockwise out of its desired shape
in the direction of arrow 146
(see FIG. 14);

c) Preventing the wind-lift-eliminating self-adjusting self-stabilizing reversible-canopy arthritic-aiding umbrella from radially twisting counterclockwise out of its desired shape
in the direction of arrow 146
(see FIG. 11, and FIG. 14); and d) Twist-locking upper self-centering inverted spiral-locking cone 108 with lower self-centering spiral-locking cone, thereby preventing easy dislodging of their union and connection
in the direction of arrow 146
(see FIG. 14).

Figure 5:
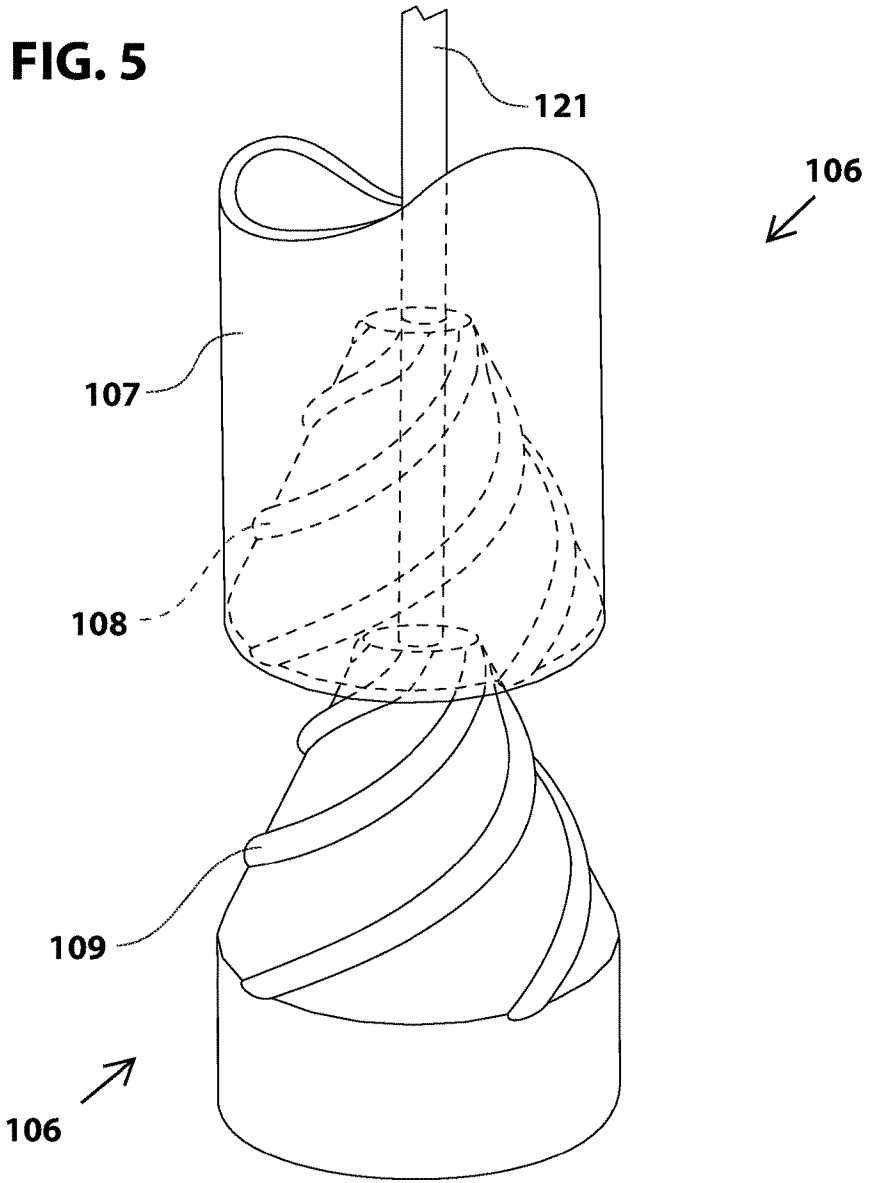
FIG. 5 illustrates an enlarged, partial, perspective view of the self-centering spiral-cone-locking cable-tube system, cable conduit, upper self-centering inverted spiral-locking cone and lower self-centering spiral-locking cone.
Figure 6A:
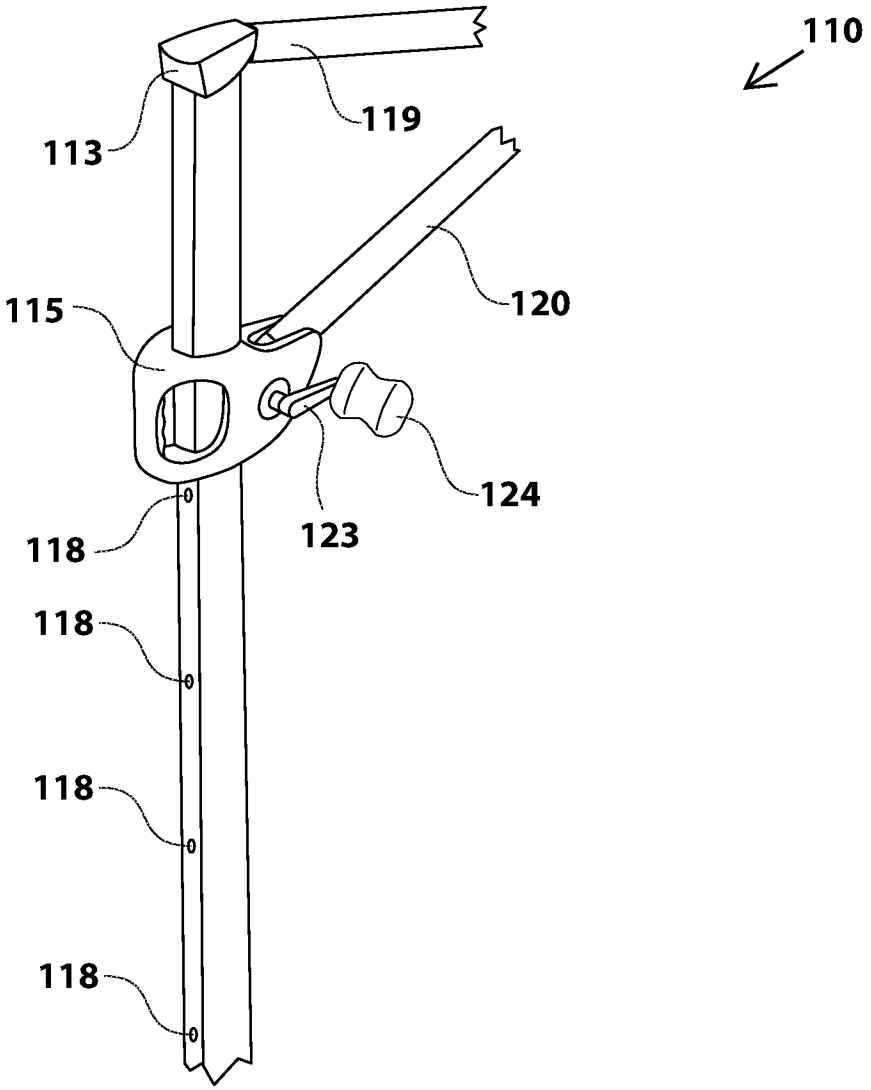
FIG. 6A and FIG. 6B illustrate a perspective and side views of the Arthritic-aiding and canopy-deploying system.
Figure 6B:
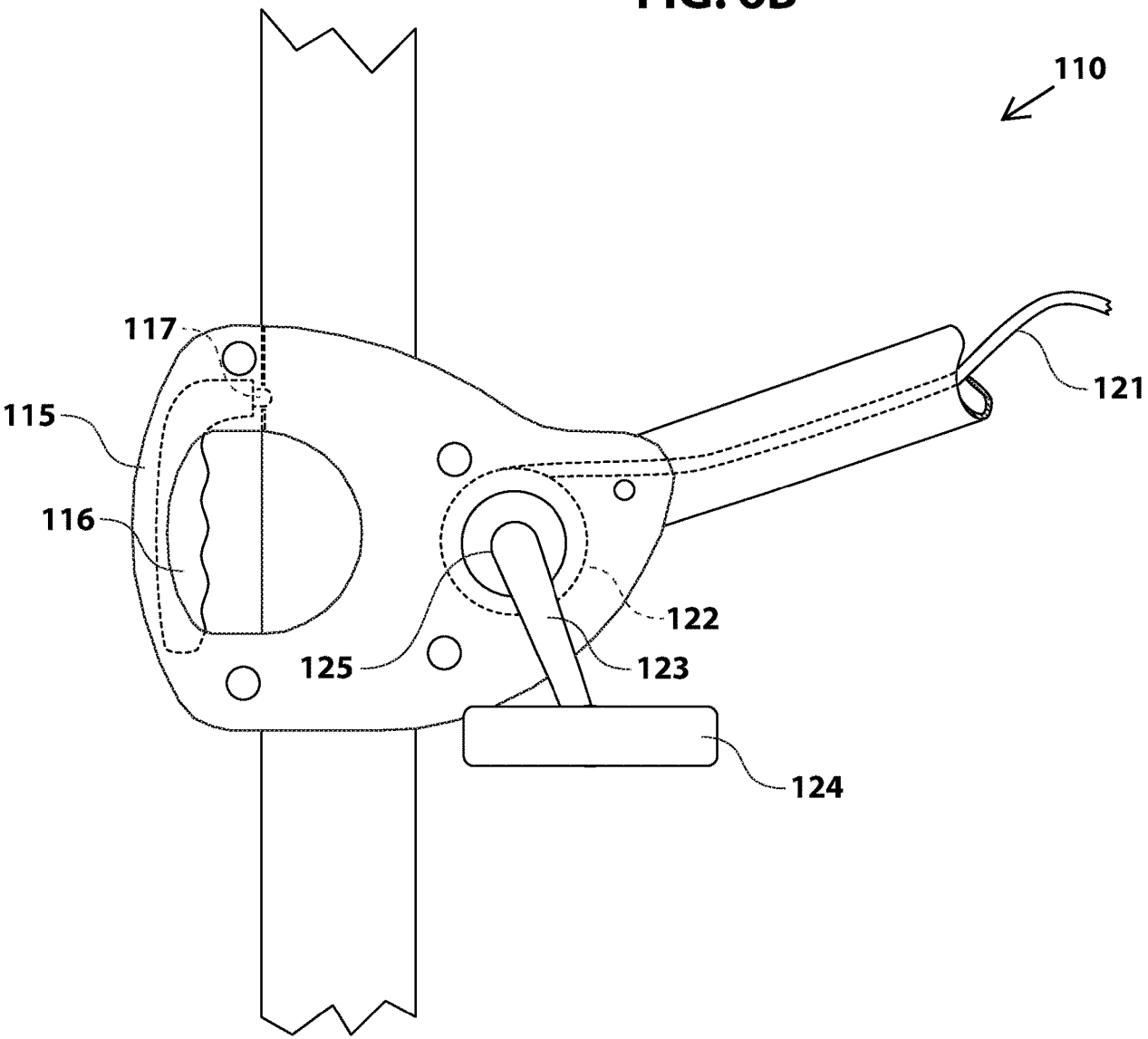
Figure 7A:
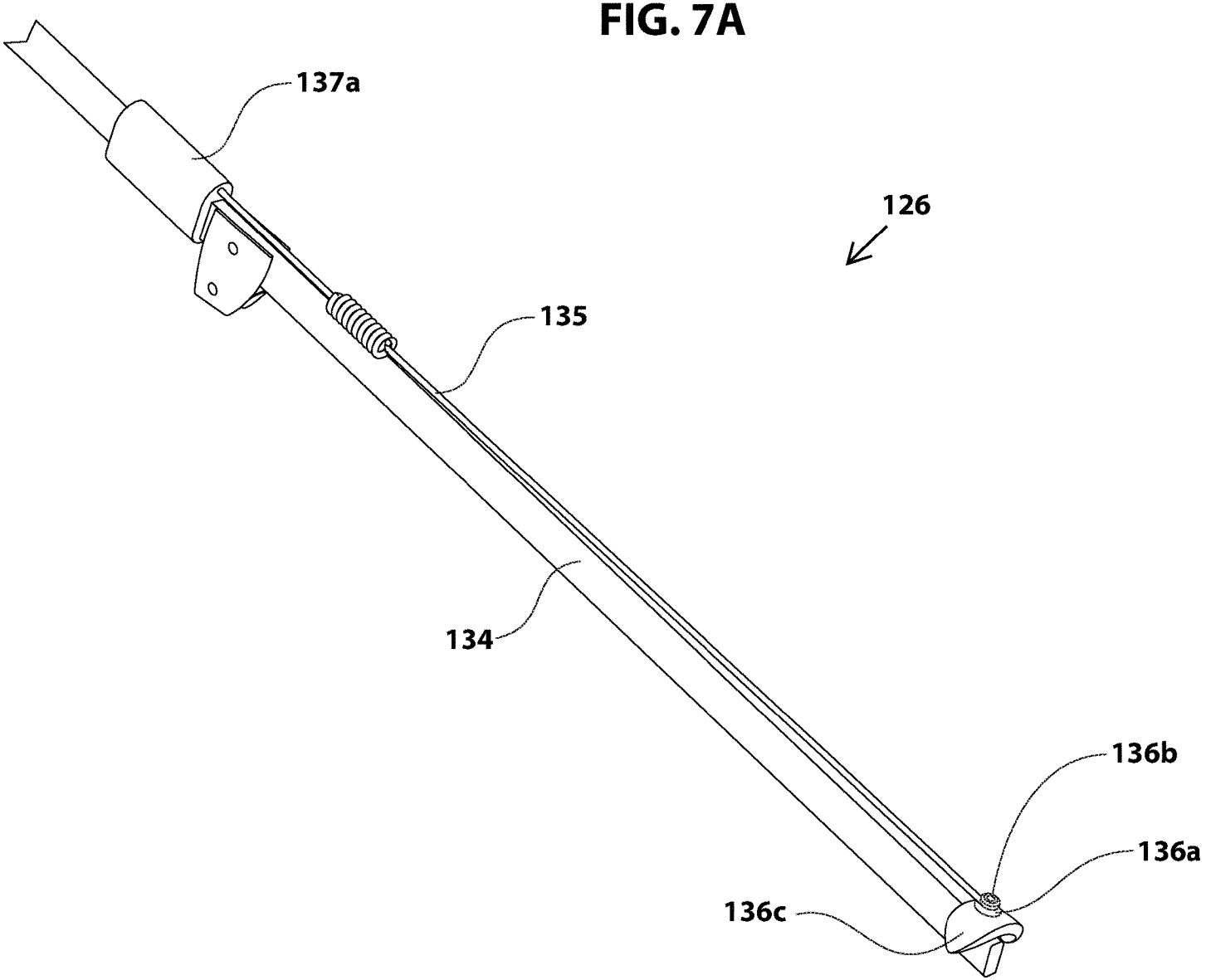
FIG. 7A and FIG. 7B illustrate partial perspective views of the adjustable-tension-canopy-spring brackets, wind-lift-eliminating self-adjusting funnel-and-canopy-tension-adjusting springs, wind-lift-eliminating-self-adjusting-funnel-and-canopy-tension-adjusting-spring eyelets, adjustable-tension-canopy-spring-eyelet washer and screws, and automatic-canopy-spring-centering crescents, respectively, in the wind-lift-eliminating self-adjusting self-stabilizing reversible-canopy arthritic-aiding umbrella.
Figure 7B:
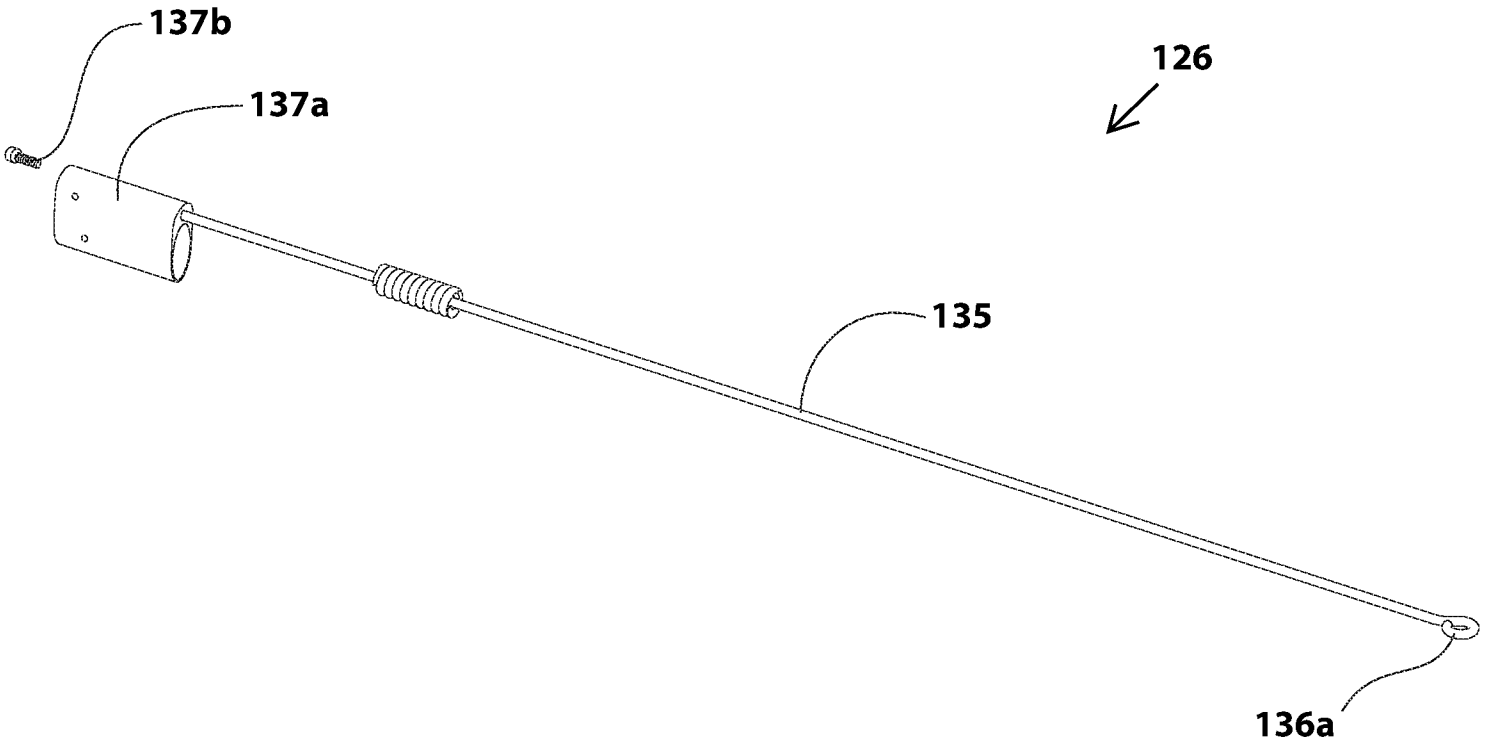
Figure 8A:
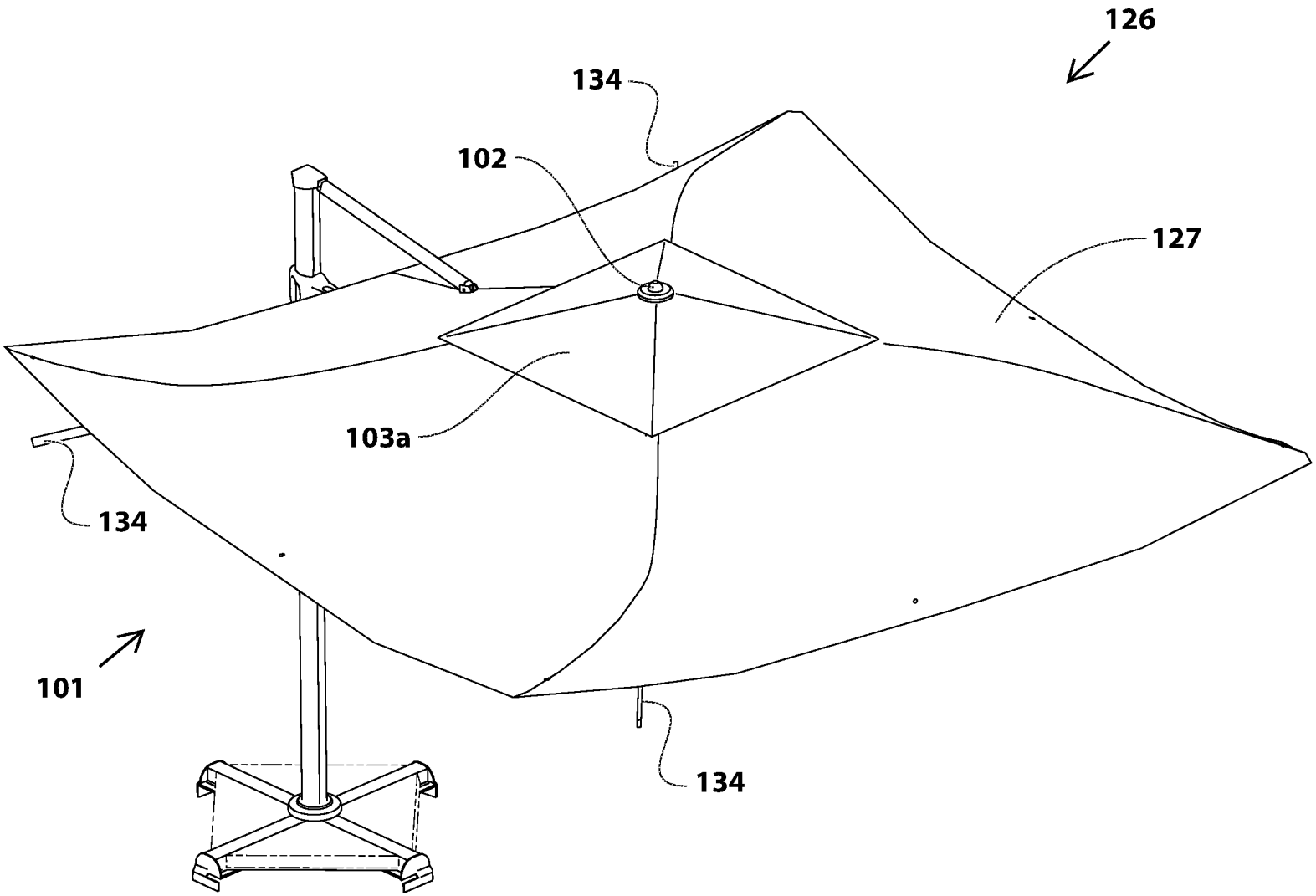
FIG. 8A, FIG. 8B, and FIG. 8C illustrate perspective, hidden, and partial views of the wind-lift-eliminating self-adjusting self-stabilizing reversible-canopy arthritic-aiding umbrella and down-force cooling-funnels, respectively.
Figure 8B:
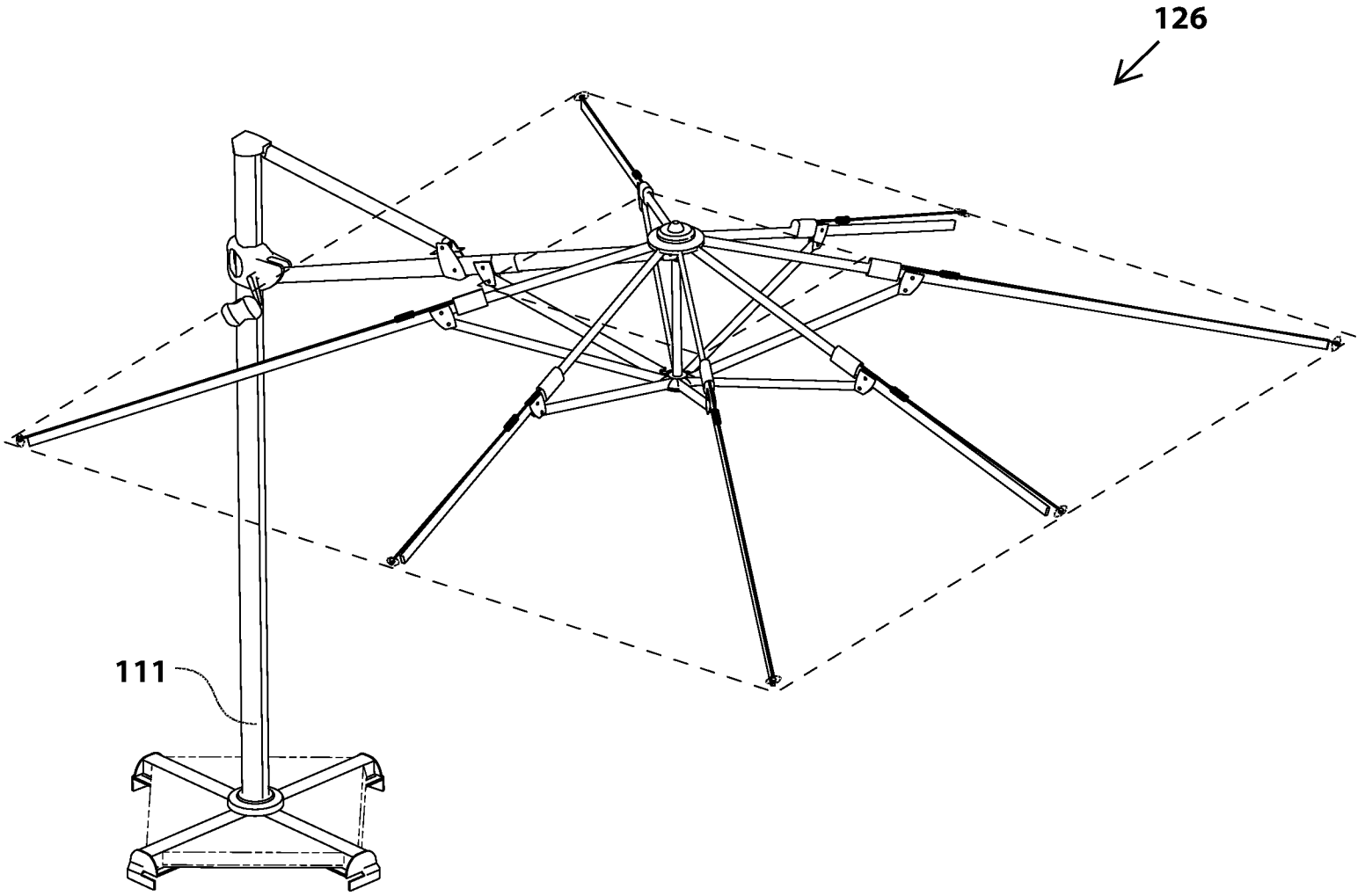
Figure 8C:
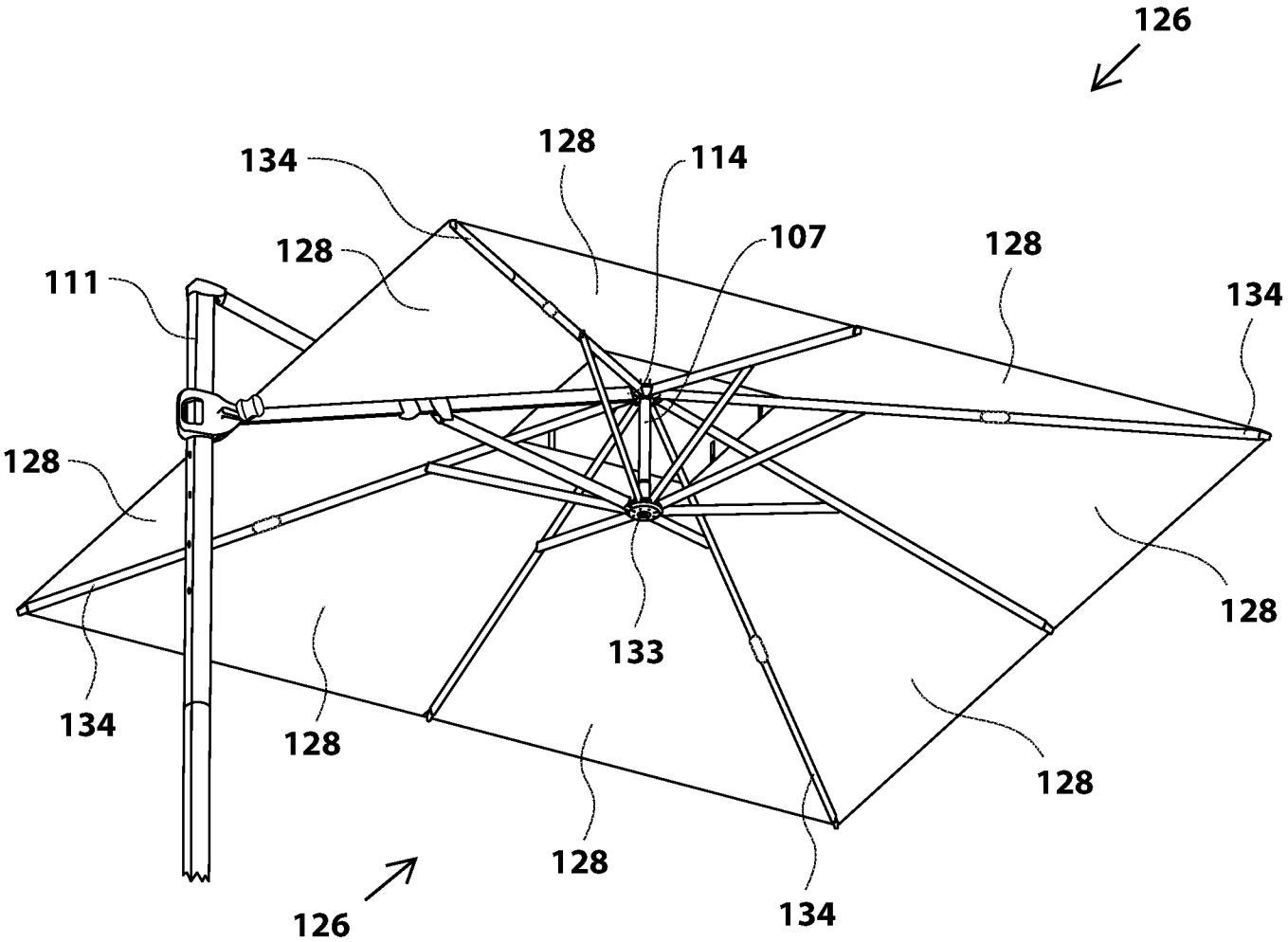
Figure 9:
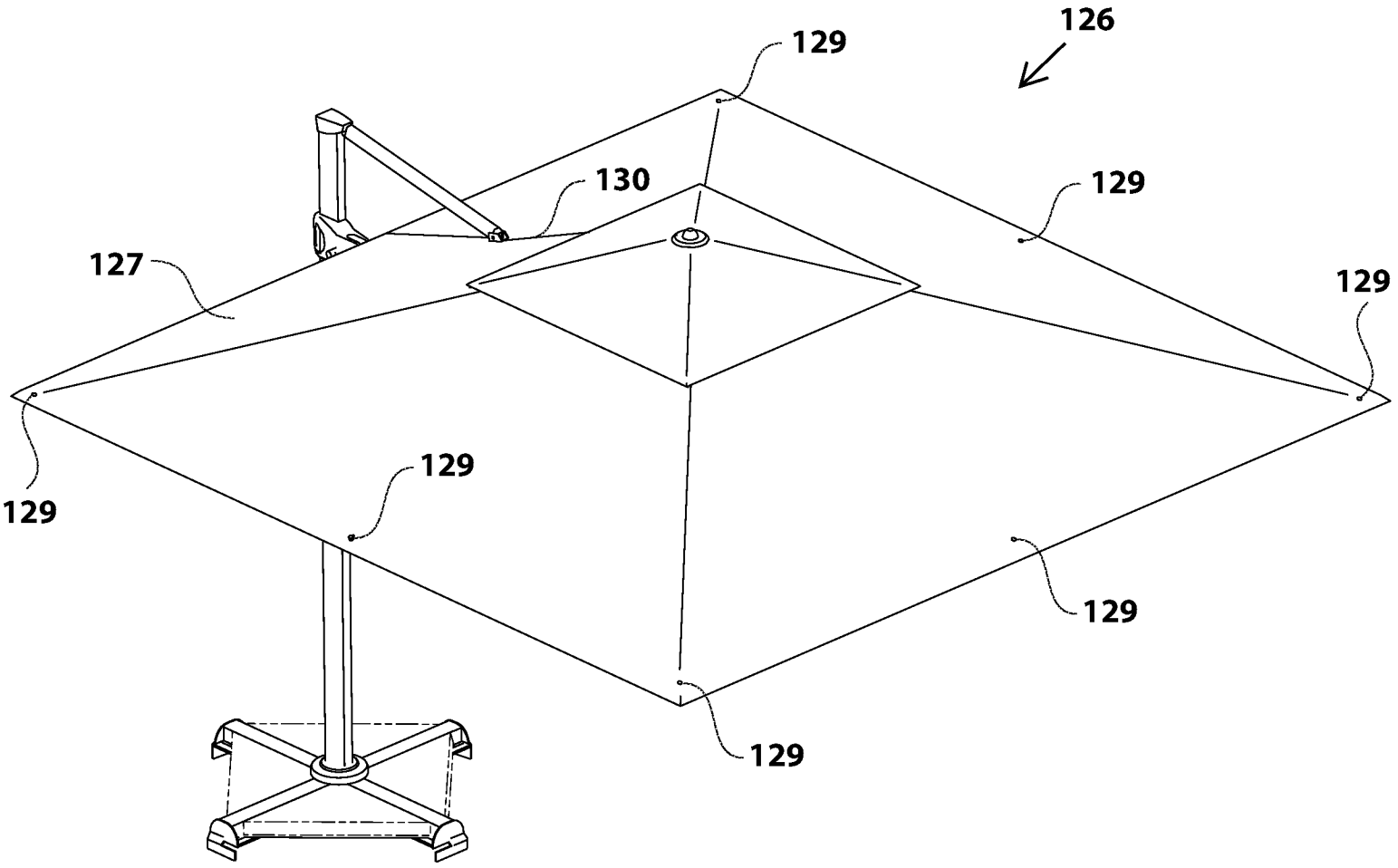

9) Lower self-centering spiral-locking cone 109 is for:

a) Centering lower self-centering spiral-locking cone 109 with upper self-centering inverted spiral-locking cone 108 during deployment of the wind-lift-eliminating self-adjusting self-stabilizing reversible-canopy arthritic-aiding umbrella
in the direction of arrow 146
(see FIG. 14);

b) Preventing the wind-lift-eliminating self-adjusting self-stabilizing reversible-canopy arthritic-aiding umbrella from radially twisting clockwise out of its desired fit while fully deployed
in the direction of arrow 146
(see FIG. 5, and FIG. 14);

c) Preventing the wind-lift-eliminating self-adjusting self-stabilizing reversible-canopy arthritic-aiding umbrella from radially twisting counterclockwise out of desired fit while fully deployed
in the direction of arrow 146
(see FIG. 14); and d) Twist-locking lower self-centering spiral-locking cone 109 with upper self-centering inverted spiral-locking cone 108, thereby preventing easy dislodging of their union and connection
in the direction of arrow 146
(see FIG. 5, and FIG. 14).

10) Arthritic-aiding and canopy-deploying system 110 is for performing the combined functions of its components.

11) Canopy-height-adjusting stanchion 111 is for:
Securing all other components of the wind-lift-eliminating self-adjusting self-stabilizing reversible-canopy arthritic-aiding umbrella upon canopy-height-adjusting stanchion 111.

12) Canopy-lifting-arm intersector 112 is for:
Bolting to canopy-height-adjusting stanchion 111 and pivotably supporting canopy-supporting arm 119.

13) Canopy-supporting-arm intersector 113 is for:
Attaching to canopy-supporting arm 119 and pivotably supporting canopy-lifting arm 120.

14) Canopy top-hub intersector 114 is for:
Attaching to canopy-lifting arm 120 and pivotably supporting canopy top-hub-ring 132.

15) Canopy-height-and-tilt-adjusting arthritic-aiding handle 115 is for:
Slidably, adjustably, and lockably connecting to canopy-height-adjusting stanchion 111.
to adjustably support the height and tilt of canopy-lifting arm 120.

16) Canopy height-adjusting arthritic-aiding trigger 116 is for:

a) Providing aid to those with arthritic conditions in their hands to operate canopy-height-and-tilt-adjusting arthritic-aiding handle 115 without discomfort:
(see FIGS. 6A and 6B)

b) Providing means to slidably lower and raise canopy-height-and-tilt-adjusting arthritic-aiding handle 115 thereby adjusting the height and tilt of canopy-lifting arm 120; and c) Engaging arthritic-aiding trigger pin 117
to predeterminedly and lockably engage to arthritic-aiding-trigger-pin holes 118.
(see FIGS. 6A and 6B)

17) Arthritic-aiding trigger pin 117 is for:
Locking canopy-height-and-tilt-adjusting arthritic-aiding handle 115 to canopy-height-adjusting stanchion 111 at a predetermined height.
in the directions of arrows 164*a*, 164*b*, 165*a*, 165*b*, 166*a*, and 166*b*
(see FIG. 22A, 22B, and FIG. 22C);

18) Arthritic-aiding-trigger-pin holes 118 are for:
Providing means to insert arthritic-aiding trigger pin 117 into canopy-height-adjusting stanchion 111.

19) Canopy-supporting arm 119 is for:
Attaching to both canopy-lifting-arm intersector 112 and canopy-supporting-arm intersector 113.

20) Canopy-lifting arm 120 is for:
Lifting and tilting canopy top-hub intersector 114.

21) Canopy-deploying cable 121 is for:
Deploying and retracting Arthritic-aiding and canopy-deploying system 110.

22) Canopy-deploying-cable spool 122 is for:
Coiling and uncoiling canopy-deploying cable 121.

Figure 10:
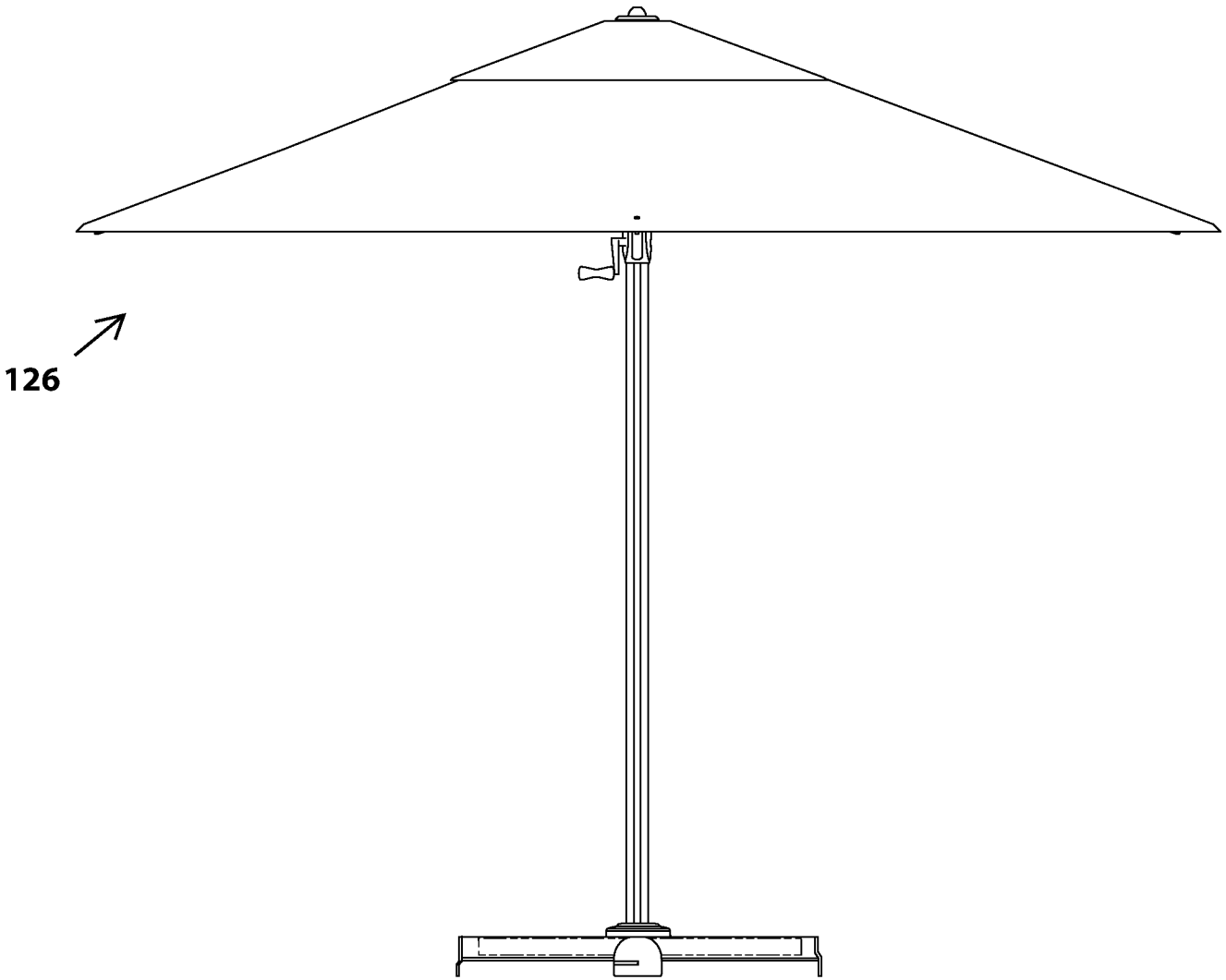
FIG. 10 illustrates a front view of the wind-lift-eliminating self-adjusting self-stabilizing reversible-canopy arthritic-aiding umbrella and the wind-lift-eliminating self-adjusting self-stabilizing reversible-canopy arthritic-aiding umbrella.
Figure 11A:
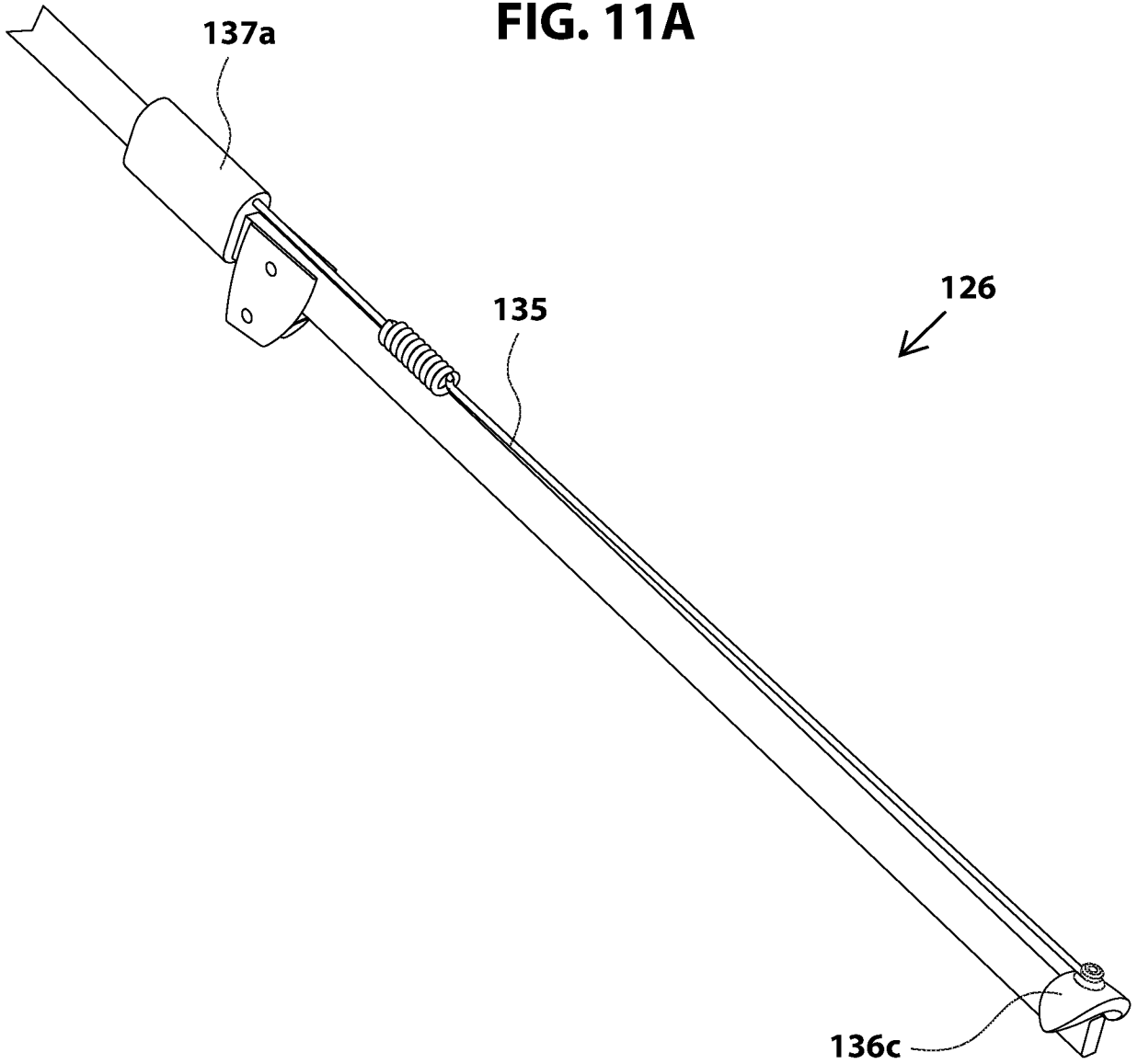
FIG. 11A and FIG. 11B illustrate a partial perspective and a partial side view of the adjustable-tension-canopy-spring brackets, wind-lift-eliminating self-adjusting funnel-and-canopy-tension-adjusting springs, wind-lift-eliminating-self-adjusting-funnel-and-canopy-tension-adjusting-spring eyelets, and automatic-canopy-spring-centering crescents, and an adjustable-tension screw, respectively, in the wind-lift-eliminating self-adjusting self-stabilizing reversible-canopy arthritic-aiding umbrella.
Figure 11B:
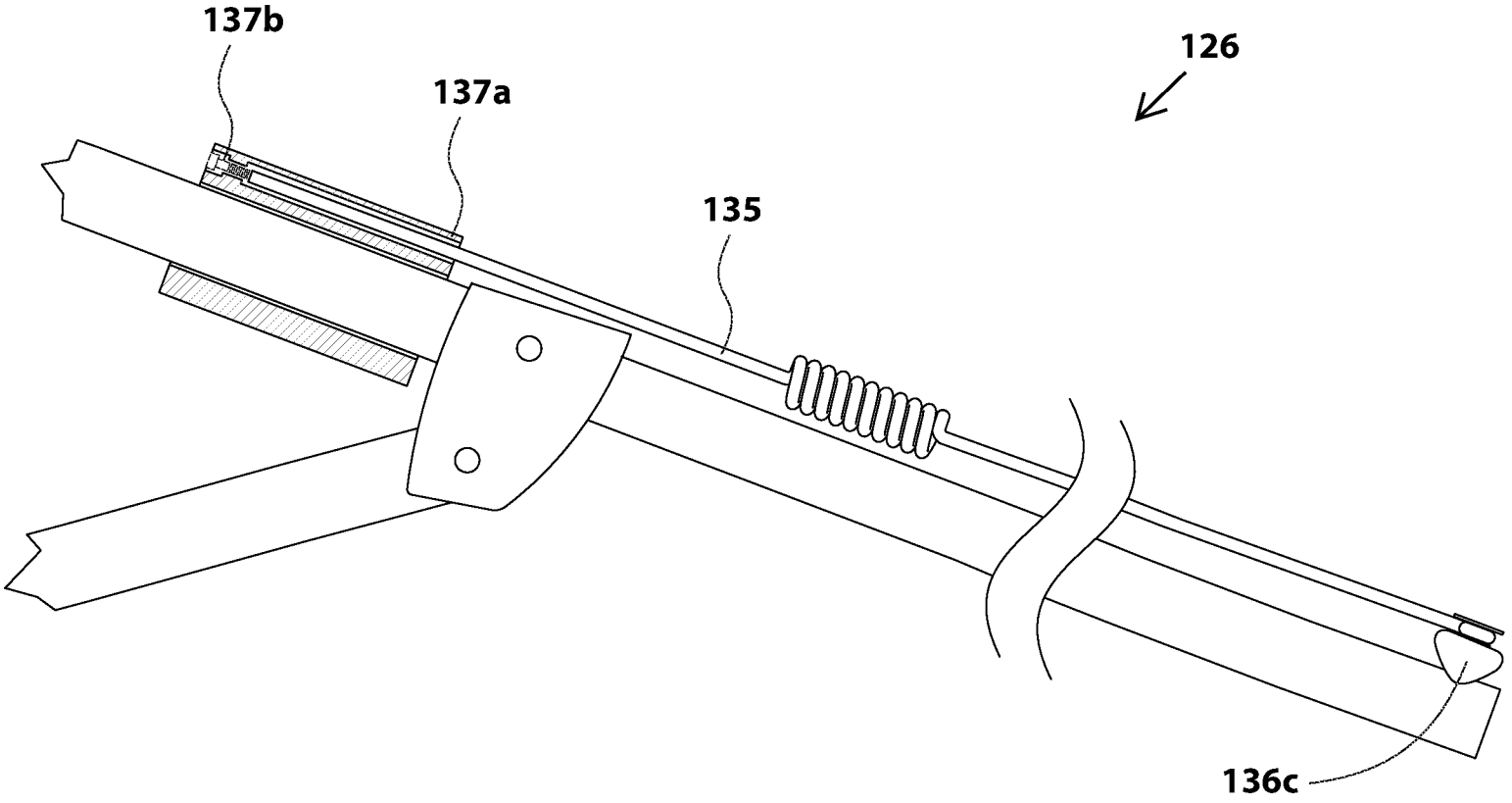
Figure 12:
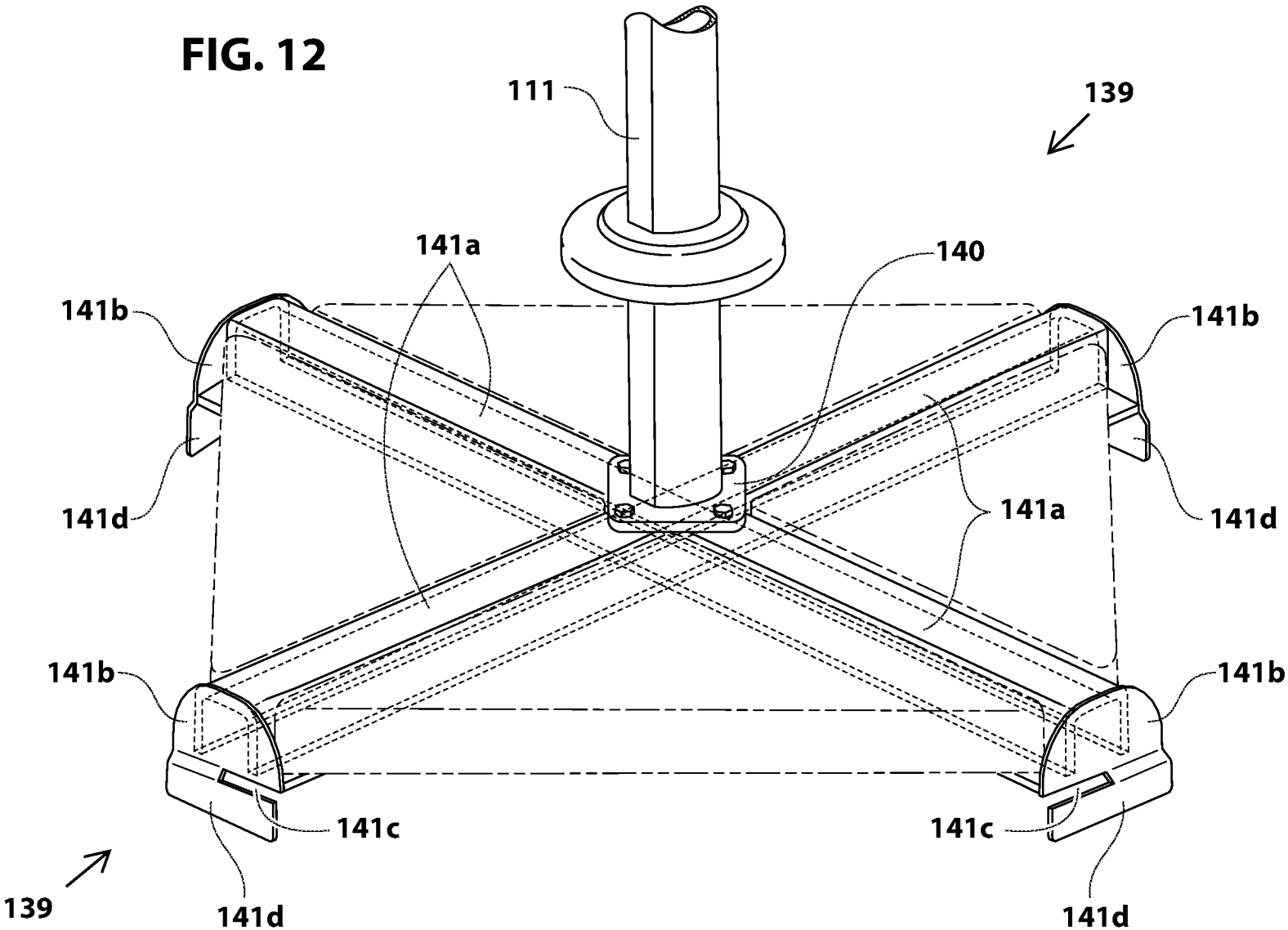
FIG. 12 illustrates a perspective partial view of the multi-base-connecting canopy base system.
Figure 15:
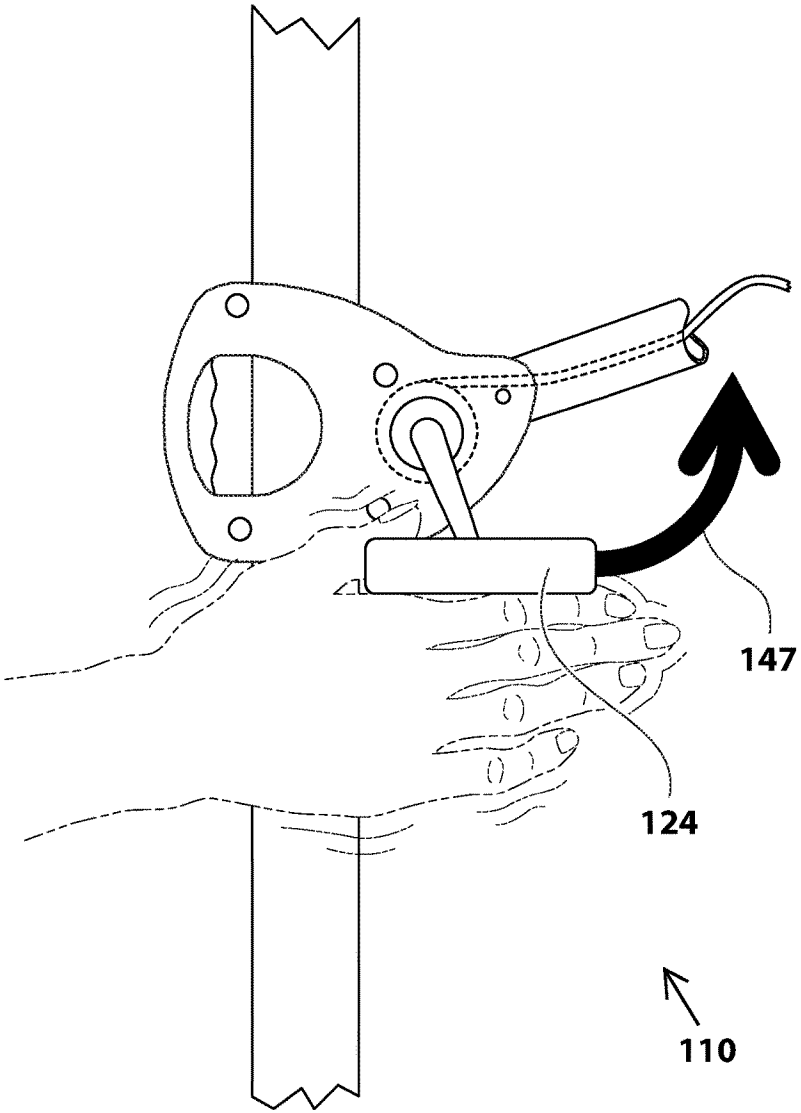
FIG. 15 illustrates a perspective partial view demonstrating how the Arthritic-aiding and canopy-deploying system aids an arthritic hand while operating the removable arthritic-aiding-canopy-deploying-crank paddles.

23) Removable arthritic-aiding-canopy-deploying crank 123 is for:
Providing means for a person to insert removable arthritic-aiding-canopy-deploying crank 123 into removable-crank insertion hole 125 and rotate canopy-deploying-cable spool 122.
in the directions of arrows 164*a*, 164*b*, 165*a*, 165*b*, 166*a*, and 166*b*
(see FIG. 22A, 22B, and FIG. 22C);

24) Removable arthritic-aiding-canopy-deploying-crank paddles 124 are for:

a) Providing aid to those with arthritic conditions in their hands to operate removable arthritic-aiding-canopy-deploying crank 123 without discomfort
in the directions of arrows 147
(see FIG. 15):

b) Providing means to engage Arthritic-aiding and canopy-deploying system 110 to deploy and retract reversible-canopy wind-pressure-releasing and cooling-funnel canopy system 126
in the directions of arrows 147
(see FIG. 10 and FIG. 15);

c) Providing a paddle-like, flatter, enlarged surface area to be in contact with an arthritic hand
to reduce concentrated pressure areas and to thereby reduce pain and discomfort, such as is not possible with prior art
in the directions of arrows 147
(see FIG. 15);

d) Providing ridges at the front and back
to aid those with arthritic hand conditions by helping to easily position and maintain their hands in the center of a removable arthritic-aiding-canopy-deploying-crank paddle 124, without slipping off, as prior art would naturally promote
in the directions of arrows 147
(see FIG. 6A, 6B, and FIG. 15); and e) Providing ridges at the top and bottom
to aid those with arthritic hand conditions by helping them easily position and maintain their hands in the center of a removable arthritic-aiding-canopy-deploying-crank paddle 124, while pushing upwards or downwards
in the directions of arrows 147
(see FIG. 15).

25) Removable-crank insertion hole 125 is for:
Inserting removable arthritic-aiding-canopy-deploying crank 123.

26) Wind-lift-eliminating self-adjusting self-stabilizing reversible-canopy arthritic-aiding umbrella 126 is for performing the combined functions of its components.

Figure 20A:
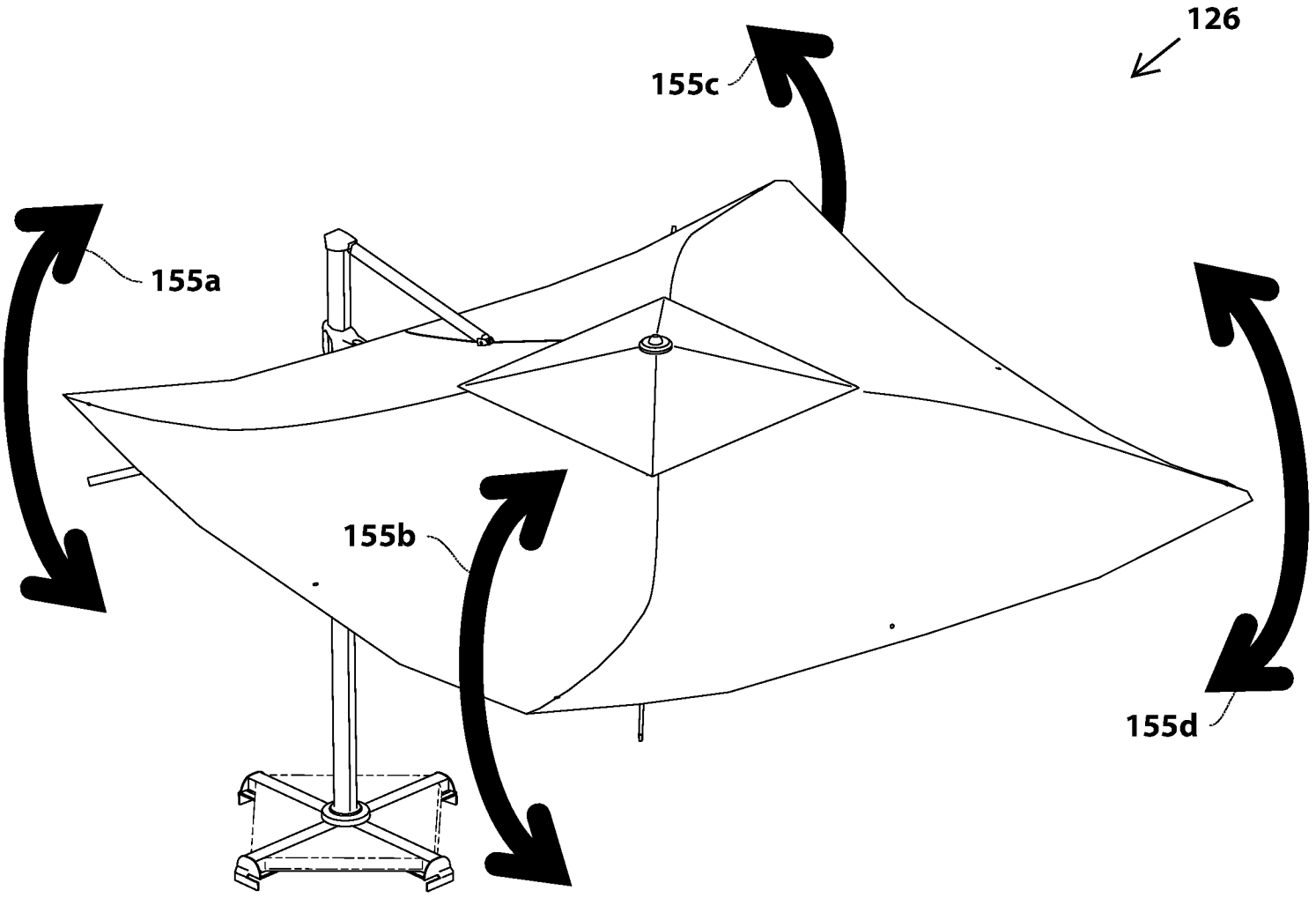
FIG. 20A, FIG. 20B, FIG. 20C, FIG. 20D, FIG. 20E, FIG. 20F, and FIG. 20G illustrate top, side, and perspective views, respectively demonstrating how the wind-lift-eliminating self-adjusting funnel-and-canopy-tension-adjusting springs can automatically flex from side to side and up and down in the wind-lift-eliminating self-adjusting self-stabilizing reversible-canopy arthritic-aiding umbrella, thereby releasing wind-pressure to stabilize the wind-lift-eliminating self-adjusting self-stabilizing reversible-canopy arthritic-aiding umbrella.
Figure 20B:
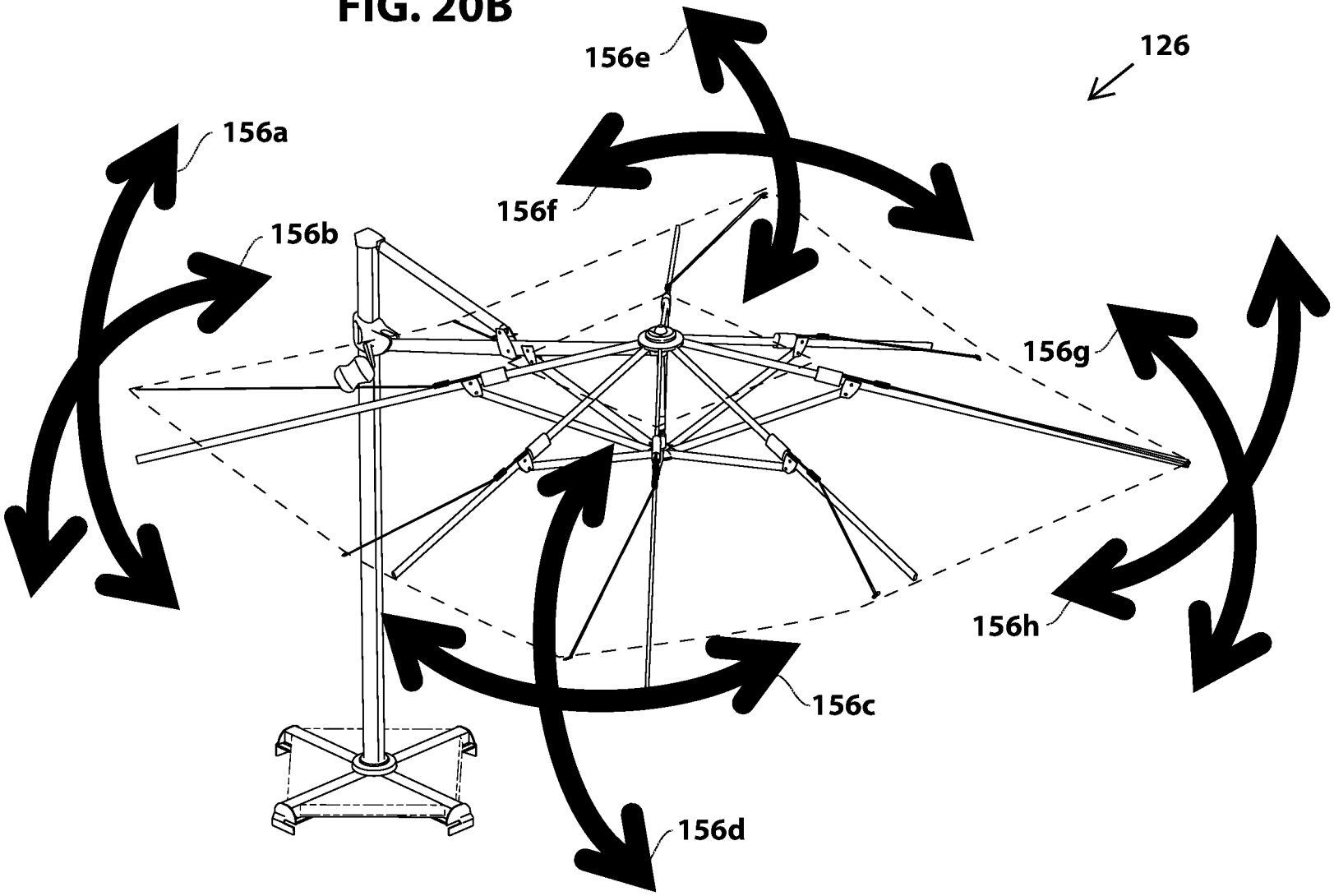
Figure 20C:
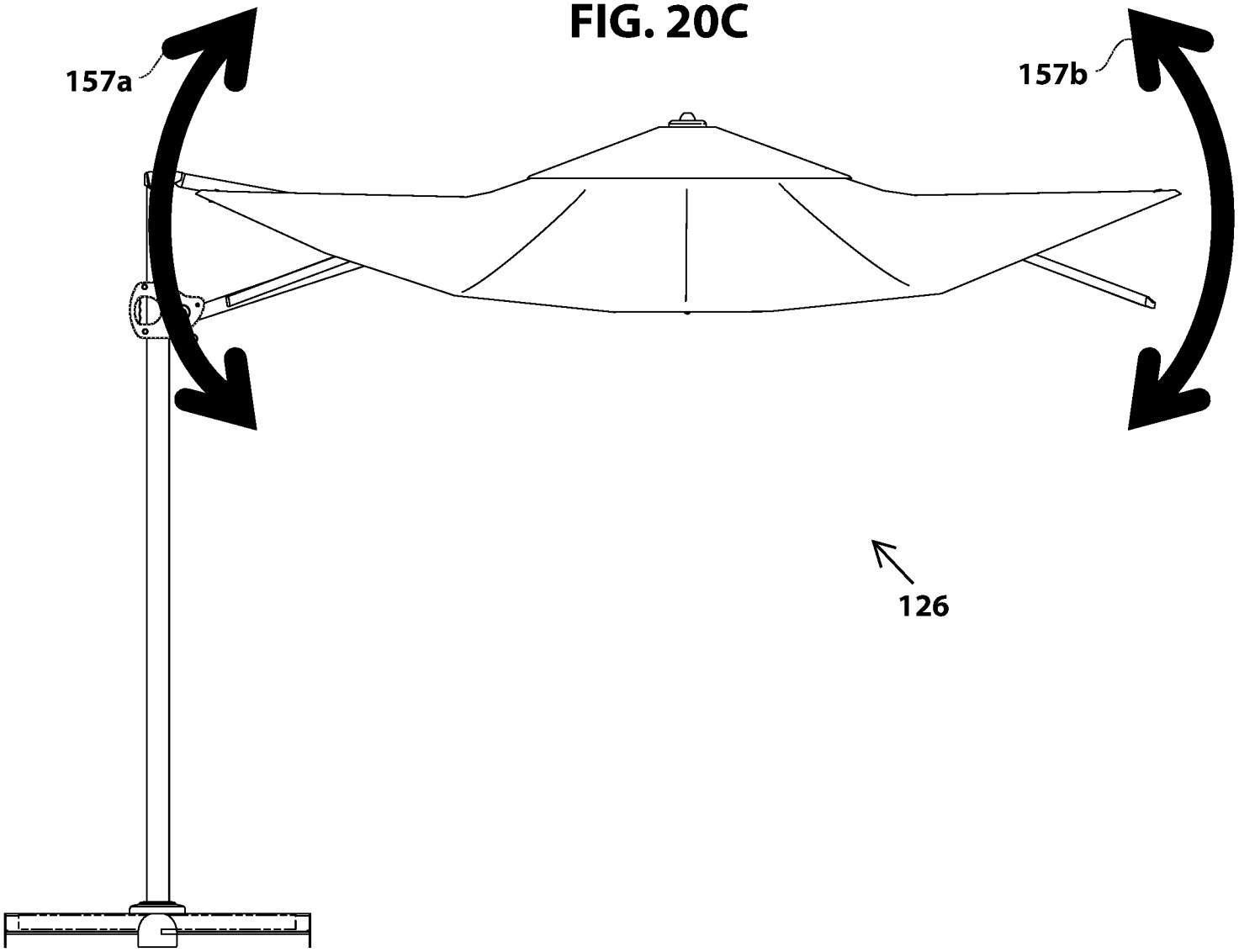
Figure 20D:
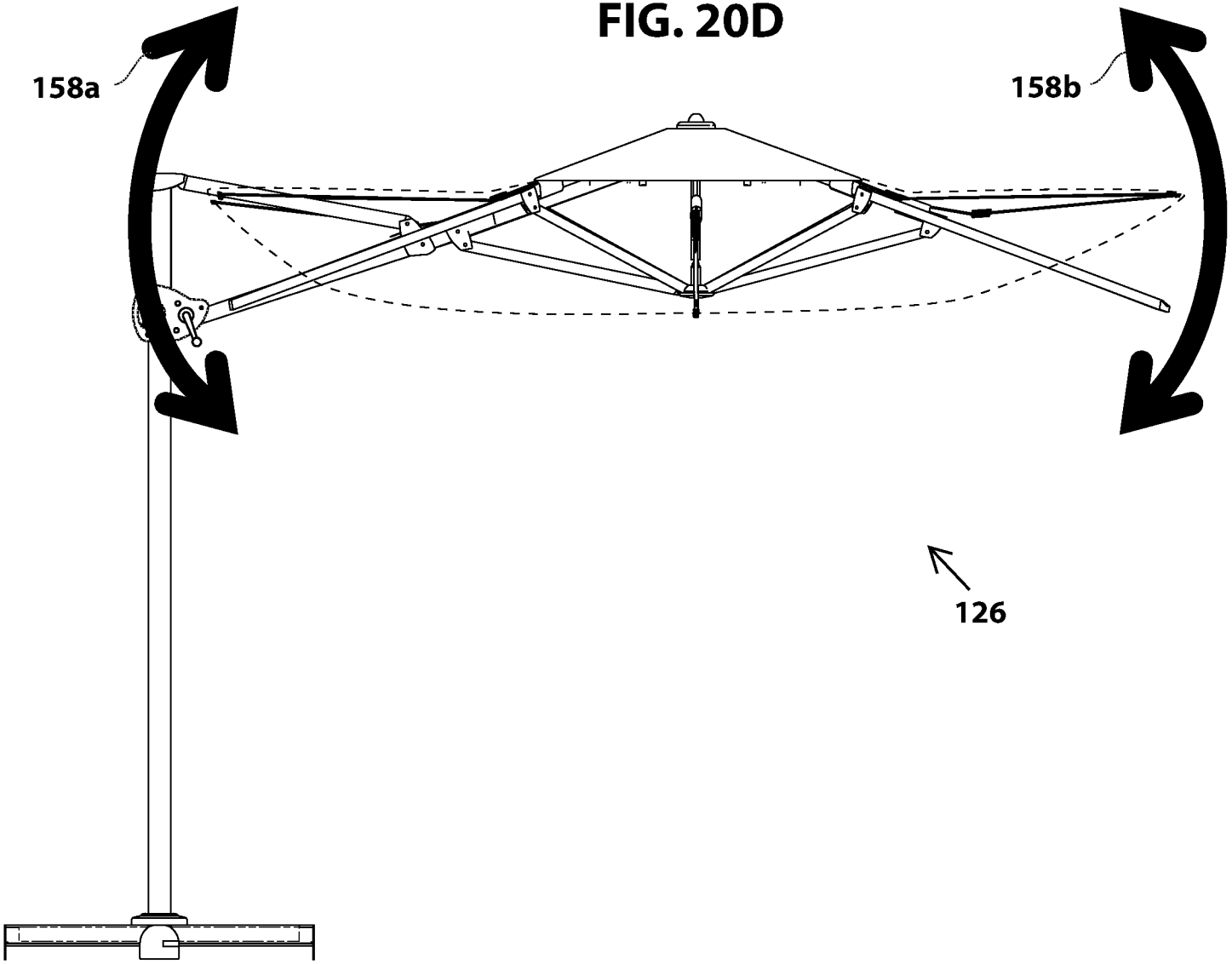
Figure 20E:
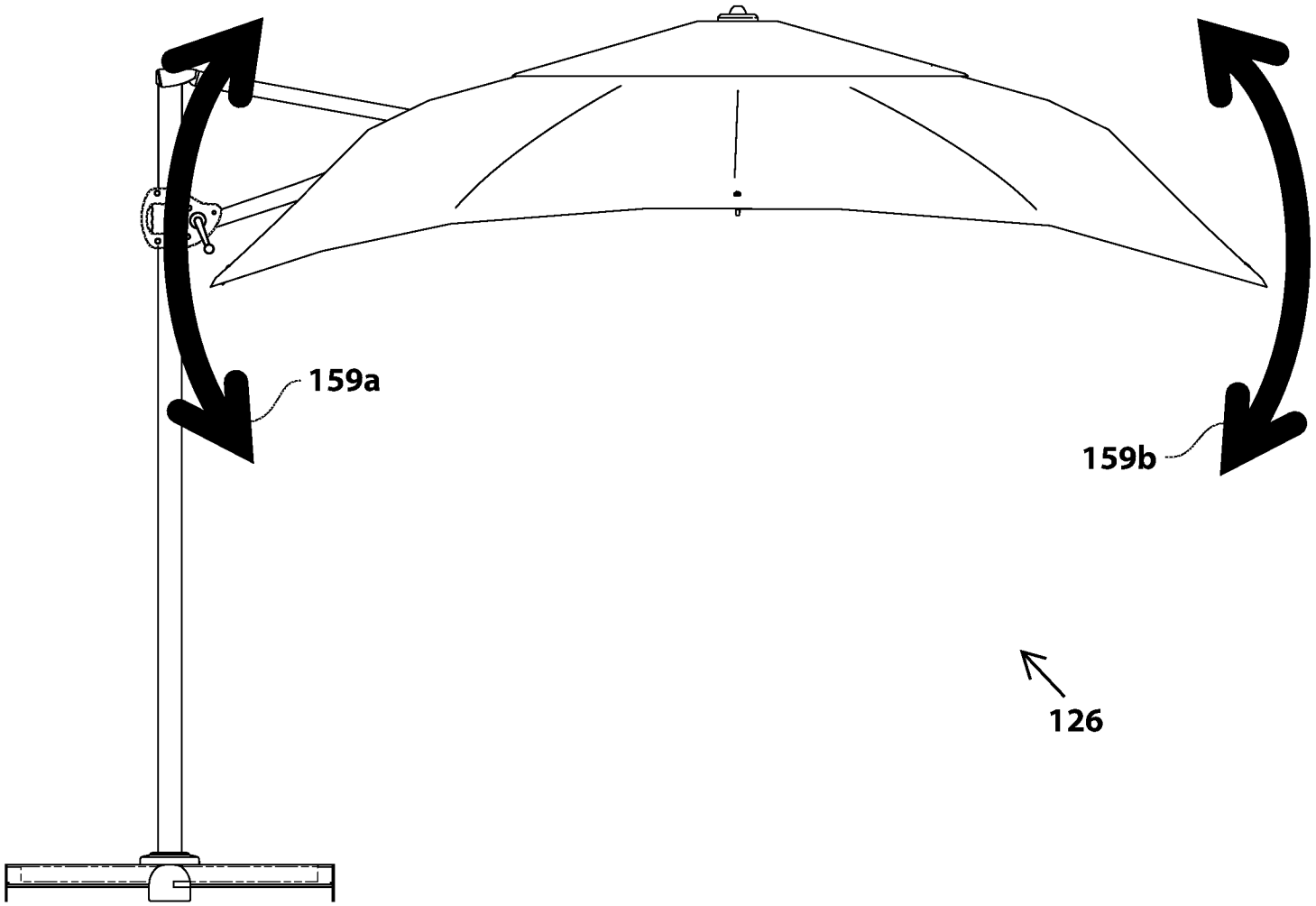
Figure 20F:
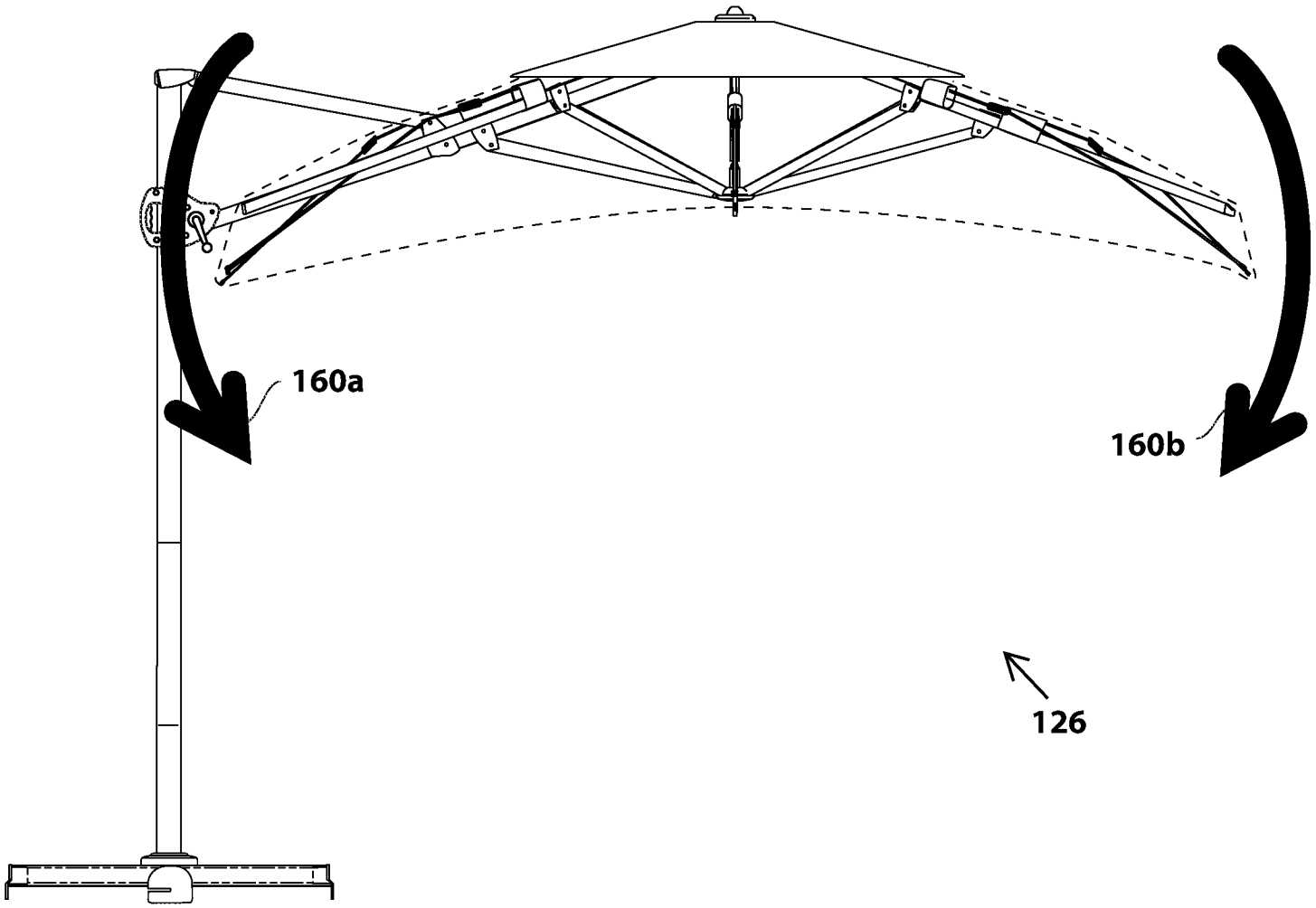
Figure 20G:
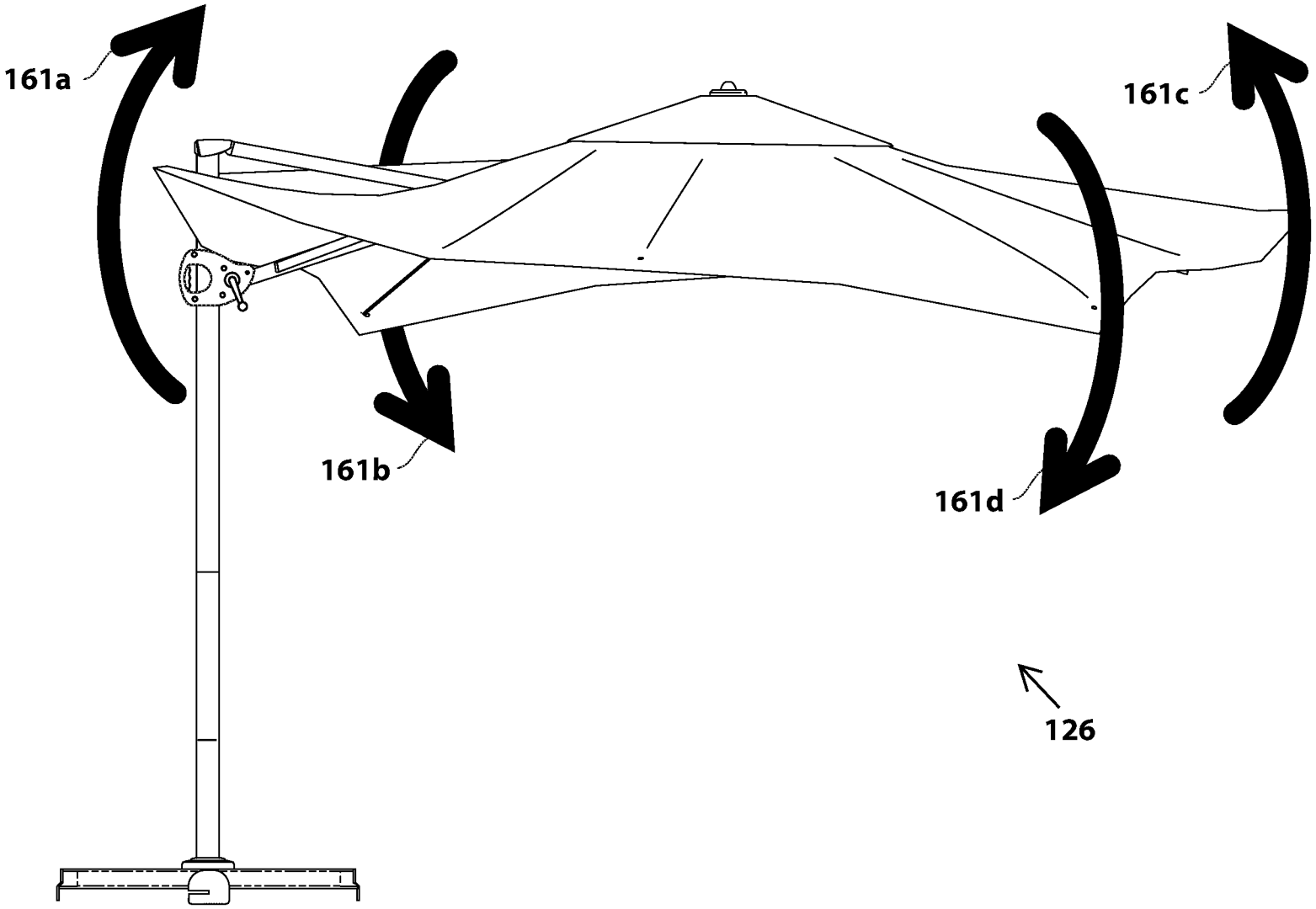

27) Reversible wind-pressure-releasing and cooling-funnel canopy 127 is for:

a) Providing a cover to protect users from weather elements;

b) Releasing air pressure below the wind-lift-eliminating self-adjusting self-stabilizing reversible-canopy arthritic-aiding umbrella
in the directions of arrows 157*a*, 157*b*, 158*a*, and 158*b*
(see FIG. 20C and FIG. 20D);

c) Stabilizing side-to-side movement from wind gusts, by relieving air pressure from below cooling-funnels 128 of the wind-lift-eliminating self-adjusting self-stabilizing reversible-canopy arthritic-aiding umbrella
in the directions of arrows 150*a*, 150*b*, 150*c*, 150*d*, 151 and 152
(see FIG. 17, 18A, FIG. 18B, and FIG. 18C);

d) Eliminating lift from wind gusts of by relieving air pressure from below cooling-funnels 128 of the wind-lift-eliminating self-adjusting self-stabilizing reversible-canopy arthritic-aiding umbrella
in the directions of arrows 157*a*, 157*b*, 158*a*, and 158*b*
(see FIG. 20C and FIG. 20B);

e) Eliminating vibration from wind by relieving air pressure from below cooling-funnels 128 of the wind-lift-eliminating self-adjusting self-stabilizing reversible-canopy arthritic-aiding umbrella
in the directions of arrows 148*a*, 148*b*, 149*a* and 149*b*
(see FIG. 16A, FIG. 16B, FIG. 16C, FIG. 16D, and FIG. 16E);

f) Customizing wind-flow direction and pattern from the sides to the inside of the wind-lift-eliminating self-adjusting self-stabilizing reversible-canopy arthritic-aiding umbrella by adjusting tension of Wind-lift-eliminating self-adjusting funnel-and-canopy-tension-adjusting springs 135 by tightening or loosening of adjustable-tension screws 137*b*
in the directions of arrows 148*a*, 148*b*, 149*a*, 148*a*, and 149*b*
(see FIG. 16A, FIG. 16B, FIG. 16C, FIG. 16D, and FIG. 16E); and g) Customizing volume of air pressure below the wind-lift-eliminating self-adjusting self-stabilizing reversible-canopy arthritic-aiding umbrella by adjusting tension of wind-lift-eliminating self-adjusting funnel-and-canopy-tension-adjusting springs 135
in the directions of arrows 148*a*, 148*b*, 149*a* and 149*b*
(see FIG. 16A, FIG. 16B, FIG. 16C, FIG. 16D, and FIG. 16E).

Figure 21A:
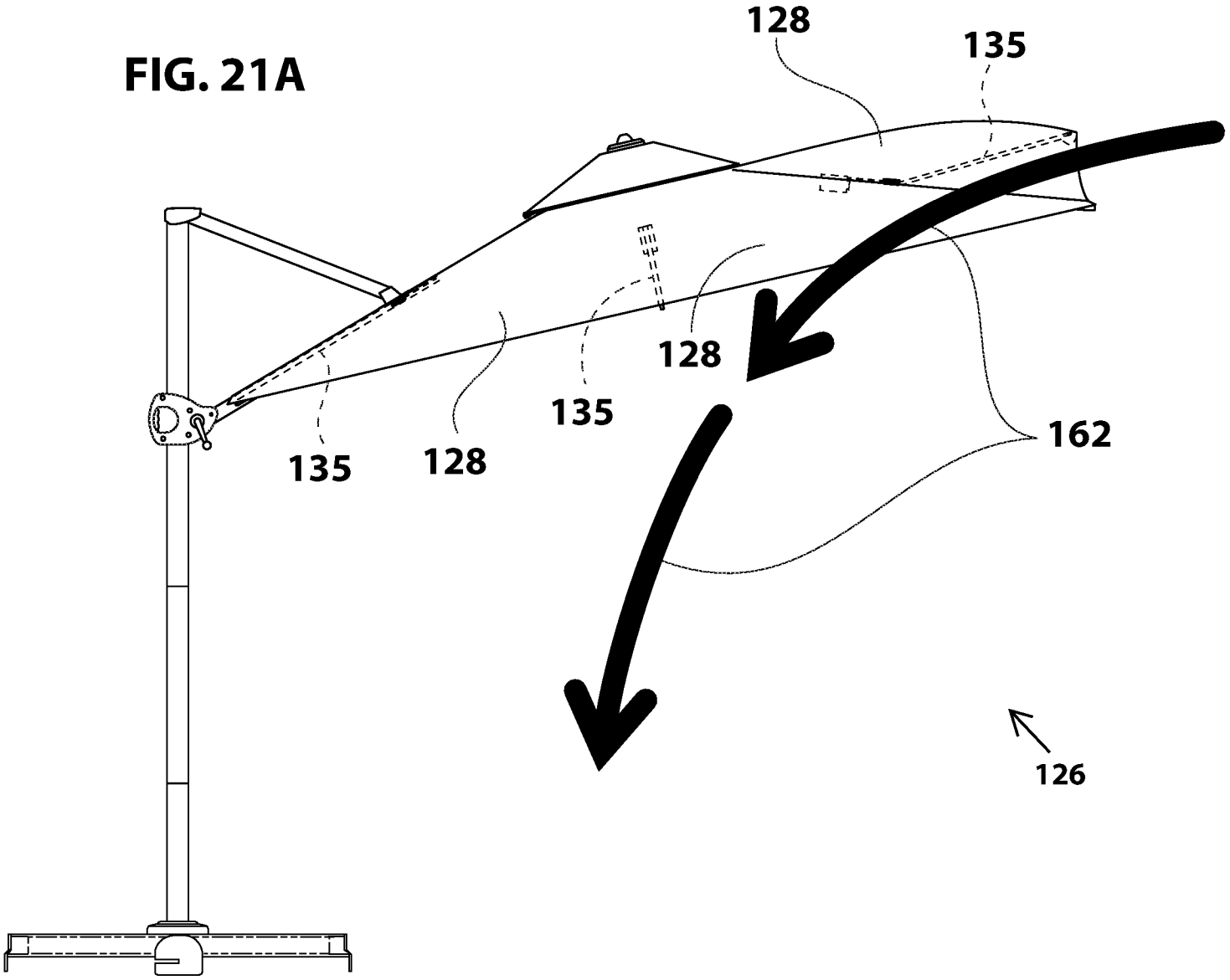
FIG. 21A and FIG. 21B illustrate side and front views, respectively demonstrating how the down-force cooling-funnels can direct horizontal wind-flow to generally vertical below the reversible wind-pressure-releasing and cooling-funnel canopy, thereby cooling the temperature for occupant's benefit below.
Figure 21B:
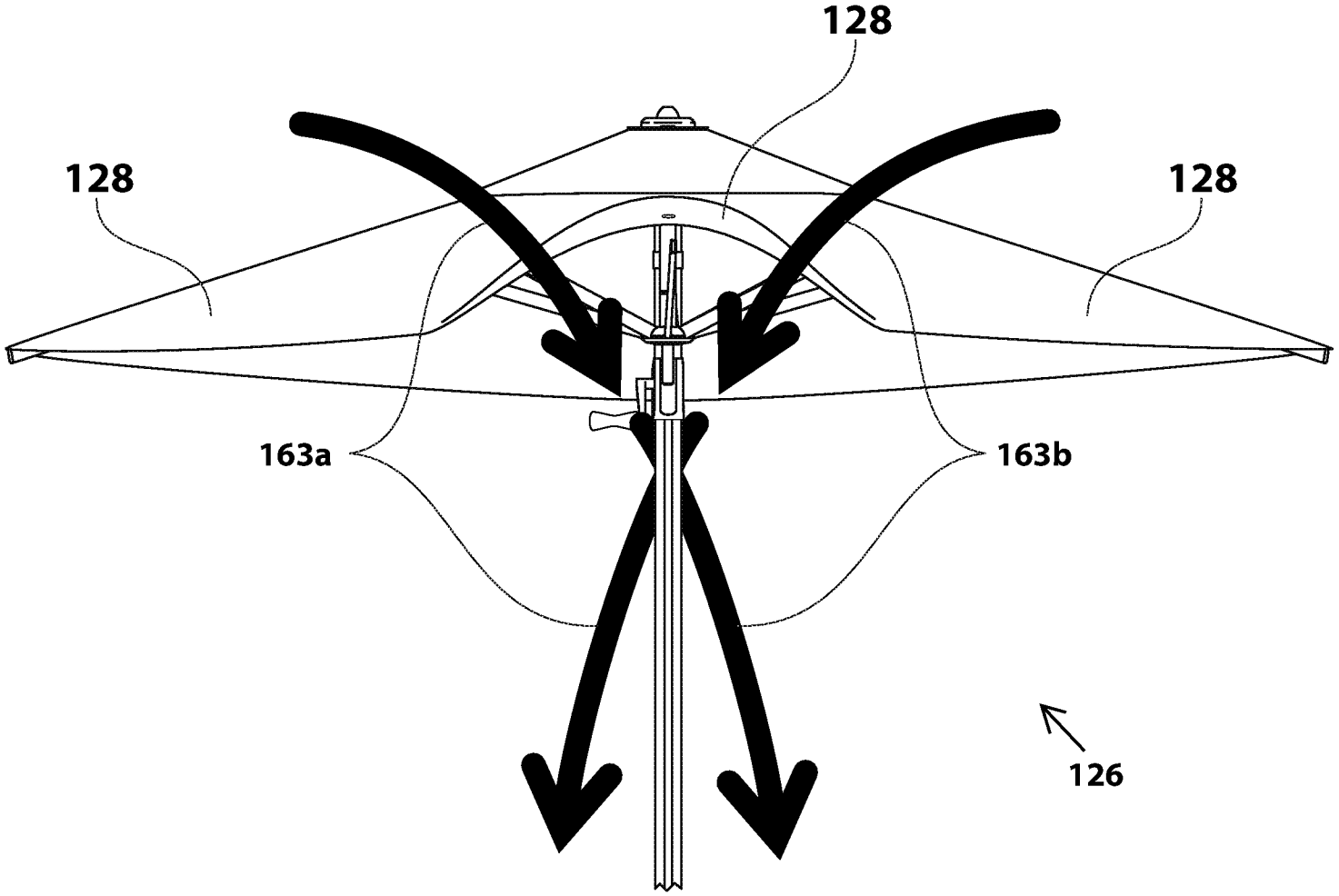
Figure 22A:
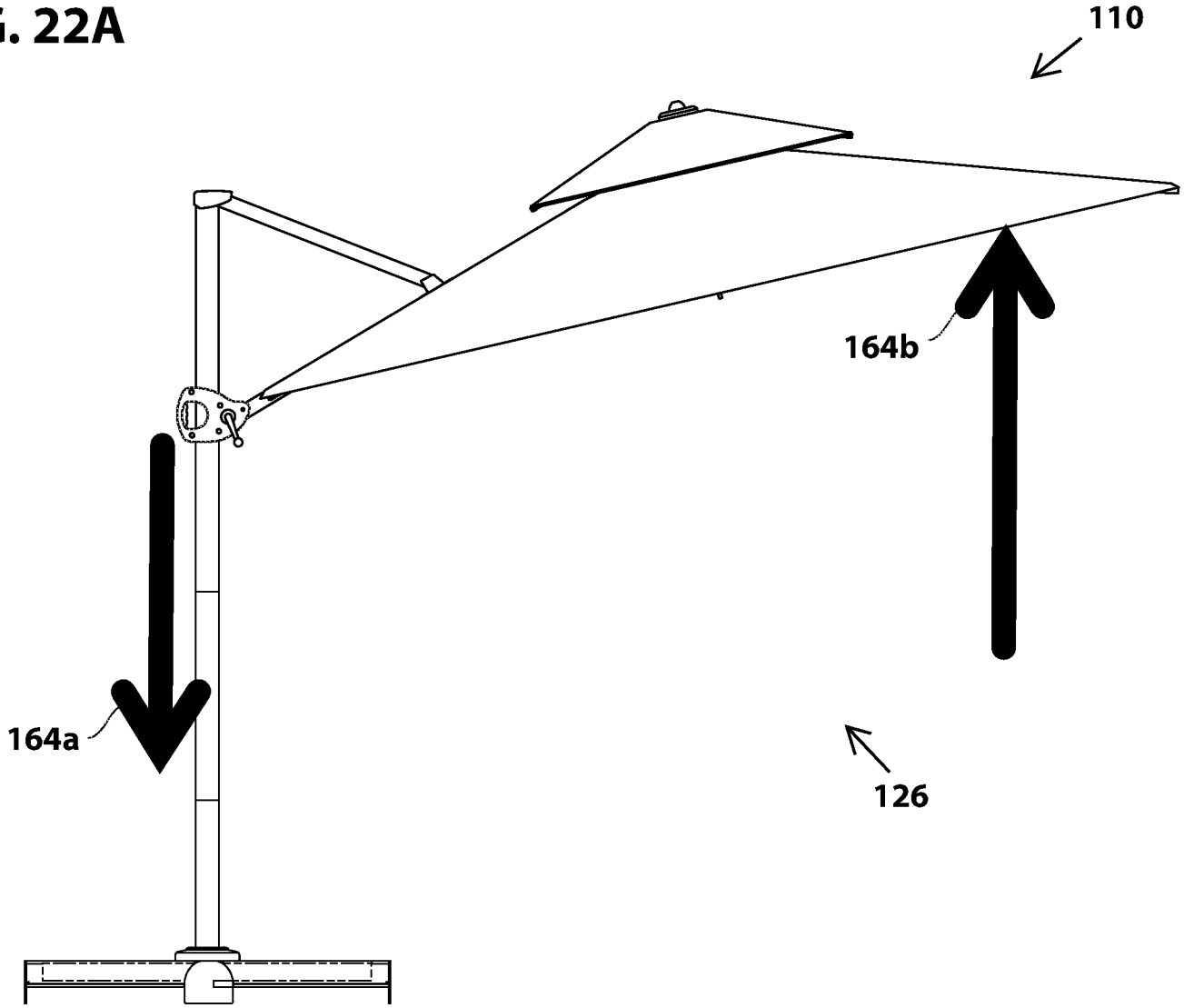
FIG. 22A, FIG. 22B, and FIG. 22C illustrate side views demonstrating how the Arthritic-aiding and canopy-deploying system provides tilt angle adjustability to the wind-lift-eliminating self-adjusting self-stabilizing reversible-canopy arthritic-aiding umbrella.
Figure 22B:
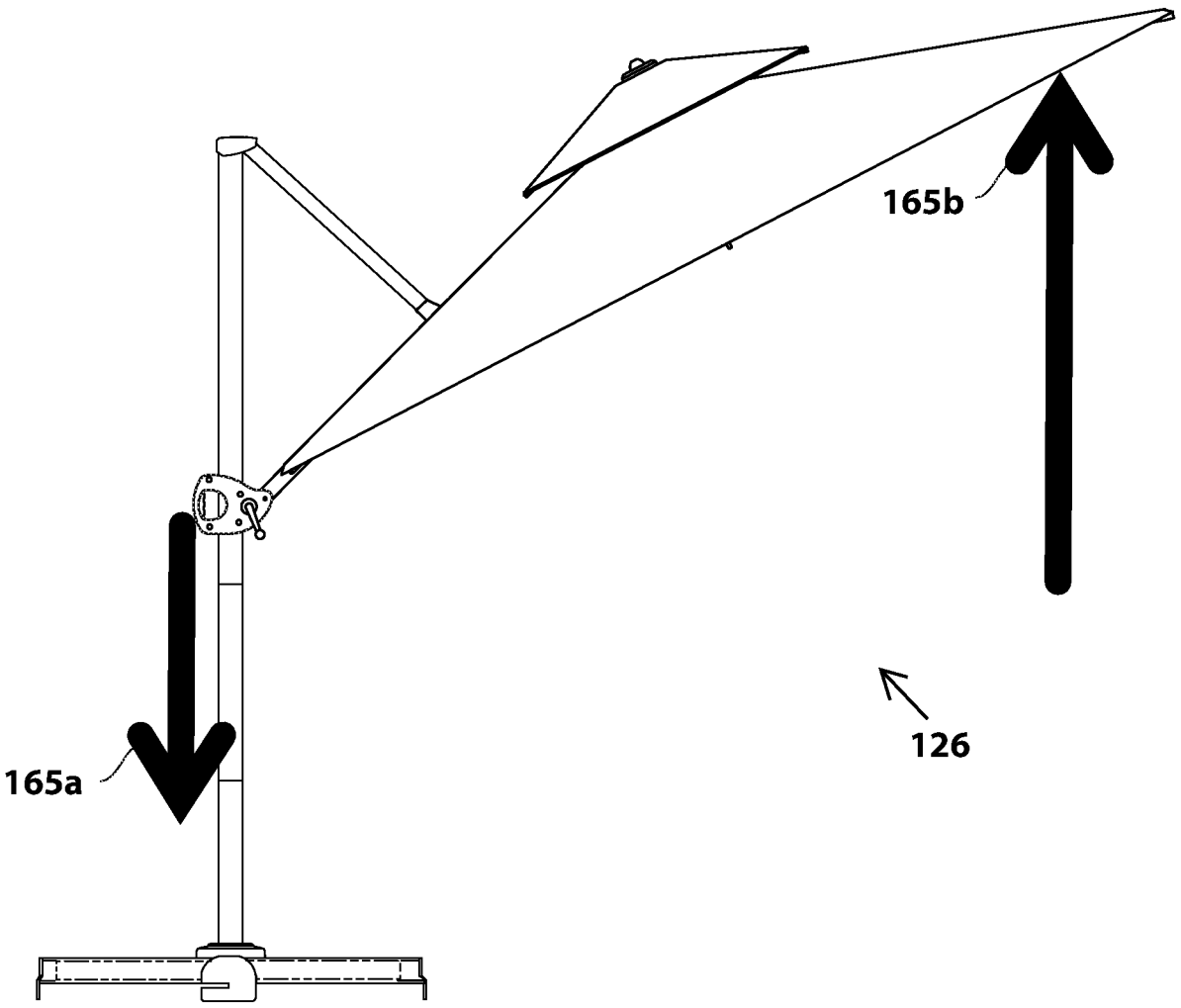
Figure 22C:
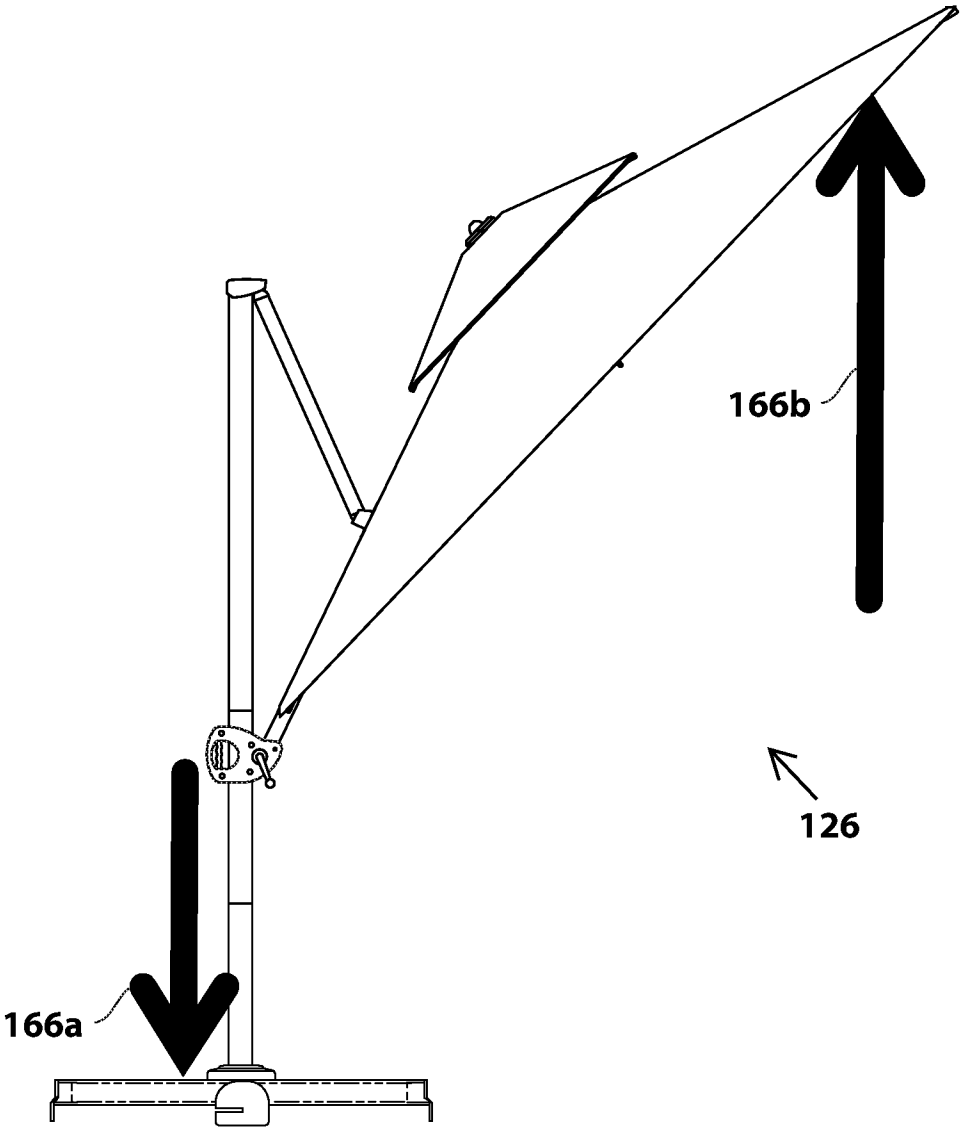

28) Cooling-funnels 128 are for:

a) Providing respective wind scoops, guiding the wind-flow inward and downward through the directional cooling-funnels 128
in the directions of arrows 162, 163*b*, and 163*b*
(see FIGS. 21A, and 21B);

b) Cooling the environment for the occupants under cooling-funnels 128 by adjusting the tilt, and tension of Wind-lift-eliminating self-adjusting funnel-and-canopy-tension-adjusting springs 135
in the directions of arrows 162
(see FIG. 21A);

c) Releasing air pressure from below respective cooling-funnels 128 d) Automatically adjusting to air pressure from below by lifting and curling respective cooling-funnels 128 in locations where the wind and pressure are greatest e) Stabilizing side-to-side movement from wind gusts, by the cooling-funnels 128 relieving air pressure by respectively lifting and curling
in the directions of arrows 162*a*, 163*a*, and 163*b*
(see FIGS. 2IA, and 21B);

f) Eliminating umbrella lift from wind gusts by neutralizing and relieving air pressure from below cooling-funnels 128
in the directions of arrows 163*a*, and 163*b*
(see FIG. 21B);

g) Eliminating vibration from wind by relieving air pressure from below cooling-funnels 128
in the directions of arrows 162*a*, 163*a*, and 163*b*
(see FIGS. 21A, and 21B);

h) Customizing wind-flow direction and pattern from the sides to the inside of the wind-lift-eliminating self-adjusting self-stabilizing reversible-canopy arthritic-aiding umbrella by adjusting tension of Wind-lift-eliminating self-adjusting funnel-and-canopy-tension-adjusting springs 135; and i) Adjusting tension of Wind-lift-eliminating self-adjusting funnel-and-canopy-tension-adjusting springs 135. to customizing volume of air pressure
in the directions of arrows 162*a*, 163*a*, and 163*b*
(see FIG. 21B).

29) Canopy-spring mounting holes 129 are for:
Screwedly securing reversible wind-pressure-releasing and cooling-funnel canopy 127 to wind-lift-eliminating-self-adjusting-funnel-and-canopy-tension-adjusting-spring eyelets 136*a*.

30) Canopy hook-and-loop closure slit 130 is for:
Providing respective access for a predetermined location in reversible wind-pressure-releasing and cooling-funnel canopy 127 for canopy-supporting-arm intersector 113.

31) Customizable-flow-directing-chapeau opening 131 is for:
Providing an opening in reversible wind-pressure-releasing and cooling-funnel canopy 127 for wind-flow and pressure-release both inward and outward.

32) Canopy top-hub-ring 132 is for:
Respectively and pivotably attaching to upper-ribs 134.

33) Canopy bottom-shuttle-hub-ring 133 is are for:
Respectively and pivotably attaching to lower-ribs 138.

34) Upper-ribs 134 are for:
Respectively and pivotably attaching to lower-ribs 138 and canopy top-hub-ring 132.

Figure 17:
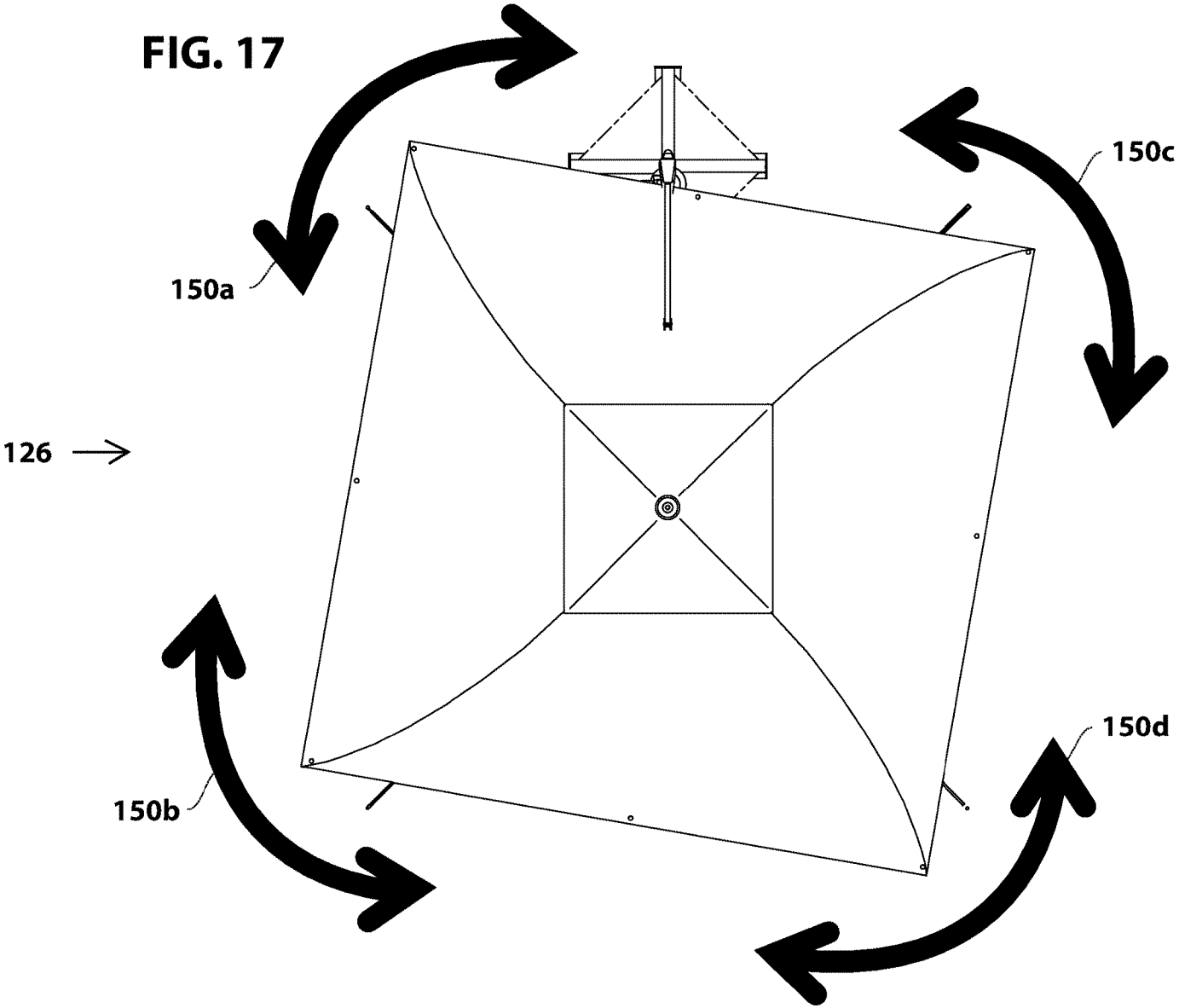
FIG. 17, FIG. 18A, FIG. 18B, FIG. 18C, FIG. 19A, FIG. 19B, and FIG. 19C illustrate top, side, and perspective views, respectively demonstrating how the wind-lift-eliminating self-adjusting funnel-and-canopy-tension-adjusting springs can automatically flex from side to side and up and down in the wind-lift-eliminating self-adjusting self-stabilizing reversible-canopy arthritic-aiding umbrella.
Figures 18A, 18B, 18C:
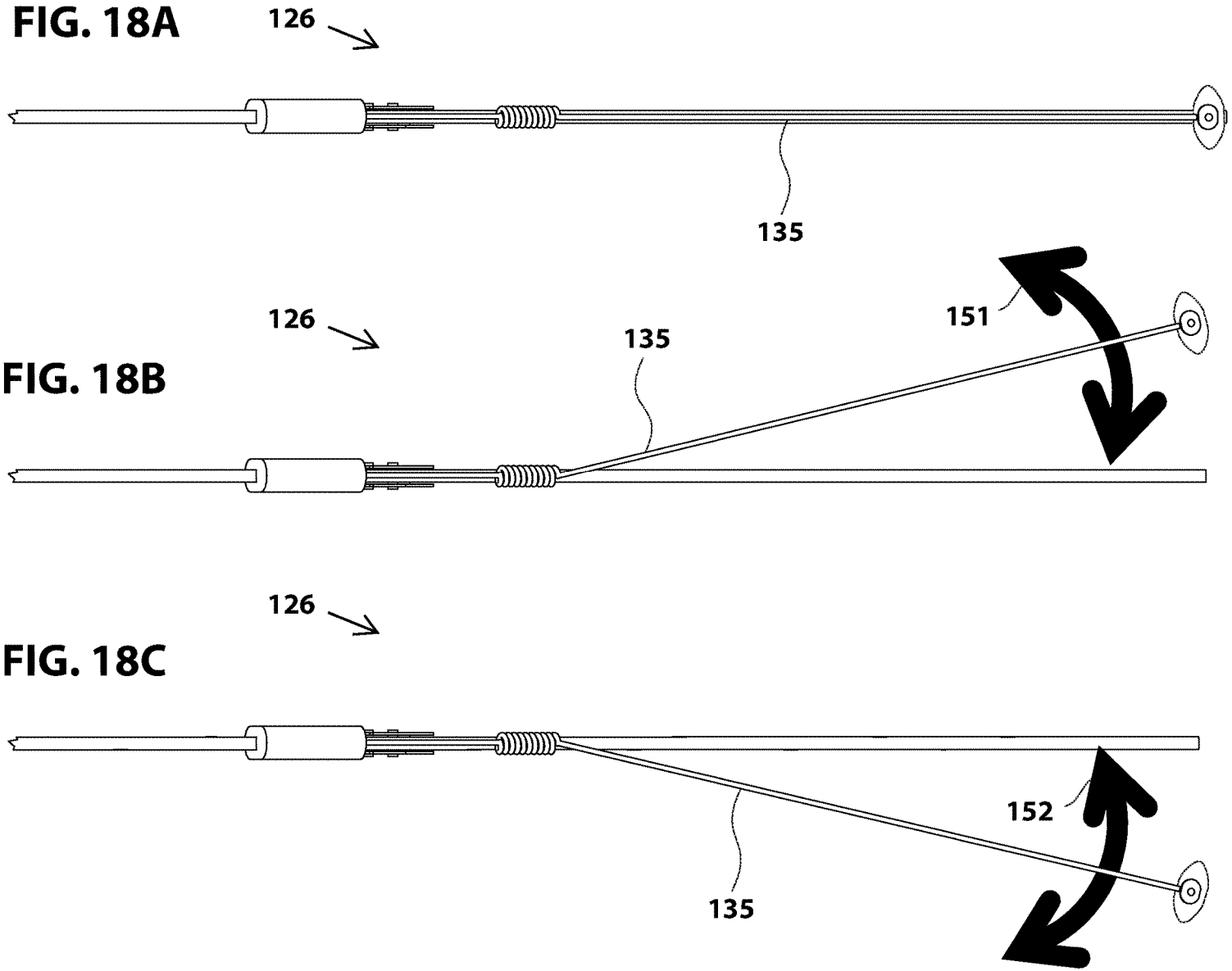
Figure 19A:
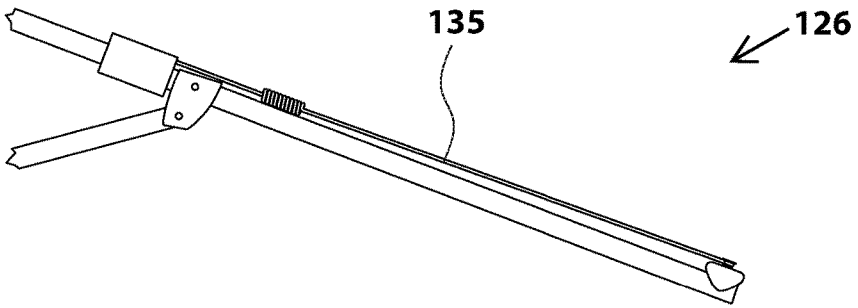
Figure 19B:
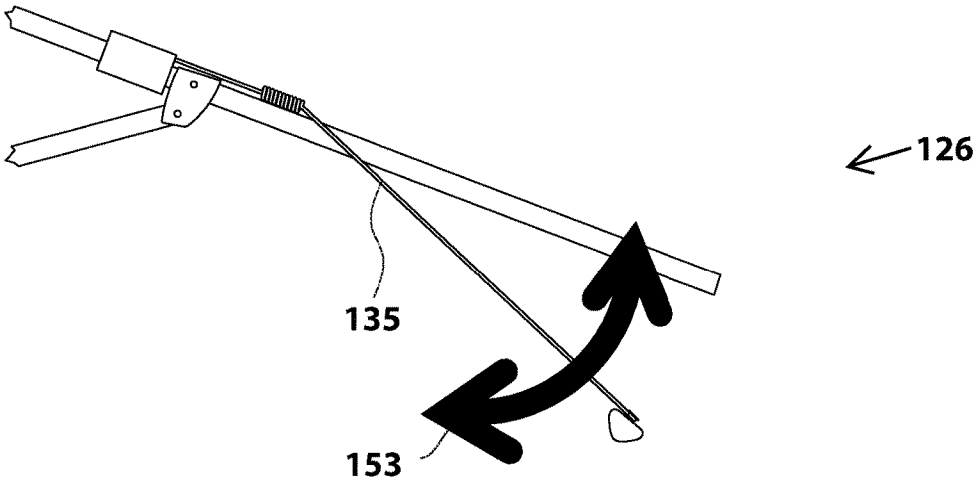
Figure 19C:
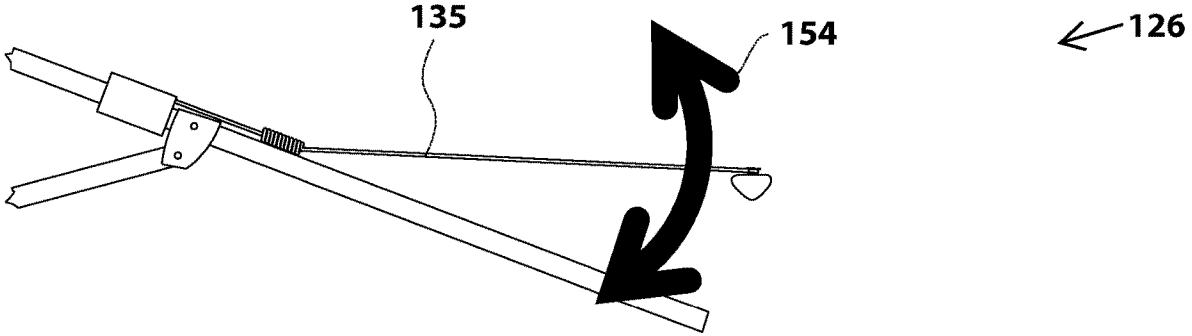

35) Wind-lift-eliminating self-adjusting funnel-and-canopy-tension-adjusting springs 135 are for:

a) Providing adjustability to customize amount of tension in the directions of arrows 150*a*, 150*b*, 150*c*, and 150*d* (see FIG. 17);

b) Releasing air pressure below the wind-lift-eliminating self-adjusting self-stabilizing reversible-canopy arthritic-aiding umbrella in the directions of arrows 150*a*, 150*b*, 150*c*, 150*d*, 157*a*, and 157*b* (see FIGS. 17 and 20C);

c) Stabilizing side-to-side movement from wind gusts, by relieving air pressure from below cooling-funnels 128 of the wind-lift-eliminating self-adjusting self-stabilizing reversible-canopy arthritic-aiding umbrella in the directions of arrows 150*a*, 150*b*, 150*c*, 150*d*, 151, 152, 153, and 154 (see FIG. 17, FIG. 18A FIG. 18B, FIG. 19A, FIG. 19B, and FIG. 19C);

d) Eliminating lift from wind gusts of by relieving air pressure from below cooling-funnels 128 of the wind-lift-eliminating self-adjusting self-stabilizing reversible-canopy arthritic-aiding umbrella in the directions of arrows 151, 152, 153, and 154 (see FIG. 18A FIG. 18B, FIG. 19A, FIG. 19B, and FIG. 19C);

e) Eliminating vibration from wind by relieving air pressure from below cooling-funnels 128 of the wind-lift-eliminating self-adjusting self-stabilizing reversible-canopy arthritic-aiding umbrella in the directions of arrows 148*a*, 148*b*, 151, 152, 153, and 154 (see FIG. 16A, 16B, 18A, FIG. 18B, FIG. 19A, FIG. 19B, and FIG. 19C); and f) Customizing volume of air pressure below the wind-lift-eliminating self-adjusting self-stabilizing reversible-canopy arthritic-aiding umbrella in the directions of arrows 149*a*, 149*b*, 156*a*, 156*b*, 156*c*, 156*d*, 156*e*, 156*f*, 156*g*, and 156*h* (see FIG. 16D, FIG. 16E, and FIG. 20B).

36) Wind-lift-eliminating-self-adjusting-funnel-and-canopy-tension-adjusting-spring eyelets 136*a* are for:

Respectably attaching wind-pressure-releasing cooling-funnel and adjustable-tension canopy springs 135 to canopy-spring mounting holes 129.

Adjustable-tension-canopy-spring-eyelet washer and screws 136*b* are for:

Respectively screwing into canopy-spring mounting holes 129.

Figure 16A:
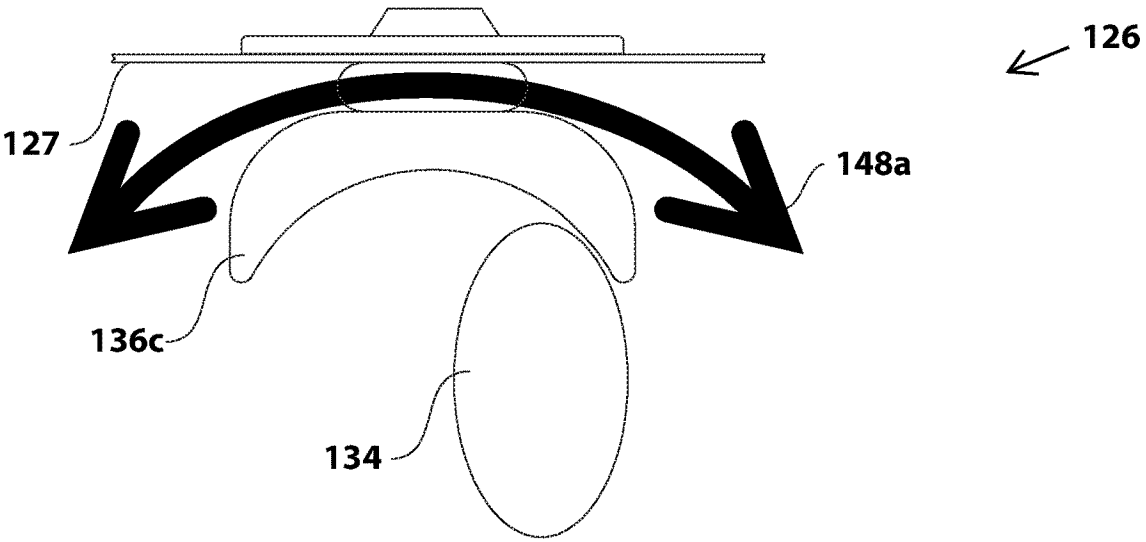
FIG. 16A and FIG. 16B present diagrams demonstrating how the wind-lift-eliminating self-adjusting funnel-and-canopy-tension-adjusting springs with automatic-canopy-spring-centering crescents will automatically center themselves against upper-ribs.
Figure 16B:
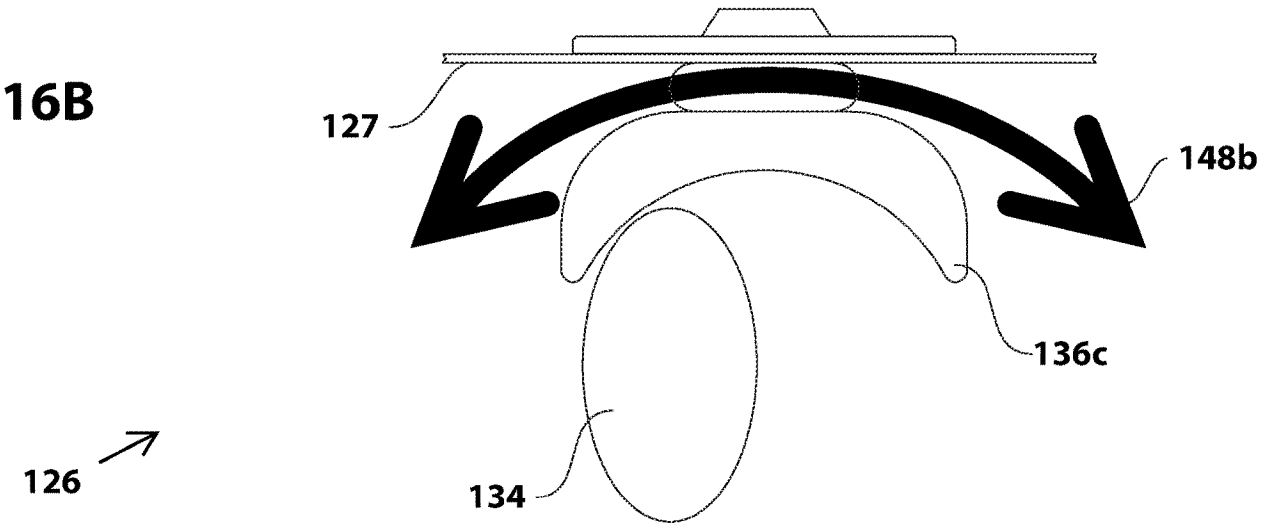
Figure 16C:
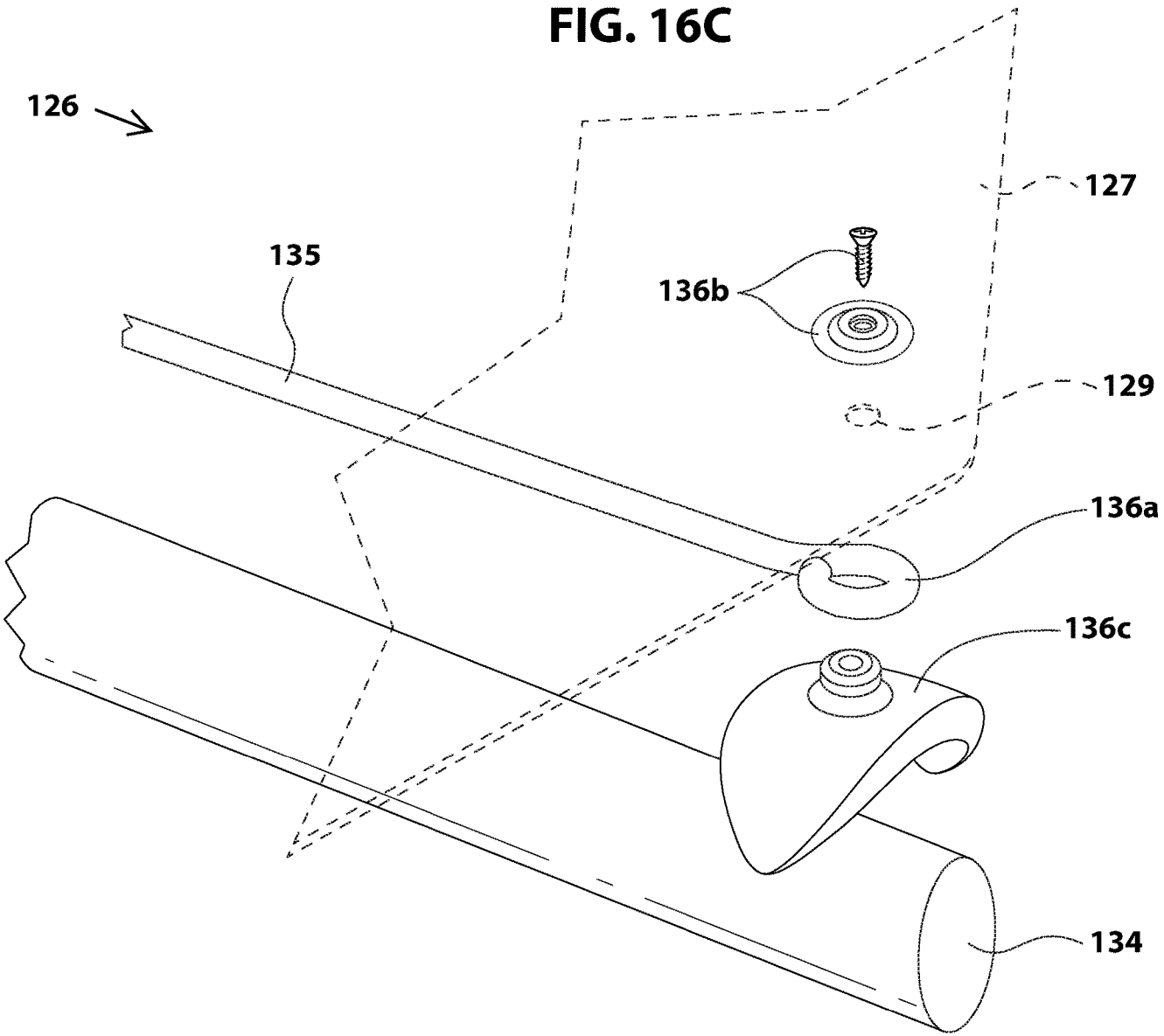
FIG. 16C illustrates a partial perspective exploded view demonstrating the automatic-centering and wind-pressure-releasing components of the wind-lift-eliminating self-adjusting self-stabilizing reversible-canopy arthritic-aiding umbrella.
Figure 16D:
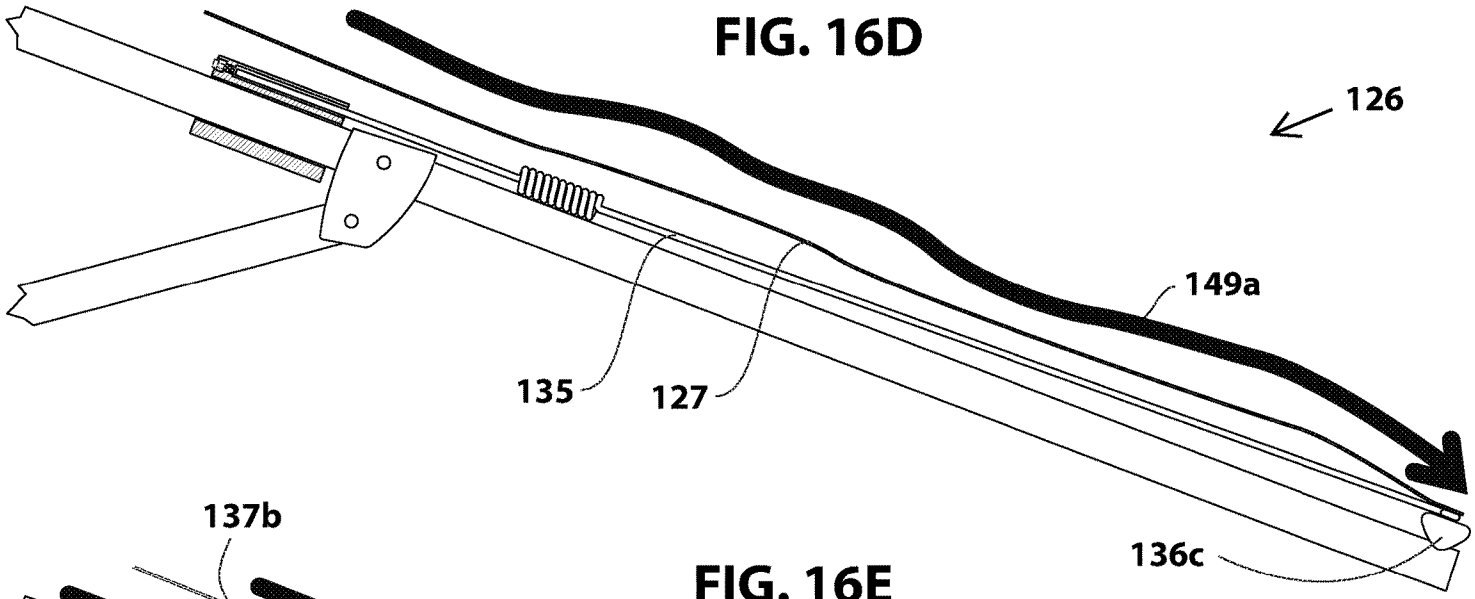
FIG. 16D and FIG. 16E present diagrams demonstrating how the reversible wind-pressure-releasing and cooling-funnel canopy is tensioned and loosened with wind-lift-eliminating self-adjusting funnel-and-canopy-tension-adjusting springs by turning adjustable-tension screws.
Figure 16E:
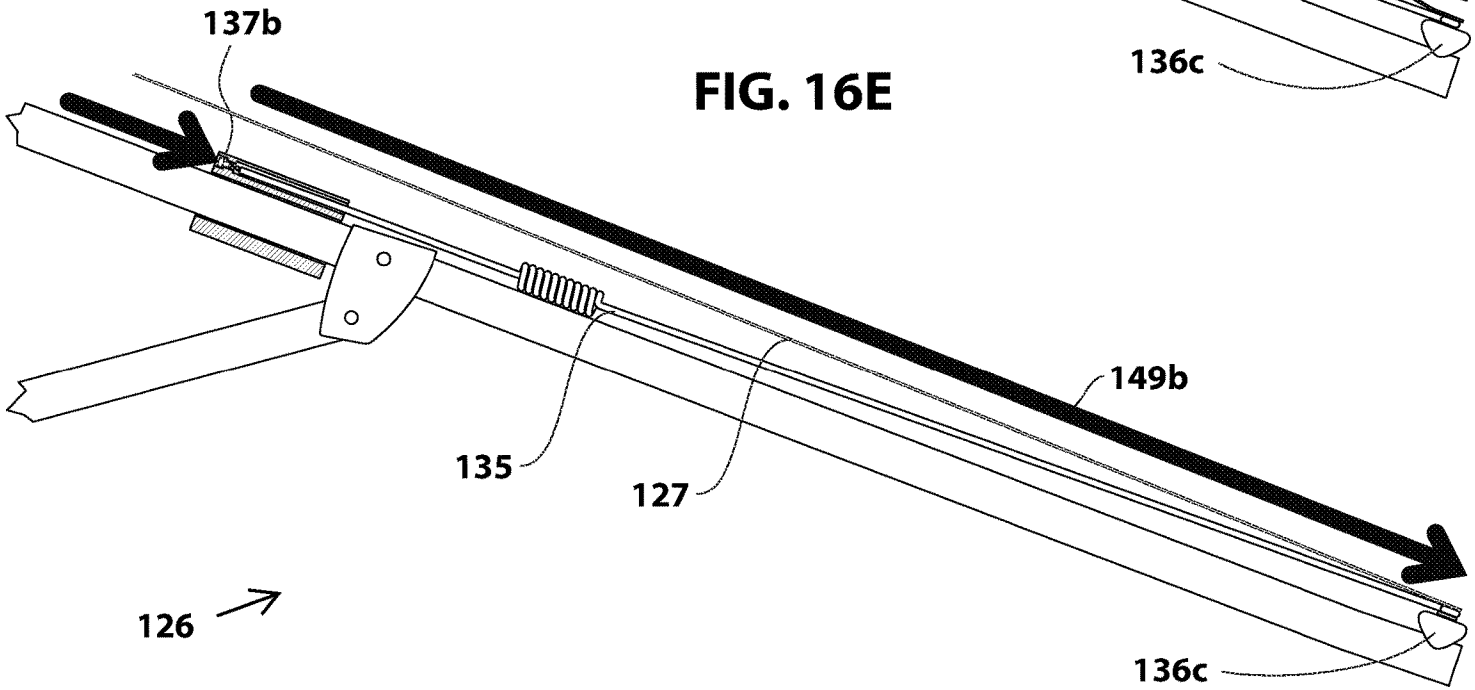

Automatic-canopy-spring-centering crescents 136*c* are for:

a) Independently and springably resting against upper-ribs 134 as wind-pressure-releasing cooling-funnel and adjustable-tension canopy springs 135 are intermittently flexed and moved by wind-gusts and air-pressure fluctuation b) Providing protection to painted or powder-coated surface of lower-ribs 138 in the directions of arrows 148*a* and 148*b* (see FIG. 16A and FIG. 16B);

c) Providing re-centering function for wind-pressure-releasing cooling-funnel and adjustable-tension canopy springs 135 in respect to the positioning of lower-ribs 138 in the directions of arrows 148*a* (see FIG. 16A);

d) Providing predetermined spacing for Wind-lift-eliminating self-adjusting funnel-and-canopy-tension-adjusting springs 135 to rest upon lower-ribs 138 in the directions of arrows 148*a* and 148*b* (see FIG. 16A and FIG. 16B);

e) Eliminating shock for Wind-lift-eliminating self-adjusting funnel-and-canopy-tension-adjusting springs 135 when impacting lower-ribs 138 in the directions of arrows 148*a*, 148*b*, 149*a*, 148*a*, and 149*b* (see FIG. 16A, FIG. 16B, and FIG. 16C);

f) Eliminating vibration from Wind-lift-eliminating self-adjusting funnel-and-canopy-tension-adjusting springs 135 in the directions of arrows 148*a* (see FIG. 16A); and g) Eliminating noise from Wind-lift-eliminating self-adjusting funnel-and-canopy-tension-adjusting springs 135 from impact against lower-ribs 138 in the directions of arrows 148*a*, 148*b*, 149*a*, 148*a*, and 149*b* (see FIG. 16A, FIG. 16B, and FIG. 16C).

37) Adjustable-tension-canopy-spring brackets 137*a* are for:

Springably, adjustably, and respectively securing Wind-lift-eliminating self-adjusting funnel-and-canopy-tension-adjusting springs 135 to upper-ribs 134.

Adjustable-tension screws 137*b* are for:

Respectively and adjustably screwing into adjustable-tension-canopy-spring brackets 137.

38) Lower-ribs 138 are for:

Respectively and pivotably attaching to upper-ribs 134 and canopy top-hub-ring 132.

39) Multi-base-connecting canopy base system 139 is for performing the combined functions of its components.

40) Canopy-stanchion base-mounting plate 140 is for:

Attaching canopy-height-adjusting stanchion 111 to canopy-base-stabilizing feet 141*a*.

41) Canopy-base-stabilizing feet 141*a* are for:

Respectively attaching to canopy-stanchion base-mounting plate 140 to stabilizing the wind-lift-eliminating self-adjusting self-stabilizing reversible-canopy arthritic-aiding umbrella.

Figure 23A:
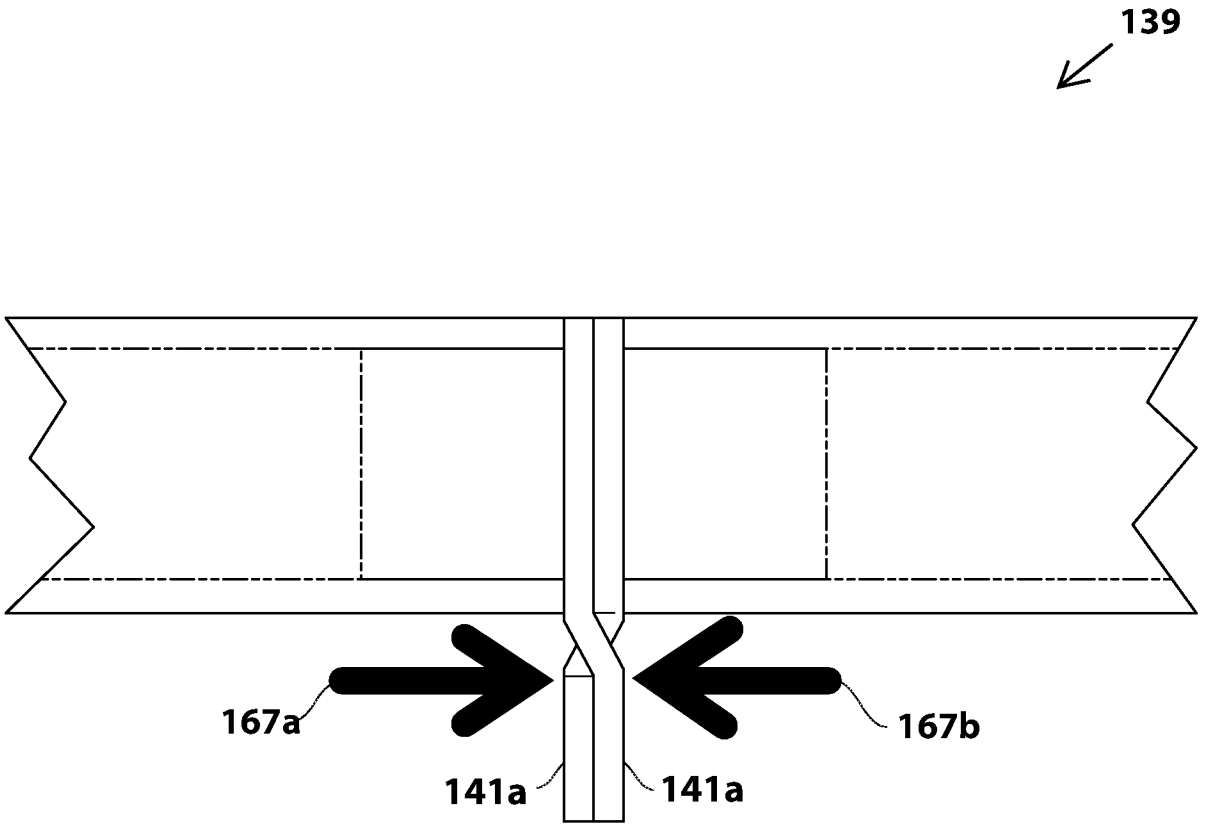
FIG. 23A, FIG. 23B, and FIG. 23C present diagrams demonstrating how the multi-base-connecting canopy base system couples multiple multi-base-connecting canopy base systems together by multi-base-connecting canopy-base plates, canopy-base-stabilizing feet, multi-base-connecting locking slots and multi-base-connecting heel-blades.
Figure 23B:
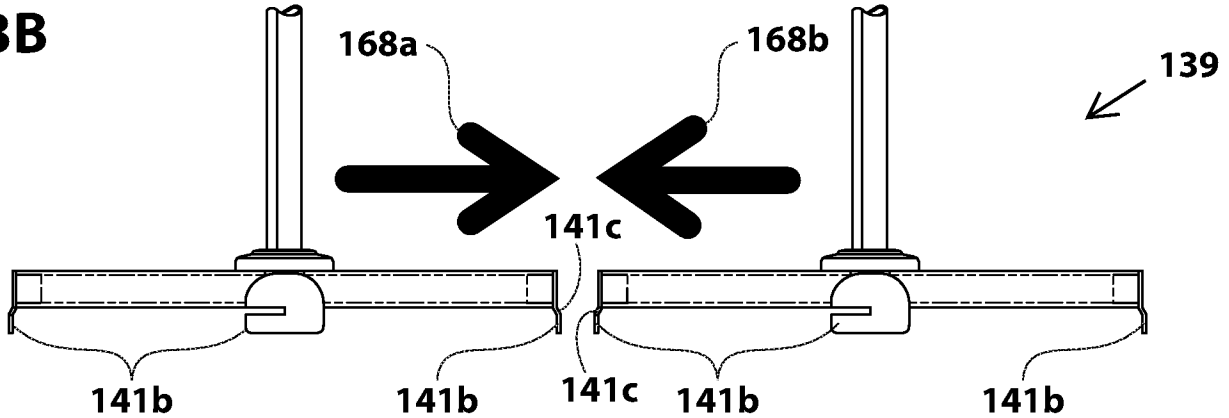
Figure 23C:
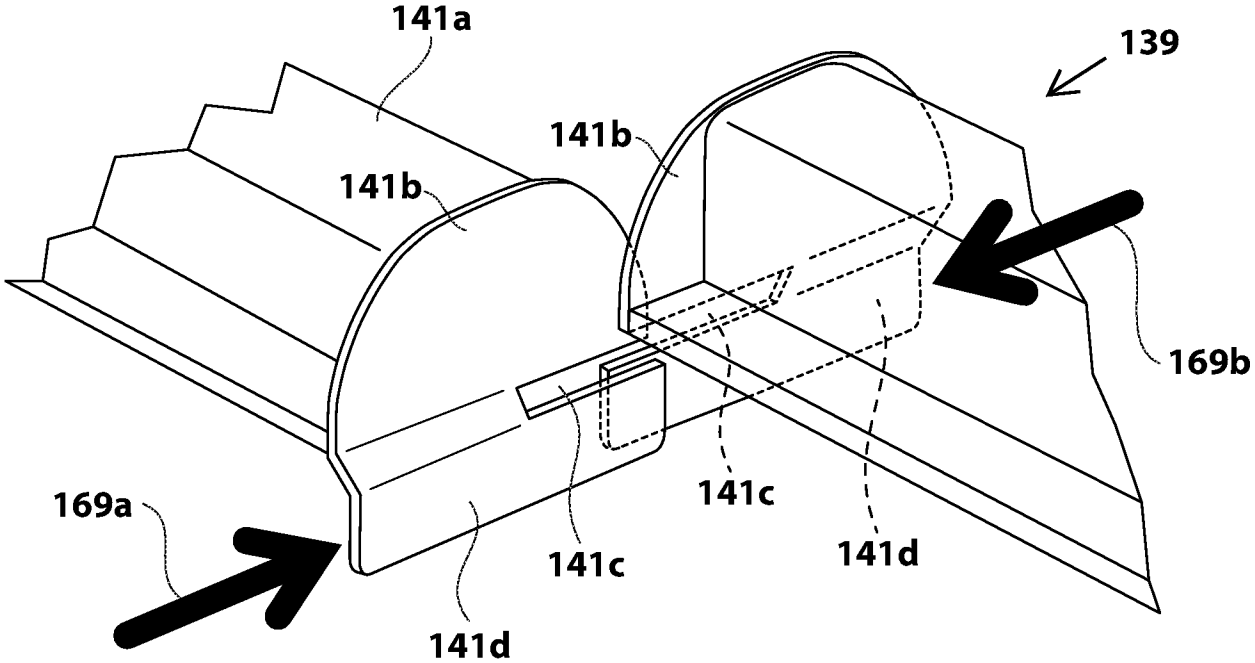
Figure 24A:
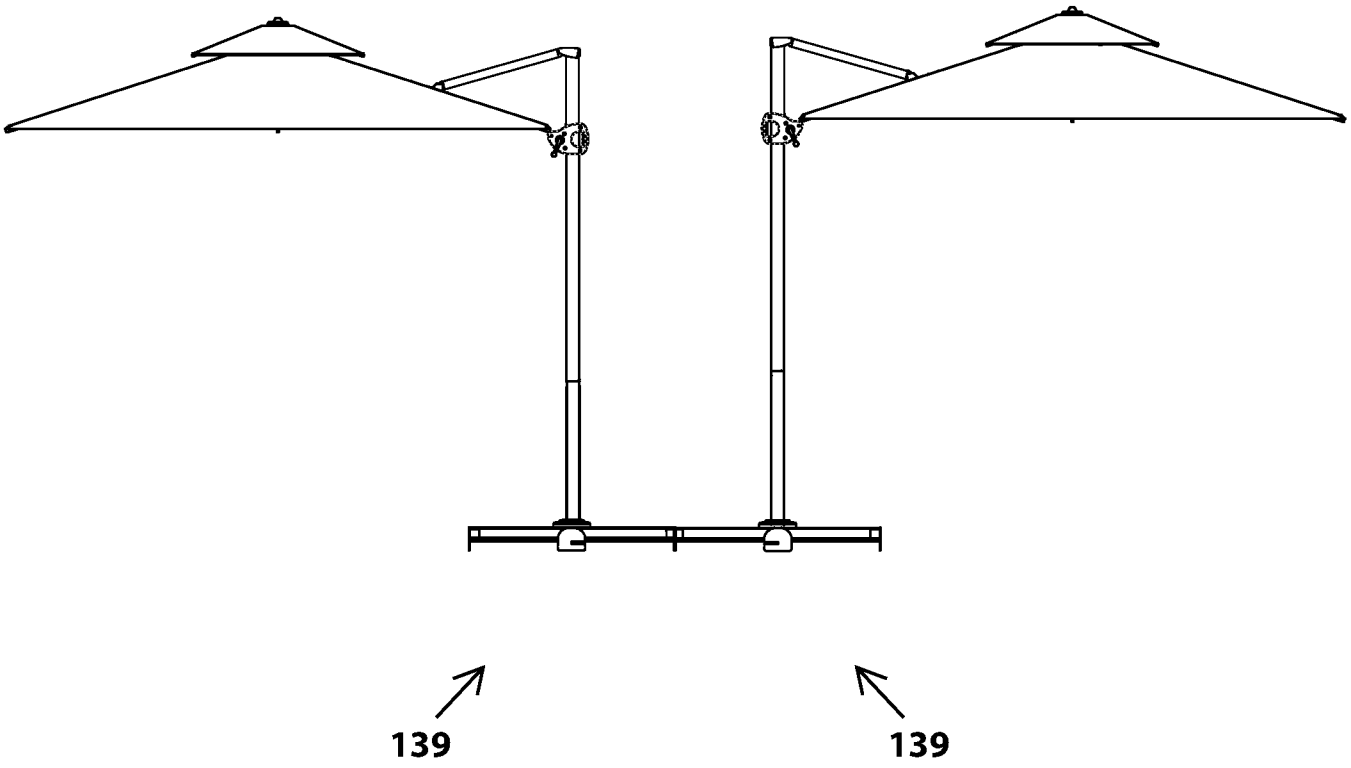
FIG. 24A, FIG. 24B, FIG. 24C, and FIG. 24D illustrates respective side and top views demonstrating how the multi-base-connecting canopy base system couples multiple multi-base-connecting canopy base systems together and sample configurations that can be achieved.
Figure 24B:
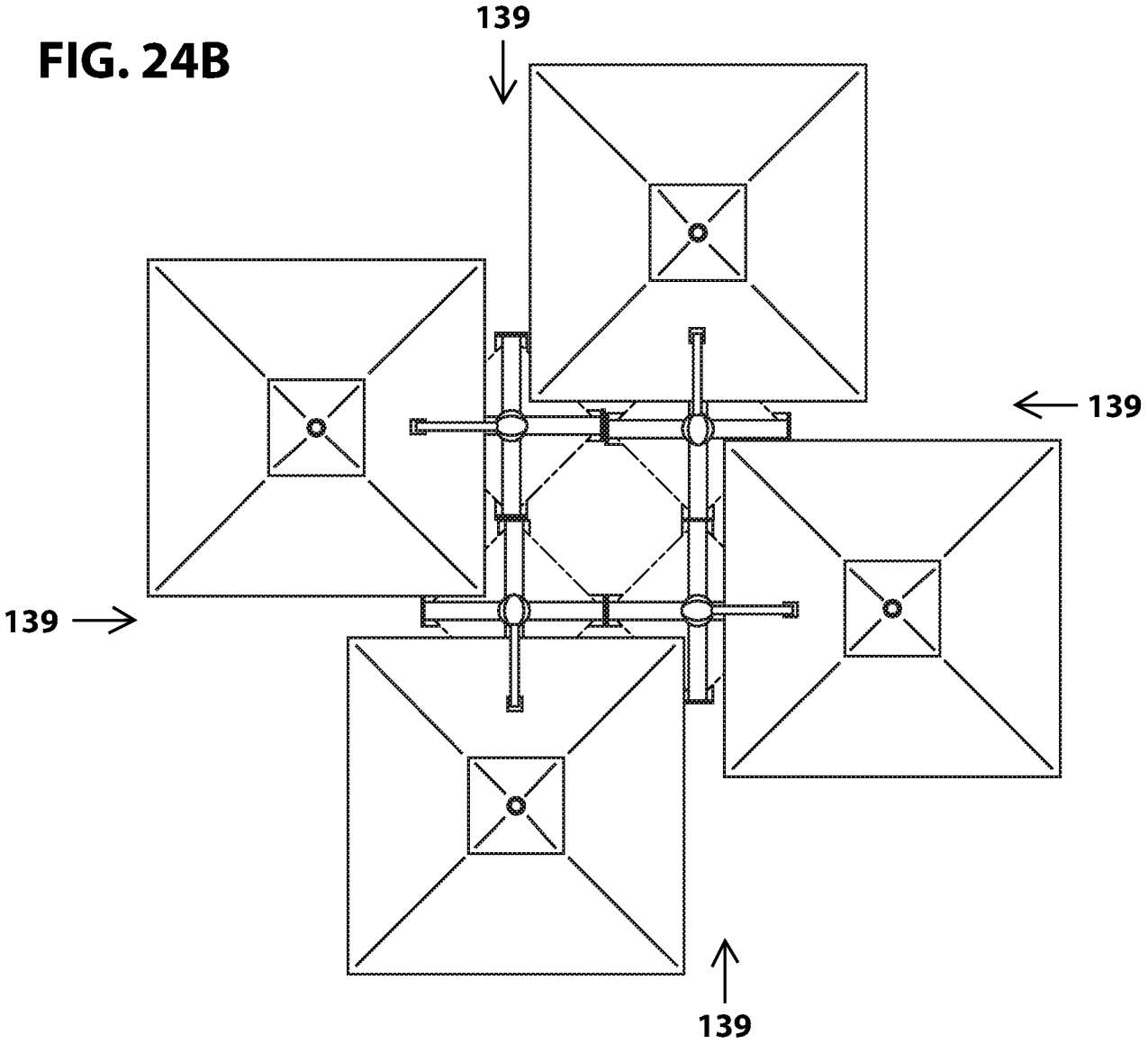
Figure 24C:
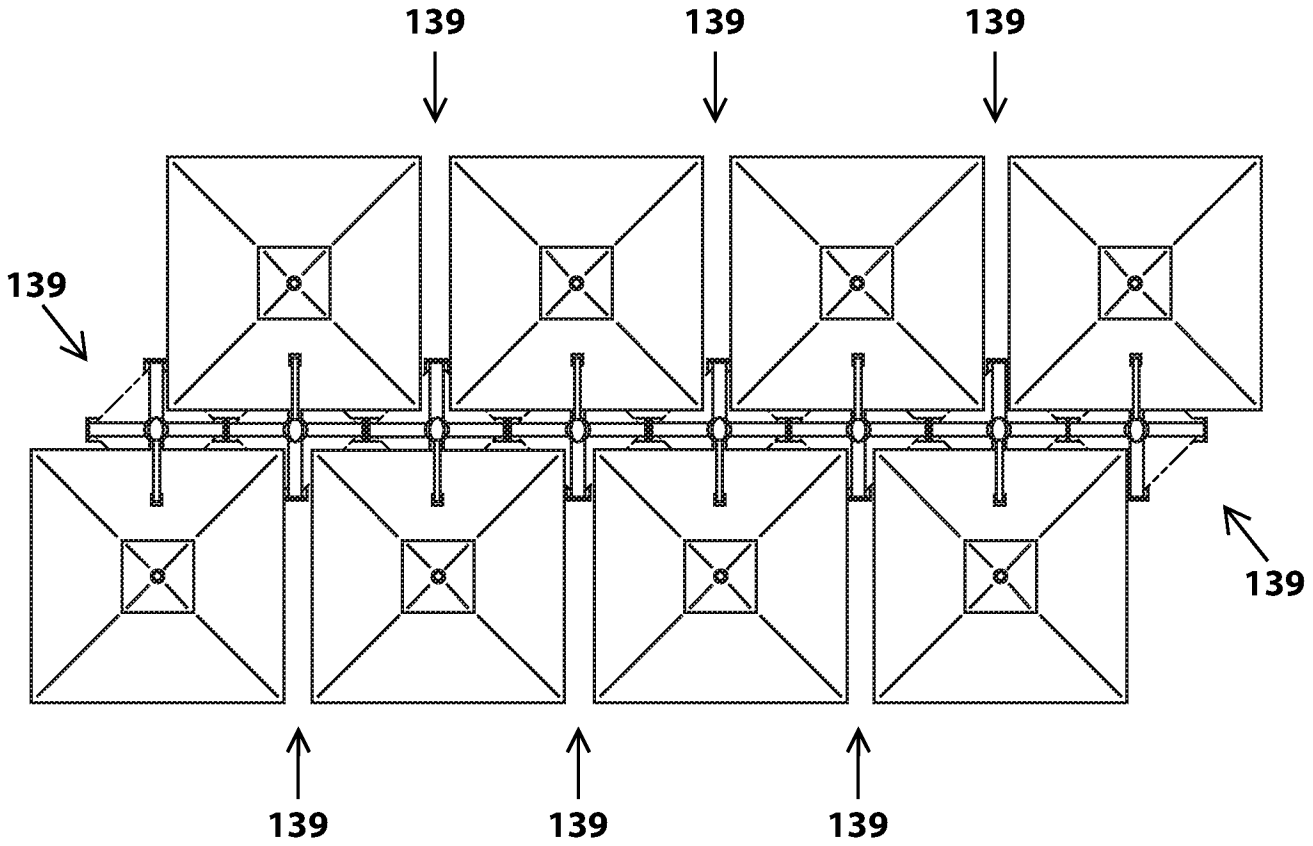
Figure 24D:
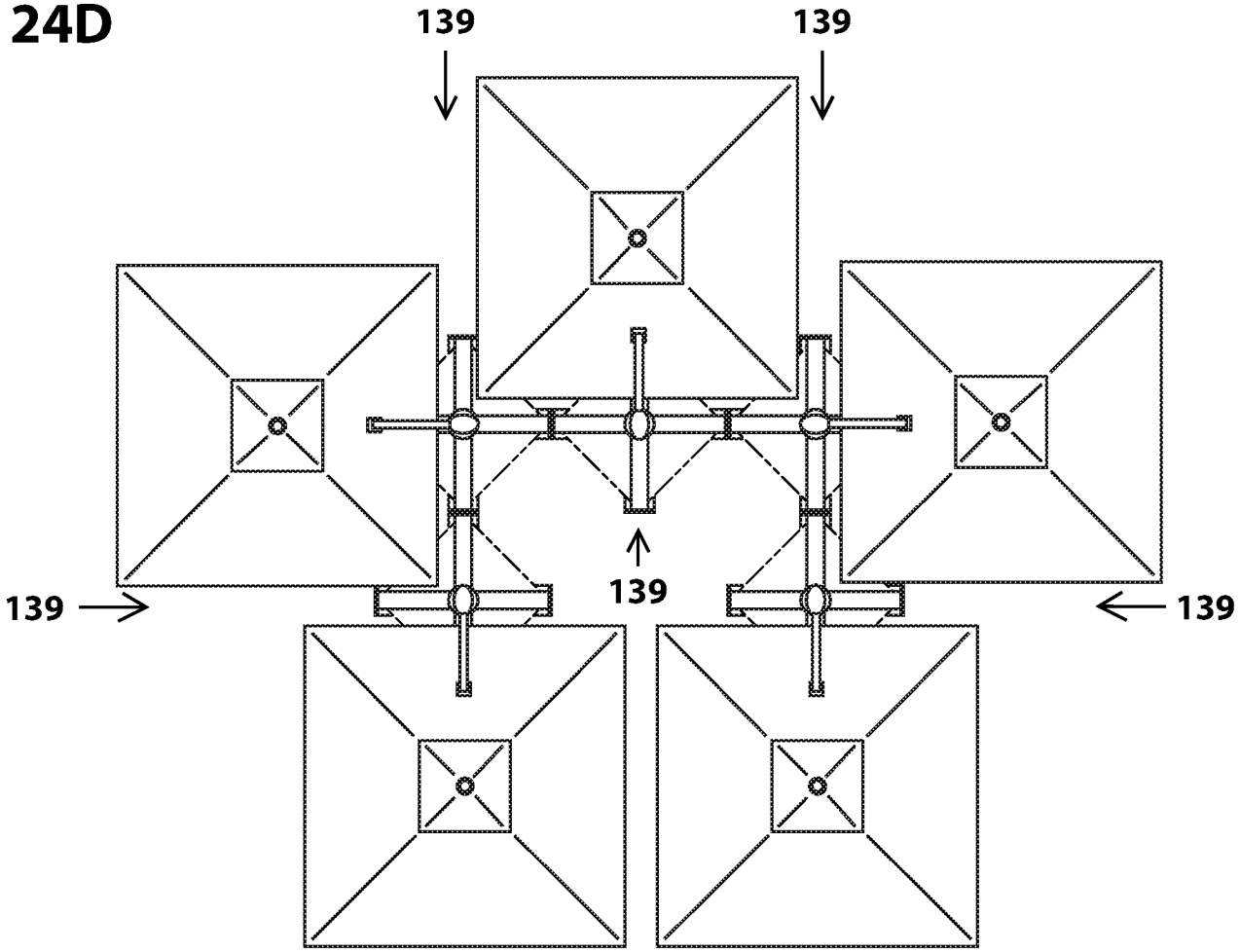

Multi-base-connecting canopy-base plates 141*b* are for:

a) Slidably hooking on multiple multi-base-connecting canopy-base plates 141*b* of other wind-lift-eliminating self-adjusting self-stabilizing reversible-canopy arthritic-aiding umbrellas to secure multiple wind-lift-eliminating self-adjusting self-stabilizing reversible-canopy arthritic-aiding umbrellas together in the directions of arrows 167*a*, 167*b*, 168*a*, 168*a*, 169*a*, and 169*b* (see FIG. 23A, FIG. 23B, and FIG. 23C);

b) Slidably hooking on multiple multi-base-connecting canopy-base plates 141*b* of other wind-lift-eliminating self-adjusting self-stabilizing reversible-canopy arthritic-aiding umbrellas to increase the footprint of, thereby providing greater stability from the effects of winds and rain (see FIG. 24A);

c) Slidably hooking on multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas for saving space when configured on decks, patios, pool-sides, balconies, verandas, sidewalks, food courts, and in restaurants (see FIG. 24A, FIG. 24B, FIG. 24C, and FIG. 24D); and d) Slidably hooking on multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas to provide many variable aesthetic and design configurations to table and lounge chair configurations on decks, patios, pool-sides, balconies, verandas, sidewalks, food courts, and in restaurants (see FIG. 24A, FIG. 24B, FIG. 24C, and FIG. 24D).

Multi-base-connecting locking slots 141*c* are for:

a) Slidably connecting multiple multi-base-connecting canopy-base plates 141*b* of other wind-lift-eliminating self-adjusting self-stabilizing reversible-canopy arthritic-aiding umbrellas to secure multiple wind-lift-eliminating self-adjusting self-stabilizing reversible-canopy arthritic-aiding umbrellas together in the directions of arrows 167*a*, 167*b*, 168*a*, 168*a*, 169*a*, and 169*b*

(see FIG. 23A, FIG. 23B, and FIG. 23C);

b) Slidably connecting multiple multi-base-connecting canopy-base plates 141*b* of other wind-lift-eliminating self-adjusting self-stabilizing reversible-canopy arthritic-aiding umbrellas to increase the footprint thereof, thereby providing greater stability from the effects of winds and rain (see FIG. 24A);

c) Slidably connecting multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas for saving space when configured on decks, patios, pool-sides, balconies, verandas, sidewalks, food courts, and in restaurants (see FIG. 24A, FIG. 24B, FIG. 24C, and FIG. 24D); and d) Slidably connecting multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas to provide many variable aesthetic and design configurations to table and lounge chair configurations on decks, patios, pool-sides, balconies, verandas, sidewalks, food courts, and in restaurants (see FIG. 24A, FIG. 24B, FIG. 24C, and FIG. 24D).

Multi-base-connecting heel-blades 141*d* are for:

respectively lifting canopy-base-stabilizing feet 141*a* above the ground.

Variation

Figure 27:
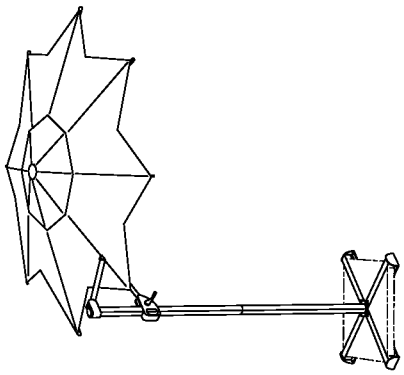
FIG. 25, FIG. 26, and FIG. 27 illustrate perspective views of equivalent variations of the wind-lift-eliminating self-adjusting self-stabilizing reversible-canopy arthritic-aiding umbrella, having a rectangular, an octagonal, and a star-shaped wind-lift-eliminating self-adjusting self-stabilizing reversible-canopy arthritic-aiding umbrella, respectively.
Figure 26:
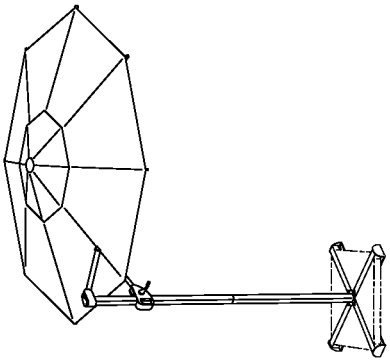
Figure 25:
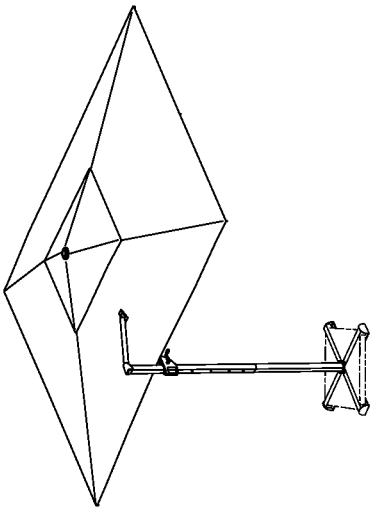
Figure 29:
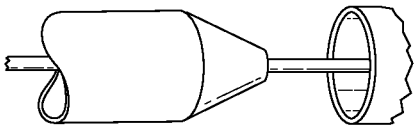
FIG. 29 illustrates a perspective view of an equivalent variation of the self-centering spiral-cone-locking cable-tube system.
Figure 28:
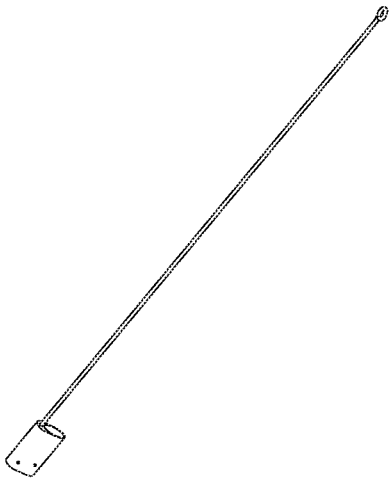
FIG. 28 illustrates a perspective view of an equivalent variation of the wind-lift-eliminating self-adjusting funnel-and-canopy-tension-adjusting springs, having a generally straight shaft.

Referring to FIG. 25, FIG. 26, FIG. 27, FIG. 28, and FIG. 29:

Any component of the wind-lift-eliminating self-adjusting self-stabilizing reversible-canopy arthritic-aiding umbrella can have any shape and size. Any component of the wind-lift-eliminating self-adjusting self-stabilizing reversible-canopy arthritic-aiding umbrella can be made of any material(s). Reversible wind-pressure-releasing and cooling-funnel canopy 127 can be attached with screws or any other type of canopy-attaching device. FIG. 25 illustrates a perspective view of an equivalent umbrella having a rectangle customizable-flow-directing chapeau 103*a* and a rectangle reversible wind-pressure-releasing and cooling-funnel canopy 127. FIG. 26 illustrates a perspective view of an equivalent umbrella having an octagonal customizable-flow-directing chapeau 103*a* and an octagonal reversible wind-pressure-releasing and cooling-funnel canopy 127. FIG. 27 illustrates a perspective view of an equivalent umbrella having an octagonal customizable-flow-directing chapeau 103*a* and a star-shaped reversible wind-pressure-releasing and cooling-funnel canopy 127. FIG. 28 illustrates a perspective view of an equivalent variation of the reversible-wind-pressure-releasing-cooling-funnel-and-adjustable-tension-canopy spring 135. FIG. 29 illustrates a perspective view of an equivalent upper self-centering inverted spiral-locking cone 108, lower self-centering spiral-locking cone 109, and cable conduit 107.

Major Advantages of the Invention

The present invention substantially departs from the conventional concepts and designs of the prior art. In doing so, the present invention provides wind-lift-eliminating self-adjusting self-stabilizing reversible-canopy arthritic-aiding umbrella (having: a) Customizable-wind-flow-directing chapeau system, b) Self-centering spiral-cone-locking cable-tube system, c) Arthritic-aiding and canopy-deploying system, d) Wind-pressure-releasing and cooling-funnel canopy system, and f) Canopy base system), having many new and significant features, functions, and advantages, which overcome all the disadvantages of the prior art, as follows:

1) It is an object of the new invention to provide a wind-lift-eliminating self-adjusting self-stabilizing reversible-canopy arthritic-aiding umbrella, having customizable-flow-directing chapeau 103*a*.

Therefore, the wind-lift-eliminating self-adjusting self-stabilizing reversible-canopy arthritic-aiding umbrella:

a) Can provide a cover to protect users from weather elements and reduce air pressure, thereby stabilizing the wind-lift-eliminating self-adjusting self-stabilizing reversible-canopy arthritic-aiding umbrella;

b) Can redirect wind-flow above customizable-flow-directing chapeau 103*a* to the inside of the wind-lift-eliminating self-adjusting self-stabilizing reversible-canopy arthritic-aiding umbrella;

in the directions of arrows 142*a*, 142*b*, 143*a*, 143*b*, 144*a*, 144*b*, 145*a*, 145*b*, 145*c*, and 145*d*

(see FIG. 13A, FIG. 13B, FIG. 13C, FIG. 13D, FIG. 13E, and FIG. 13F).

c) Can redirect hot air to flow out and away from underside of the wind-lift-eliminating self-adjusting self-stabilizing reversible-canopy arthritic-aiding umbrella, thereby cooling the environment for the occupants;

in the directions of arrows 142*a*, 142*b*, 143*a*, 143*b*, 144*a*, 144*b*, 145*c*, and 145*d*

(see FIG. 13A, FIG. 13B, FIG. 13E, and FIG. 13F);

d) Can customize wind-flow direction and pattern from above customizable-flow-directing chapeau 103*a* to the inside of the wind-lift-eliminating self-adjusting self-stabilizing reversible-canopy arthritic-aiding umbrella
in the directions of arrows 142*a*, 142*b*, 144*a*, 144*b*, 145*c*, and 145*d*
(see FIG. 13A, FIG. 13C, FIG. 13E, and FIG. 13F);

e) Can release air pressure below the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*a*, 145*b*, 145*c*, and 145*d*
(see FIG. 13C, FIG. 13B, FIG. 13C, FIG. 13D, and FIG. 13F); and f) Can customize volume of air pressure below the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*a*, 145*b*, 145*c*, and 145*d*
(see FIG. 13C, FIG. 13B, FIG. 13C, FIG. 13D, and FIG. 13F).

2) It is another object of the new invention to provide a wind-lift-eliminating self-adjusting self-stabilizing reversible-canopy arthritic-aiding umbrella, having customizable-flow-directing chapeau control levers 104.

Figure 13A:
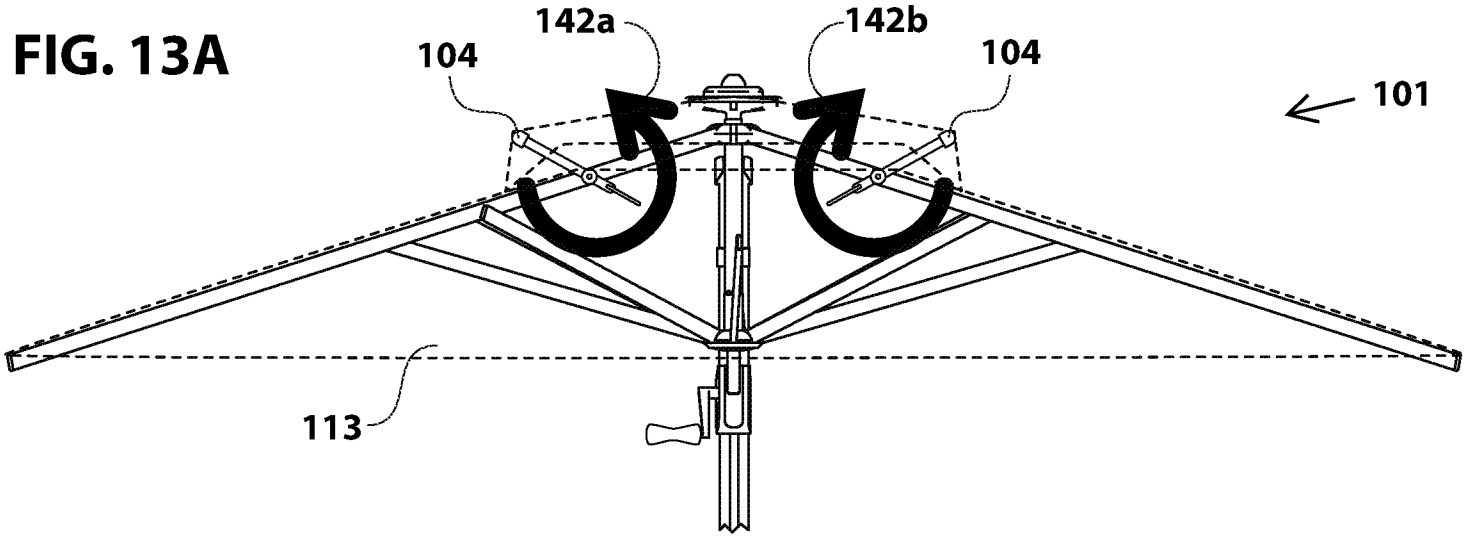
FIG. 13A, FIG. 13B, FIG. 13C, FIG. 13D, FIG. 13E, and FIG. 13F illustrate side views of the customizable-wind-flow-directing chapeau system, customizable-flow-directing chapeau, customizable-flow-directing chapeau control levers, and arthritic-aiding control tabs, respectively, demonstrating the variable rotational settings of customizable-flow-directing chapeau control levers, thereby providing custom opening characteristics of customizable-flow-directing chapeau, to control desired downward airflow cooling, upward heat ventilation, and wind pressure-release.
Figure 13B:
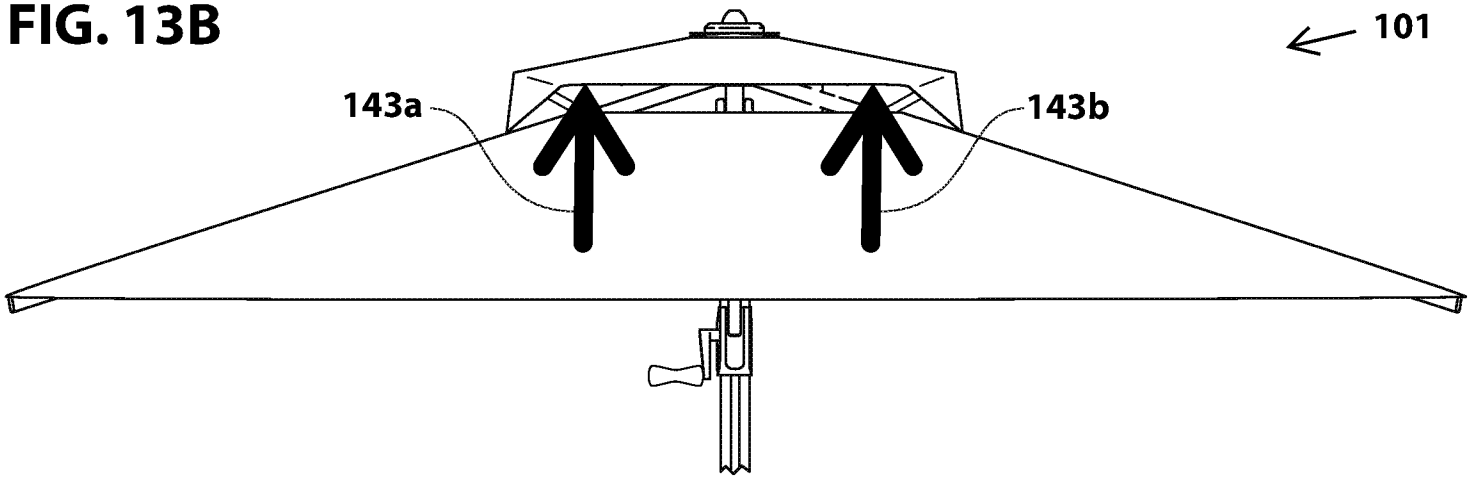
Figure 13C:
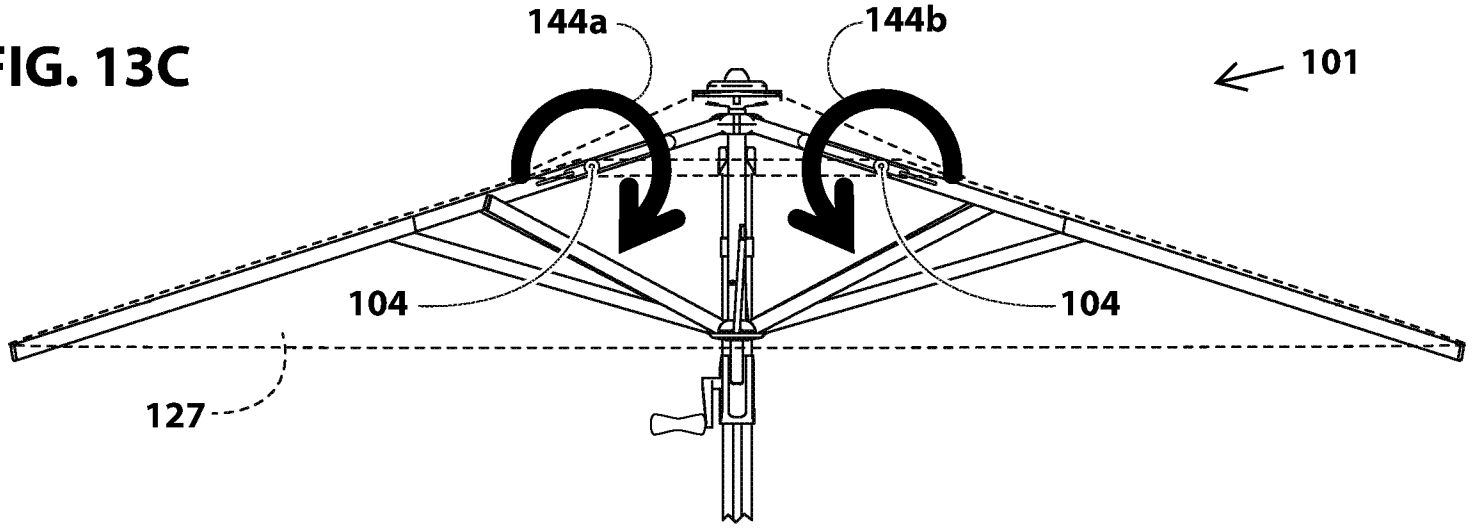
Figure 13D:
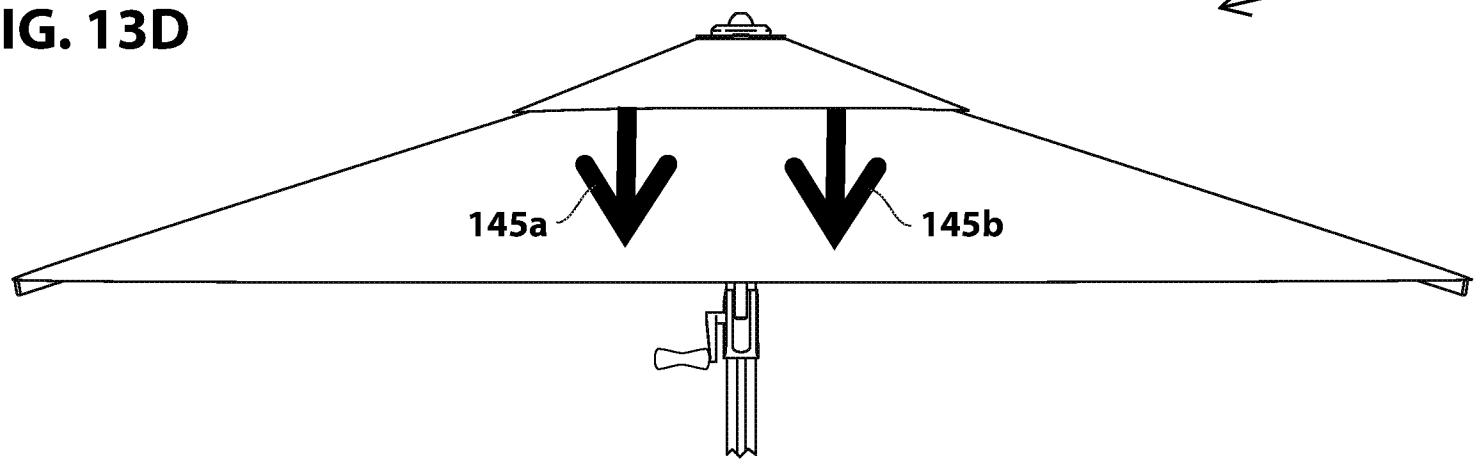
Figure 13E:
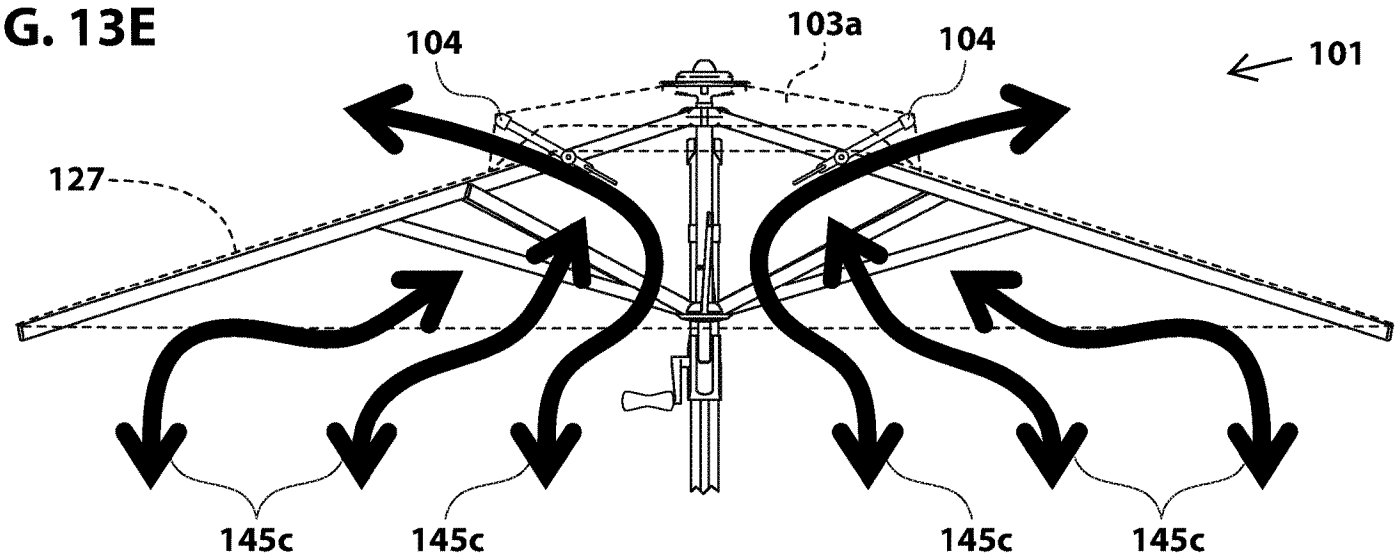
Figure 13F:
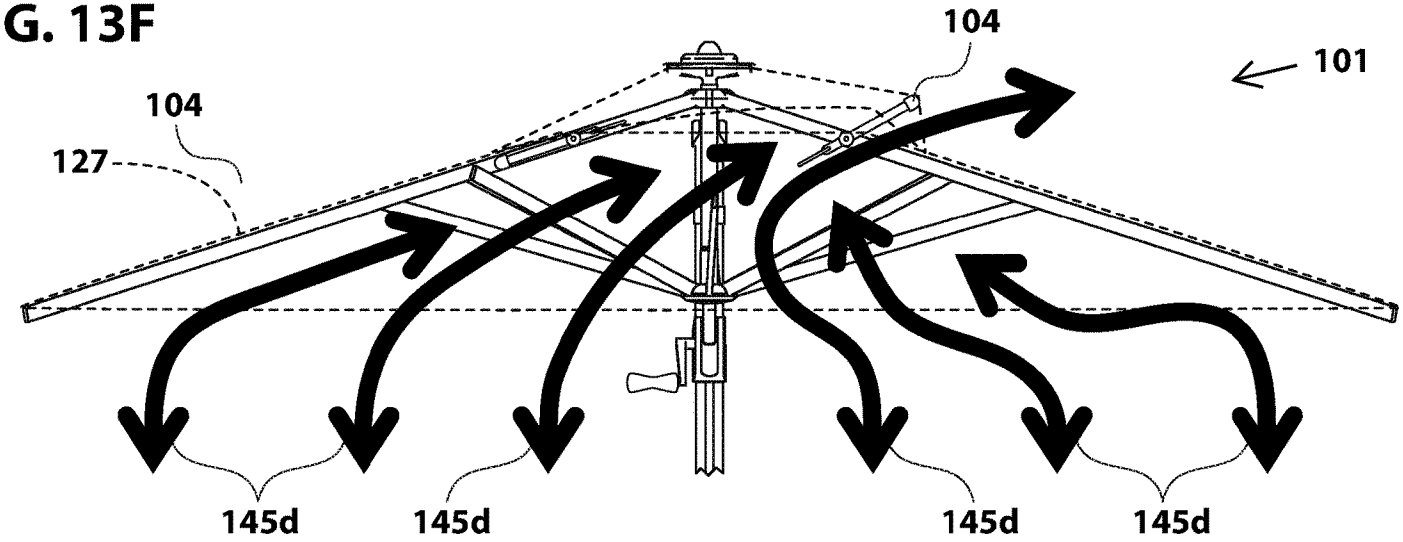

Therefore, the wind-lift-eliminating self-adjusting self-stabilizing reversible-canopy arthritic-aiding umbrella:

a) Can control air pressure and the effects of wind-flow under the wind-lift-eliminating self-adjusting self-stabilizing reversible-canopy arthritic-aiding umbrella thereby stabilizing the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*a*, 145*b*, 145*c*, and 145*d*
(see FIG. 13A, FIG. 13B, FIG. 13C, FIG. 13D, FIG. 13E, and FIG. 13F);

b) Can control to redirect wind-flow above wind-pressure-releasing and cooling-funnel canopy 127 to the inside of the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*c*, and 145*d*
(see FIG. 13A, FIG. 13B, FIG. 13E, and FIG. 13F);

c) Can control to redirect hot air to flow out and away from underside of the wind-lift-eliminating self-adjusting self-stabilizing reversible-canopy arthritic-aiding umbrella, thereby cooling the environment for the occupants
in the directions of arrows 142*a*, 142*b*, 144*a*, 144*b*, 145*c*, and 145*d*
(see FIG. 13A, FIG. 13C, FIG. 13E, and FIG. 13F);

d) Can control to customize wind-flow direction and pattern from above wind-pressure-releasing and cooling-funnel canopy 127 to the inside of the wind-lift-eliminating self-adjusting self-stabilizing reversible-canopy arthritic-aiding umbrella
in the directions of arrows 142*a*, 142*b*, 143*a*, 143*b*, 144*a*, 144*b*, 145*a*, 145*b*, 145*c*, and 145*d*
(see FIG. 13C, FIG. 13B, FIG. 13C, FIG. 13D, and FIG. 13F);

e) Can control to release the air pressure below the wind-lift-eliminating self-adjusting self-stabilizing reversible-canopy arthritic-aiding umbrella
in the directions of arrows 143*a*, and 143*b*
(see FIG. 13B); and f) Can control to customize the volume of air pressure below the wind-lift-eliminating self-adjusting self-stabilizing reversible-canopy arthritic-aiding umbrella
in the directions of arrows 145*c* and 145*d*
(see FIG. 13D and FIG. 13F).

3) It is another object of the new invention to provide a wind-lift-eliminating self-adjusting self-stabilizing reversible-canopy arthritic-aiding umbrella, having arthritic-aiding control tabs 105.

Therefore, the wind-lift-eliminating self-adjusting self-stabilizing reversible-canopy arthritic-aiding umbrella:

Can medicinally beneficially aid a person with an arthritic hand to keep his/her hand straight to eliminate the need for bending his/her fingers and wrist when holding and operating customizable-flow-directing chapeau control levers 104
to require less effort to deploy canopy for those with limited hand mobility due to arthritis.

4) It is a further object of the new invention to provide a wind-lift-eliminating self-adjusting self-stabilizing reversible-canopy arthritic-aiding umbrella, having upper self-centering inverted spiral-locking cone 108.

Therefore, the wind-lift-eliminating self-adjusting self-stabilizing reversible-canopy arthritic-aiding umbrella:

a) Can center upper self-centering inverted spiral-locking cone 108 with lower self-centering spiral-locking cone 109 during deployment of the wind-lift-eliminating self-adjusting self-stabilizing reversible-canopy arthritic-aiding umbrella;

b) Can prevent the wind-lift-eliminating self-adjusting self-stabilizing reversible-canopy arthritic-aiding umbrella from radially twisting clockwise out of its desired shape;

c) Can prevent the wind-lift-eliminating self-adjusting self-stabilizing reversible-canopy arthritic-aiding umbrella from radially twisting counterclockwise out of its desired shape; and d) Can twist-lock upper self-centering inverted spiral-locking cone 108 with lower self-centering spiral-locking cone, thereby preventing easy dislodging of their union and connection.

5) It is an even further object of the new invention to provide a wind-lift-eliminating self-adjusting self-stabilizing reversible-canopy arthritic-aiding umbrella, having lower self-centering spiral-locking cone 109.

Therefore, the wind-lift-eliminating self-adjusting self-stabilizing reversible-canopy arthritic-aiding umbrella:

a) Can center lower self-centering spiral-locking cone 109 with upper self-centering inverted spiral-locking cone 108 during deployment of the wind-lift-eliminating self-adjusting self-stabilizing reversible-canopy arthritic-aiding umbrella
in the direction of arrow 146
(see FIG. 5, and FIG. 14);

b) Can prevent the wind-lift-eliminating self-adjusting self-stabilizing reversible-canopy arthritic-aiding umbrella from radially twisting clockwise out of its desired fit while fully deployed
in the direction of arrow 146
(see FIG. 14);

c) Can prevent the wind-lift-eliminating self-adjusting self-stabilizing reversible-canopy arthritic-aiding umbrella from radially twisting counterclockwise out of desired fit while fully deployed; and
in the direction of arrow 146
(see FIG. 11, and FIG. 14); and d) Can twist-lock lower self-centering spiral-locking cone 109 with upper self-centering inverted spiral-locking cone 108, thereby preventing easy dislodging of their union and connection
in the direction of arrow 146
(see FIG. 14).

6) It is another object of the new invention to provide a wind-lift-eliminating self-adjusting self-stabilizing reversible-canopy arthritic-aiding umbrella, having canopy height-adjusting arthritic-aiding trigger 116.
Therefore, the wind-lift-eliminating self-adjusting self-stabilizing reversible-canopy arthritic-aiding umbrella:
a) Can aid those with arthritic conditions in their hands to operate canopy-height-and-tilt-adjusting arthritic-aiding handle 115 without discomfort
(see FIGS. 6A and 6B);
b) Can provide means to engage arthritic-aiding and canopy-deploying system 110 to slidably lower and higher canopy-height-and-tilt-adjusting arthritic-aiding handle 115 thereby adjusting the height and tilt of canopy-lifting arm 120
(see FIG. 6A); and
c) Can engage arthritic-aiding trigger pin 117
to predeterminedly and lockably engage to arthritic-aiding-trigger-pin holes 118
(see FIGS. 6A and 6B).

7) It is yet another object of the new invention to provide a wind-lift-eliminating self-adjusting self-stabilizing reversible-canopy arthritic-aiding umbrella, having removable arthritic-aiding-canopy-deploying-crank paddle 124.
Therefore, the wind-lift-eliminating self-adjusting self-stabilizing reversible-canopy arthritic-aiding umbrella:
a) Can aid to those with arthritic conditions in their hands
to operate removable arthritic-aiding-canopy-deploying crank 123 without discomfort
in the directions of arrows 147
(see FIG. 15);
b) Can provide means to engage arthritic-aiding handles and canopy-deploying system 110
to deploy and retract wind-pressure-releasing and cooling-funnel canopy system 126
in the directions of arrows 147
(see FIG. 10 and FIG. 15);
c) Can provide a paddle-like, flatter, enlarged surface area to be in contact with an arthritic hand
to reduce concentrated pressure areas and to thereby reduce pain and discomfort, such as is not possible with prior art
in the directions of arrows 147
(see FIG. 15);
d) Can provide ridges at the front and back
to aid those with arthritic hand conditions by helping to easily position and maintain their hands in the center of removable arthritic-aiding-canopy-deploying-crank paddle 124, without slipping off, as prior art would naturally promote
in the directions of arrows 147
(see FIG. 6A, 6B, and FIG. 15); and
e) Can provide ridges at the top and bottom
to aid those with arthritic hand conditions by helping them easily position and maintain their hands in the center of removable arthritic-aiding-canopy-deploying-crank paddle 124, while pushing upwards or downwards
in the directions of arrows 147
(see FIG. 15).

8) It is still yet another object of the new invention to provide a wind-lift-eliminating self-adjusting self-stabilizing reversible-canopy arthritic-aiding umbrella, having wind-pressure-releasing and cooling-funnel canopy 127.
Therefore, the wind-lift-eliminating self-adjusting self-stabilizing reversible-canopy arthritic-aiding umbrella:
a) Can cover to protect users from weather elements
b) Can release air pressure below the wind-lift-eliminating self-adjusting self-stabilizing reversible-canopy arthritic-aiding umbrella
in the directions of arrows 157*a*, 157*b*, 158*a*, and 158*b*
(see FIG. 20C and FIG. 20D);
c) Can stabilize side-to-side movement from wind gusts, by relieving air pressure from below cooling-funnels 128 of the wind-lift-eliminating self-adjusting self-stabilizing reversible-canopy arthritic-aiding umbrella
in the directions of arrows 150*a*, 150*b*, 150*c*, 150*d*, 151 and 152
(see FIG. 17, 18A, FIG. 18B, and FIG. 18C);
d) Can eliminate lift from wind gusts of by relieving air pressure from below cooling-funnels 128 of the wind-lift-eliminating self-adjusting self-stabilizing reversible-canopy arthritic-aiding umbrella
in the directions of arrows 157*a*, 157*b*, 158*a*, and 158*b*
(see FIG. 20C and FIG. 20B);
e) Can eliminate vibration from wind by relieving air pressure from below cooling-funnels 128 of the wind-lift-eliminating self-adjusting self-stabilizing reversible-canopy arthritic-aiding umbrella
in the directions of arrows 148*a*, 148*b*, 149*a* and 149*b*
(see FIG. 16A, FIG. 16B, FIG. 16C, FIG. 16D, and FIG. 16E);
f) Can customize wind-flow direction and pattern from the sides to the inside of the wind-lift-eliminating self-adjusting self-stabilizing reversible-canopy arthritic-aiding umbrella by adjusting tension of wind-lift-eliminating self-adjusting funnel-and-canopy-tension-adjusting springs 135
in the directions of arrows 148*a*, 148*b*, 149*a*, 148*a*, and 149*b*
(see FIG. 16A, FIG. 16B, FIG. 16C, FIG. 16D, and FIG. 16E); and
g) Can customize the volume of air pressure below the wind-lift-eliminating self-adjusting self-stabilizing reversible-canopy arthritic-aiding umbrella by adjusting tension of wind-lift-eliminating self-adjusting funnel-and-canopy-tension-adjusting springs 135
in the directions of arrows 148*a*, 148*b*, 149*a* and 149*b*
(see FIG. 16A, FIG. 16B, FIG. 16C, FIG. 16D, and FIG. 16E).

9) It is still yet another object of the new invention to provide a wind-lift-eliminating self-adjusting self-stabilizing reversible-canopy arthritic-aiding umbrella, having cooling-funnels 128.
Therefore, the wind-lift-eliminating self-adjusting self-stabilizing reversible-canopy arthritic-aiding umbrella:
a) Can provide respective wind scoops, guiding the wind-flow inward and downward through the directional cooling-funnels 128
in the directions of arrows 162, 163*b*, and 163*b*
(see FIGS. 21A, and 21B);

b) Can cool the environment for the occupants under cooling-funnels 128 by adjusting the tilt, and tension of wind-lift-eliminating self-adjusting funnel-and-canopy-tension-adjusting springs 135
in the directions of arrows 162
(see FIG. 21A);

c) Can release the air pressure from below respective cooling-funnels 128;

d) Can automatically adjust the air pressure from below by lifting and curling respective cooling-funnels 128 in locations where the wind and pressure are greatest;

e) Can stabilize side-to-side movement from wind gusts, by the cooling-funnels 128 relieving air pressure by respectively lifting and curling;

f) Can eliminate umbrella lift from wind gusts by neutralizing and relieving air pressure from below cooling-funnels 128
in the directions of arrows 162*a*, 163*a*, and 163*b*
(see FIGS. 2IA, and 21B);

g) Can eliminate vibration from wind by relieving air pressure from below cooling-funnels 128
in the directions of arrows 162*a*, 163*a*, and 163*b*
(see FIGS. 21A, and 21B);

h) Can customize the wind-flow direction and pattern from the sides to the inside of the wind-lift-eliminating self-adjusting self-stabilizing reversible-canopy arthritic-aiding umbrella by adjusting tension of wind-lift-eliminating self-adjusting funnel-and-canopy-tension-adjusting springs 135; and i) Can adjust the tension of wind-lift-eliminating self-adjusting funnel-and-canopy-tension-adjusting springs 135 to customizing volume of air pressure
in the directions of arrows 162*a*, 163*a*, and 163*b*
(see FIG. 21B).

10) It is still yet another object of the new invention to provide a wind-lift-eliminating self-adjusting self-stabilizing reversible-canopy arthritic-aiding umbrella, having wind-lift-eliminating self-adjusting funnel-and-canopy-tension-adjusting springs 135.

Therefore, the wind-lift-eliminating self-adjusting self-stabilizing reversible-canopy arthritic-aiding umbrella:

a) Can adjust to customize amount of tension
in the directions of arrows 150*a*, 150*b*, 150*c*, and 150*d*
(see FIG. 17);

b) Can release the air pressure below the wind-lift-eliminating self-adjusting self-stabilizing reversible-canopy arthritic-aiding umbrella
in the directions of arrows 150*a*, 150*b*, 150*c*, 150*d*, 157*a*, and 157*b* (see FIGS. 17 and 20C);

c) Can stabilize the side-to-side movement from wind gusts, by relieving air pressure from below cooling-funnels 128 of the wind-lift-eliminating self-adjusting self-stabilizing reversible-canopy arthritic-aiding umbrella
in the directions of arrows 150*a*, 150*b*, 150*c*, 150*d*, 151, 152, 153, and 154
(see FIG. 17, FIG. 18A FIG. 18B, FIG. 19A, FIG. 19B, and FIG. 19C);

d) Can eliminate lift from wind gusts of by relieving air pressure from below cooling-funnels 128 of the wind-lift-eliminating self-adjusting self-stabilizing reversible-canopy arthritic-aiding umbrella
in the directions of arrows 151, 152, 153, and 154
(see FIG. 18A FIG. 18B, FIG. 19A, FIG. 19B, and FIG. 19C);

e) Can eliminate vibration from wind by relieving air pressure from below cooling-funnels 128 of the wind-lift-eliminating self-adjusting self-stabilizing reversible-canopy arthritic-aiding umbrella
in the directions of arrows 148*a*, 148*b*, 151, 152, 153, and 154
(see FIG. 16A, 16B, 18A, FIG. 18B, FIG. 19A, FIG. 19B, and FIG. 19C); and f) Can customize the volume of air pressure below the wind-lift-eliminating self-adjusting self-stabilizing reversible-canopy arthritic-aiding umbrella
in the directions of arrows 149*a*, 149*b*, 156*a*, 156*b*, 156*c*, 156*d*, 156*e*, 156*f*, 156*g*, and 156*h*
(see FIG. 16D, FIG. 16E, and FIG. 20B).

11) It is still another object of the new invention to provide a wind-lift-eliminating self-adjusting self-stabilizing reversible-canopy arthritic-aiding umbrella, having automatic-canopy-spring-centering crescents 136*c*.

Therefore, the wind-lift-eliminating self-adjusting self-stabilizing reversible-canopy arthritic-aiding umbrella:

a) Can protect painted or powder-coated surface of lower-ribs 138
in the directions of arrows 148*a* and 148*b*
(see FIG. 16A and FIG. 16B);

b) Can re-center reversible wind-lift-eliminating self-adjusting funnel-and-canopy-tension-adjusting springs 135 in respect to the positioning of lower-ribs 138
in the directions of arrows 148*a*
(see FIG. 16A);

c) Can provide predetermined spacing for reversible wind-lift-eliminating self-adjusting funnel-and-canopy-tension-adjusting springs 135 to rest upon lower-ribs 138
in the directions of arrows 148*a* and 148*b*
(see FIG. 16A and FIG. 16B);

d) Can eliminate shock for reversible wind-lift-eliminating self-adjusting funnel-and-canopy-tension-adjusting springs 135 when impacting lower-ribs 138
in the directions of arrows 148*a*, 148*b*, 149*a*, 148*a*, and 149*b*
(see FIG. 16A, FIG. 16B, and FIG. 16C);

e) Can eliminate vibration from reversible wind-lift-eliminating self-adjusting funnel-and-canopy-tension-adjusting springs 135
in the directions of arrows 148*a*
(see FIG. 16A); and f) Can eliminate noise from reversible wind-lift-eliminating self-adjusting funnel-and-canopy-tension-adjusting springs 135 from impact against lower-ribs 138
in the directions of arrows 148*a*, 148*b*, 149*a*, 148*a*, and 149*b*
(see FIG. 16A, FIG. 16B, and FIG. 16C).

12) It is another object of the new invention to provide a wind-lift-eliminating self-adjusting self-stabilizing reversible-canopy arthritic-aiding umbrella, having multi-base-connecting canopy-base plates 141*b*.

Therefore, the wind-lift-eliminating self-adjusting self-stabilizing reversible-canopy arthritic-aiding umbrella:

a) Can connect multiple multi-base-connecting canopy-base plates 141*b* of other wind-lift-eliminating self-adjusting self-stabilizing reversible-canopy arthritic-aiding umbrellas to secure multiple wind-lift-eliminating self-adjusting self-stabilizing reversible-canopy arthritic-aiding umbrellas together in the directions of arrows 167*a*, 167*b*, 168*a*, 168*a*, 169*a*, and 169*b*

(see FIG. 23A, FIG. 23B, and FIG. 23C);

b) Can connect multiple multi-base-connecting canopy-base plates 141*b* of other wind-lift-eliminating self-adjusting self-stabilizing reversible-canopy arthritic-aiding umbrellas to increase the footprint thereof, thereby providing greater stability from the effects of winds and rain (see FIG. 24A);

c) Can connect multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas for saving space when configured on decks, patios, pool-sides, balconies, verandas, sidewalks, food courts, and in restaurants (see FIG. 24A, FIG. 24B, FIG. 24C, and FIG. 24D); and d) Can connect multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas to provide many variable aesthetic and design configurations to table and lounge chair configurations on decks, patios, pool-sides, balconies, verandas, sidewalks, food courts, and in restaurants (see FIG. 24A, FIG. 24B, FIG. 24C, and FIG. 24D).

13) It is another object of the new invention to provide a wind-lift-eliminating self-adjusting self-stabilizing reversible-canopy arthritic-aiding umbrella, having multi-base-connecting locking slots 141*c*.

Therefore, the wind-lift-eliminating self-adjusting self-stabilizing reversible-canopy arthritic-aiding umbrella:

a) Can connect multiple multi-base-connecting canopy-base plates 141*b* of other wind-lift-eliminating self-adjusting self-stabilizing reversible-canopy arthritic-aiding umbrellas to secure multiple wind-lift-eliminating self-adjusting self-stabilizing reversible-canopy arthritic-aiding umbrellas together in the directions of arrows 167*a*, 167*b*, 168*a*, 168*a*, 169*a*, and 169*b*

(see FIG. 23A, FIG. 23B, and FIG. 23C);

b) Can connect multiple multi-base-connecting canopy-base plates 141*b* of other wind-lift-eliminating self-adjusting self-stabilizing reversible-canopy arthritic-aiding umbrellas to increase the footprint thereof, thereby providing greater stability from the effects of winds and rain (see FIG. 24A);

c) Can connect multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas for saving space when configured on decks, patios, pool-sides, balconies, verandas, sidewalks, food courts, and in restaurants (see FIG. 24A, FIG. 24B, FIG. 24C, and FIG. 24D); and d) Can connect multiple multi-base-connecting canopy-base plates 141*b* of other wind-lift-eliminating self-adjusting self-stabilizing reversible-canopy arthritic-aiding umbrellas to provide connected combinations of wind-lift-eliminating self-adjusting self-stabilizing reversible-canopy arthritic-aiding umbrellas to provide many variable aesthetic and design configurations to table and lounge chair configurations on decks, patios, pool-sides, balconies, verandas, sidewalks, food courts, and in restaurants (see FIG. 24A, FIG. 24B, FIG. 24C, and FIG. 24D).

What is claimed is:

1. A wind-lift-eliminating self-adjusting self-stabilizing reversible-canopy arthritic-aiding umbrella having an underside, an inside, and a shape, said wind-lift-eliminating self-adjusting self-stabilizing reversible-canopy arthritic-aiding umbrella comprising:

a customizable-flow-directing chapeau crown;

a customizable-flow-directing chapeau, attached to said customizable-flow-directing chapeau crown for protecting users from weather elements, for redirecting hot air to flow out and away from said underside of said wind-lift-eliminating self-adjusting self-stabilizing reversible-canopy arthritic-aiding umbrella to cool said inside, for releasing air pressure below said wind-lift-eliminating self-adjusting self-stabilizing reversible-canopy arthritic-aiding umbrella to cool said inside, for redirecting wind-flow above said customizable-flow-directing chapeau into said inside of said wind-lift-eliminating self-adjusting self-stabilizing reversible-canopy arthritic-aiding umbrella to cool said inside, for customizing wind-flow direction and pattern from above said customizable-flow-directing chapeau to said inside of said wind-lift-eliminating self-adjusting self-stabilizing reversible-canopy arthritic-aiding umbrella to cool said inside, and for customizing volume of air pressure below said wind-lift-eliminating self-adjusting self-stabilizing reversible-canopy arthritic-aiding umbrella to cool said inside;

a plurality of chapeau attachment stitching strips respectively stitched to said customizable-flow-directing chapeau;

a cable conduit;

an upper self-centering inverted spiral-locking cone rotatably attached to said cable conduit for preventing said wind-lift-eliminating self-adjusting self-stabilizing reversible-canopy arthritic-aiding umbrella from radially twisting clockwise out of said shape, and for preventing said wind-lift-eliminating self-adjusting self-stabilizing reversible-canopy arthritic-aiding umbrella from radially twisting counter-clockwise out of said shape;

a lower self-centering spiral-locking cone
for centering said lower self-centering spiral-locking cone with said upper self-centering inverted spiral-locking cone,
for preventing said wind-lift-eliminating self-adjusting self-stabilizing reversible-canopy arthritic-aiding umbrella from radially twisting clockwise out of said shape,
for preventing said wind-lift-eliminating self-adjusting self-stabilizing reversible-canopy arthritic-aiding umbrella from radially twisting counter-clockwise out of said shape, and
for twist-locking said lower self-centering spiral-locking cone with said upper self-centering inverted spiral-locking cone;
a canopy-height-adjusting stanchion;
a canopy-lifting-arm intersector
bolted to said canopy-height-adjusting stanchion;
a canopy-supporting-arm intersector;
a canopy top-hub intersector;
a canopy-height-and-tilt-adjusting arthritic-hand-aiding handle
slidably connected to said canopy-height-adjusting stanchion;
a canopy height-adjusting arthritic-hand-aiding trigger
springably and pivotably attached to said canopy-height-and-tilt-adjusting arthritic-hand-aiding handle
for providing aid to arthritic hands to operate said canopy-height-and-tilt-adjusting arthritic-hand-aiding handle without discomfort, and
for providing means to slidably lower and raise said canopy-height-and-tilt-adjusting arthritic-hand-aiding handle to adjust said wind-lift-eliminating self-adjusting self-stabilizing reversible-canopy arthritic-aiding umbrella;
an arthritic-hand-aiding trigger pin
molded to said canopy height-adjusting arthritic-hand-aiding trigger;
a plurality of arthritic-hand-aiding-trigger-pin holes
respectively drilled into said canopy-height-adjusting stanchion,
said arthritic-hand-aiding trigger pin lockably and unlockably inserted into one of said arthritic-hand-aiding-trigger-pin holes;
a canopy-supporting arm
pivotably attached to said canopy-lifting-arm intersector and said canopy-supporting-arm intersector;
a canopy-lifting arm
pivotably attached to said canopy-height-and-tilt-adjusting arthritic-hand-aiding handle and said canopy top-hub intersector,
said canopy-supporting-arm intersector pivotably attached to said canopy-lifting arm;
a canopy-deploying cable;
a canopy-deploying-cable spool
molded into said canopy-height-and-tilt-adjusting arthritic-hand-aiding handle, and attached to said canopy-deploying cable;
a removable arthritic-hand-aiding-canopy-deploying crank;
a removable arthritic-hand-aiding-canopy-deploying-crank paddle
having a paddle-like flatter, an enlarged surface area, a plurality of ridges,
and a center,
said removable arthritic-hand-aiding-canopy-deploying-crank paddle rotatably connected to said removable arthritic-hand-aiding-canopy-deploying crank
for providing aid to arthritic hands
to operate said removable arthritic-hand-aiding-canopy-deploying crank without discomfort,
for providing means to deploy and retract said wind-lift-eliminating self-adjusting self-stabilizing reversible-canopy arthritic-aiding umbrella,
for providing said paddle-like flatter and said enlarged surface area to be in contact with an arthritic hand to reduce concentrated pressure and pain exerted thereon,
for providing said ridges at said front and said back to aid arthritic hands to stay and maintain in said center of said removable arthritic-hand-aiding-canopy-deploying-crank paddle, without slipping off, and
for providing said ridges on said removable arthritic-hand-aiding-canopy-deploying-crank paddle to aid arthritic hands to stay and maintain in said center of said removable arthritic-hand-aiding-canopy-deploying-crank paddle;
a removable-crank insertion hole
connected to said canopy-deploying-cable spool,
said removable arthritic-hand-aiding-canopy-deploying crank detachably inserted into said removable-crank insertion hole;
a reversible wind-pressure-releasing and cooling-funnel canopy,
said customizable-flow-directing chapeau attached to said reversible wind-pressure-releasing and cooling-funnel canopy by said chapeau attachment stitching strips,
for providing a cover to protect users from weather elements, and
for releasing air pressure below said wind-lift-eliminating self-adjusting self-stabilizing reversible-canopy arthritic-aiding umbrella;
a plurality of canopy-spring mounting holes
respectively punched out of said reversible wind-pressure-releasing and cooling-funnel canopy;
a customizable-flow-directing-chapeau opening
is cut into said reversible wind-pressure-releasing and cooling-funnel canopy;
a canopy top-hub-ring,
said cable conduit respectively and rotatably attached to said canopy top-hub-ring,
said canopy top-hub intersector pivotably attached to said canopy top-hub-ring;
a canopy bottom-shuttle-hub-ring,
said lower self-centering spiral-locking cone respectively and rotatably attached to said canopy bottom-shuttle-hub-ring,
said canopy-deploying cable connected to said canopy bottom-shuttle-hub-ring;
a plurality of upper-ribs;
a plurality of wind-lift-eliminating self-adjusting funnel-and-canopy-tension-adjusting springs
for adjustably tensioning said reversible wind-pressure-releasing and cooling-funnel canopy,
for releasing air pressure below said wind-lift-eliminating self-adjusting self-stabilizing reversible-canopy arthritic-aiding umbrella,
for stabilizing said wind-lift-eliminating self-adjusting self-stabilizing reversible-canopy arthritic-aiding umbrella from wind gusts, by relieving air pressure from below said wind-lift-eliminating self-adjusting self-stabilizing reversible-canopy arthritic-aiding umbrella, for eliminating lift from wind gusts by relieving air pressure from below said wind-lift-eliminating self-adjusting self-stabilizing reversible-canopy arthritic-aiding umbrella, for eliminating vibration from wind by relieving air pressure from below said wind-lift-eliminating self-adjusting self-stabilizing reversible-canopy arthritic-aiding umbrella, and for customizing volume of pressured air below said wind-lift-eliminating self-adjusting self-stabilizing reversible-canopy arthritic-aiding umbrella;

a plurality of wind-lift-eliminating-self-adjusting-spring eyelets respectively molded to wind-lift-eliminating self-adjusting funnel-and-canopy-tension-adjusting springs;

a plurality of adjustable-tension-canopy-spring-eyelet washer and screws respectively screwed through said canopy-spring mounting holes to said wind-lift-eliminating-self-adjusting-spring eyelets;

a plurality of automatic-canopy-spring-centering crescents respectively screwed to said wind-lift-eliminating self-adjusting funnel-and-canopy-tension-adjusting springs and respectively and detachably resting against said upper-ribs for protecting said upper-ribs from being scratched, for centering said wind-lift-eliminating self-adjusting funnel-and-canopy-tension-adjusting springs on said upper-ribs, for providing spacing between said wind-lift-eliminating self-adjusting funnel-and-canopy-tension-adjusting springs and said upper-ribs, for providing dampening for said wind-lift-eliminating self-adjusting funnel-and-canopy-tension-adjusting springs when impacting said upper-ribs, for eliminating vibration from said wind-lift-eliminating self-adjusting funnel-and-canopy-tension-adjusting springs on said upper-ribs, and for eliminating noise from said wind-lift-eliminating self-adjusting funnel-and-canopy-tension-adjusting springs from impact against said upper-ribs, a plurality of adjustable-tension-canopy-spring brackets springably and respectively securing said wind-lift-eliminating self-adjusting funnel-and-canopy-tension-adjusting springs to said upper-ribs;

a plurality of adjustable-tension screws respectively and adjustably screwed to said adjustable-tension-canopy-spring brackets;

a plurality of lower-ribs respectively and pivotably screwed to said canopy bottom-shuttle-hub-ring and said upper-ribs;

a canopy-stanchion base-mounting plate, attached to said canopy-height-adjusting stanchion;

a plurality of canopy-base-stabilizing feet respectively bolted to said canopy-stanchion base-mounting-plate.

2. The wind-lift-eliminating self-adjusting self-stabilizing reversible-canopy arthritic-aiding umbrella of claim 1, further comprising:

a plurality of cooling-funnels respectively formed into said reversible wind-pressure-releasing and cooling-funnel canopy for scooping and guiding wind-flow inward and downward through said cooling-funnels, for cooling said inside under said cooling-funnels by adjusting said wind-lift-eliminating self-adjusting funnel-and-canopy-tension-adjusting springs, for releasing air pressure from below said cooling-funnels, for automatically adjusting to air pressure from below said cooling-funnels, for relieving air pressure from wind gusts to stabilize said wind-lift-eliminating self-adjusting self-stabilizing reversible-canopy arthritic-aiding umbrella, for eliminating umbrella lift from wind gusts by neutralizing and relieving air pressure from below said cooling-funnels, for eliminating vibration from wind by relieving air pressure from below said cooling-funnels, for customizing wind-flow direction and pattern into and out of said inside when adjusting said wind-lift-eliminating self-adjusting funnel-and-canopy-tension-adjusting springs to customize air pressure.

3. The wind-lift-eliminating self-adjusting self-stabilizing reversible-canopy arthritic-aiding umbrella of claim 2, wherein said cooling-funnels each are formed into a triangular shape.

4. The wind-lift-eliminating self-adjusting self-stabilizing reversible-canopy arthritic-aiding umbrella of claim 1, further comprising:

a plurality of multi-base-connecting canopy-base plates respectively welded to canopy-base-stabilizing feet, said multi-base-connecting canopy-base plates each having a multi-base-connecting locking slot and a bent lower connecting portion disposed below said multi-base-connecting locking slot for slidably fitting behind adjacent multi-base-connecting canopy-base plate to secure a plurality of said wind-lift-eliminating self-adjusting self-stabilizing reversible-canopy arthritic-aiding umbrellas together, for slidably hooking behind adjacent multi-base-connecting canopy-base plate to increase footprint and to provide greater stability for said wind-lift-eliminating self-adjusting self-stabilizing reversible-canopy arthritic-aiding umbrellas, and for slidably hooking a plurality of said wind-lift-eliminating self-adjusting self-stabilizing reversible-canopy arthritic-aiding umbrellas together to provide a plurality of variable aesthetic and design configurations to table and lounge chair configurations on decks, patios, pool-sides, balconies, verandas, sidewalks, food courts, or in restaurants.

5. The wind-lift-eliminating self-adjusting self-stabilizing reversible-canopy arthritic-aiding umbrella of claim 1, further comprising:

a plurality of customizable-flow-directing chapeau control levers respectively attached to said upper-ribs for controling air pressure and effects of wind-flow under said wind-lift-eliminating self-adjusting self-stabilizing reversible-canopy arthritic-aiding umbrella to stabilize said wind-lift-eliminating self-adjusting self-stabilizing reversible-canopy arthritic-aiding umbrella, for opening or closing said customizable-flow-directing chapeau in a plurality of configurations, for providing controls to redirect hot air to flow out and away from said underside of said wind-lift-eliminating self-adjusting self-stabilizing reversible-canopy arthritic-aiding umbrella to cool said underside, for providing controls to customize wind-flow direction and pattern from above said wind-lift-eliminating self-adjusting self-stabilizing reversible-canopy arthritic-aiding umbrella to said inside of said wind-lift-eliminating self-adjusting self-stabilizing reversible-canopy arthritic-aiding umbrella, for providing controls to release air pressure below said wind-lift-eliminating self-adjusting self-stabilizing reversible-canopy arthritic-aiding umbrella, and for providing controls to customize air pressure in said inside of said wind-lift-eliminating self-adjusting self-stabilizing reversible-canopy arthritic-aiding umbrella when opening or closing said customizable-flow-directing chapeau to regulate air pressure in said inside.

6. The wind-lift-eliminating self-adjusting self-stabilizing reversible-canopy arthritic-aiding umbrella of claim 4, further comprising:

a plurality of arthritic-hand-aiding control tabs respectively and pivotably are molded to said customizable-flow-directing chapeau control levers for helping an arthritic to operate said customizable-flow-directing chapeau control levers.

7. The wind-lift-eliminating self-adjusting self-stabilizing reversible-canopy arthritic-aiding umbrella of claim 1, further comprising:

a canopy hook-and-loop closure slit formed into said reversible wind-pressure-releasing and cooling-funnel canopy for providing access to said canopy-supporting-arm intersector.

8. The wind-lift-eliminating self-adjusting self-stabilizing reversible-canopy arthritic-aiding umbrella of claim 1, wherein said canopy-deploying cable is made of nylon material.

9. The wind-lift-eliminating self-adjusting self-stabilizing reversible-canopy arthritic-aiding umbrella of claim 1, wherein said automatic-canopy-spring-centering crescents each are made of metallic or plastic material.

10. A wind-lift-eliminating self-adjusting self-stabilizing arthritic-aiding umbrella having an underside, an inside, and a shape, said wind-lift-eliminating self-adjusting self-stabilizing arthritic-aiding umbrella comprising:

a customizable-flow-directing chapeau, attached to said customizable-flow-directing chapeau crown for protecting users from weather elements, for redirecting hot air to flow out and away from said underside of said wind-lift-eliminating self-adjusting self-stabilizing arthritic-aiding umbrella to cool said inside, for releasing air pressure below said wind-lift-eliminating self-adjusting self-stabilizing arthritic-aiding umbrella to cool said inside, for redirecting wind-flow above said customizable-flow-directing chapeau into said inside of said wind-lift-eliminating self-adjusting self-stabilizing arthritic-aiding umbrella to cool said inside, for customizing wind-flow direction and pattern from above said customizable-flow-directing chapeau to said inside of said wind-lift-eliminating self-adjusting self-stabilizing arthritic-aiding umbrella to cool said inside, and for customizing volume of air pressure below said wind-lift-eliminating self-adjusting self-stabilizing arthritic-aiding umbrella to cool said inside;

a cable conduit;

an upper self-centering cone rotatably attached to said cable conduit for preventing said wind-lift-eliminating self-adjusting self-stabilizing arthritic-aiding umbrella from radially twisting clockwise out of said shape, and for preventing said wind-lift-eliminating self-adjusting self-stabilizing arthritic-aiding umbrella from radially twisting counterclockwise out of said shape;

a lower self-centering tube for centering said upper self-centering cone;

a canopy-height-adjusting stanchion;

a canopy-lifting-arm intersector bolted to said canopy-height-adjusting stanchion;

a canopy-supporting-arm intersector;

a canopy top-hub intersector;

a canopy-height-and-tilt-adjusting arthritic-hand-aiding handle slidably connected to said canopy-height-adjusting stanchion;

a canopy height-adjusting arthritic-hand-aiding trigger springably and pivotably attached to said canopy-height-and-tilt-adjusting arthritic-hand-aiding handle for providing aid to arthritic hands to operate said canopy-height-and-tilt-adjusting arthritic-hand-aiding handle without discomfort, and for providing means to slidably lower and raise said canopy-height-and-tilt-adjusting arthritic-hand-aiding handle to adjust said wind-lift-eliminating self-adjusting self-stabilizing arthritic-aiding umbrella;

an arthritic-hand-aiding trigger pin molded to said canopy height-adjusting arthritic-hand-aiding trigger;

a plurality of arthritic-hand-aiding-trigger-pin holes respectively drilled into said canopy-height-adjusting stanchion, said arthritic-hand-aiding trigger pin lockably and unlockably inserted into one of said arthritic-hand-aiding-trigger-pin holes;

a canopy-supporting arm pivotably attached to said canopy-lifting-arm intersector and said canopy-supporting-arm intersector;

a canopy-lifting arm pivotably attached to said canopy-height-and-tilt-adjusting arthritic-hand-aiding handle and said canopy top-hub intersector, said canopy-supporting-arm intersector pivotably attached to said canopy-lifting arm;

a canopy-deploying cable;

a canopy-deploying-cable spool molded into said canopy-height-and-tilt-adjusting arthritic-hand-aiding handle, and attached to said canopy-deploying cable;

a removable arthritic-hand-aiding-canopy-deploying crank;

a removable arthritic-hand-aiding-canopy-deploying-crank paddle having a paddle-like flatter, an enlarged surface area, a plurality of ridges, and a center, said removable arthritic-hand-aiding-canopy-deploying-crank paddle rotatably connected to said removable arthritic-hand-aiding-canopy-deploying crank for providing aid to arthritic hands to operate said removable arthritic-hand-aiding-canopy-deploying crank without discomfort, for providing means to deploy and retract said wind-lift-eliminating self-adjusting self-stabilizing arthritic-aiding umbrella, for providing said paddle-like flatter and said enlarged surface area to be in contact with an arthritic hand to reduce concentrated pressure and pain exerted thereon, for providing said ridges at said front and said back to aid arthritic hands to stay and maintain in said center of said removable arthritic-hand-aiding-canopy-deploying-crank paddle, without slipping off, and for providing said ridges on said removable arthritic-hand-aiding-canopy-deploying-crank paddle to aid arthritic hands to stay and maintain in said center of said removable arthritic-hand-aiding-canopy-deploying-crank paddle;

a removable-crank insertion hole connected to said canopy-deploying-cable spool, said removable arthritic-hand-aiding-canopy-deploying crank detachably inserted into said removable-crank insertion hole;

a reversible wind-pressure-releasing and cooling-funnel canopy, said customizable-flow-directing chapeau attached to said reversible wind-pressure-releasing and cooling-funnel canopy by said chapeau attachment stitching strips, for providing a cover to protect users from weather elements, and for releasing air pressure below said wind-lift-eliminating self-adjusting self-stabilizing arthritic-aiding umbrella;

a plurality of canopy-spring mounting holes respectively punched out of said reversible wind-pressure-releasing and cooling-funnel canopy;

a customizable-flow-directing-chapeau opening is cut into said reversible wind-pressure-releasing and cooling-funnel canopy;

a canopy top-hub-ring, said cable conduit respectively and rotatably attached to said canopy top-hub-ring, said canopy top-hub intersector pivotably attached to said canopy top-hub-ring;

a canopy bottom-shuttle-hub-ring, said lower self-centering spiral-locking cone respectively and rotatably attached to said canopy bottom-shuttle-hub-ring, said canopy-deploying cable connected to said canopy bottom-shuttle-hub-ring;

a plurality of upper-ribs;

a plurality of wind-lift-eliminating self-adjusting funnel-and-canopy-tension-adjusting springs for adjustably tensioning said reversible wind-pressure-releasing and cooling-funnel canopy, for releasing air pressure below said wind-lift-eliminating self-adjusting self-stabilizing arthritic-aiding umbrella, for stabilizing said wind-lift-eliminating self-adjusting self-stabilizing arthritic-aiding umbrella from wind gusts, by relieving air pressure from below said wind-lift-eliminating self-adjusting self-stabilizing arthritic-aiding umbrella, for eliminating lift from wind gusts by relieving air pressure from below said wind-lift-eliminating self-adjusting self-stabilizing arthritic-aiding umbrella, for eliminating vibration from wind by relieving air pressure from below said wind-lift-eliminating self-adjusting self-stabilizing arthritic-aiding umbrella, and for customizing volume of pressured air below said wind-lift-eliminating self-adjusting self-stabilizing arthritic-aiding umbrella;

a plurality of wind-lift-eliminating-self-adjusting-spring eyelets respectively molded to said wind-lift-eliminating self-adjusting funnel-and-canopy-tension-adjusting springs;

a plurality of adjustable-tension-canopy-spring-eyelet washer and screws respectively screwed through said canopy-spring mounting holes to said wind-lift-eliminating-self-adjusting-spring eyelets;

a plurality of adjustable-tension-canopy-spring brackets springably and respectively securing said wind-lift-eliminating self-adjusting funnel-and-canopy-tension-adjusting springs to said upper-ribs;

a plurality of adjustable-tension screws respectively and adjustably screwed to said adjustable-tension-canopy-spring brackets;

a plurality of lower-ribs respectively and pivotably screwed to said canopy bottom-shuttle-hub-ring and said upper-ribs;

a canopy-stanchion base-mounting plate, attached to said canopy-height-adjusting stanchion;

a plurality of canopy-base-stabilizing feet respectively bolted to said canopy-stanchion base-mounting-plate.

11. The wind-lift-eliminating self-adjusting self-stabilizing arthritic-aiding umbrella of claim 10, further comprising:

a plurality of automatic-canopy-spring-centering crescents respectively screwed to said wind-lift-eliminating self-adjusting funnel-and-canopy-tension-adjusting springs and respectively and detachably resting against said upper-ribs for protecting said upper-ribs from being scratched, for centering said wind-lift-eliminating self-adjusting funnel-and-canopy-tension-adjusting springs on said upper-ribs, for providing spacing between said wind-lift-eliminating self-adjusting funnel-and-canopy-tension-adjusting springs and said upper-ribs, for providing dampening for said wind-lift-eliminating self-adjusting funnel-and-canopy-tension-adjusting springs when impacting said upper-ribs, for eliminating vibration from said wind-lift-eliminating self-adjusting funnel-and-canopy-tension-adjusting springs on said upper-ribs, and for eliminating noise from said wind-lift-eliminating self-adjusting funnel-and-canopy-tension-adjusting springs from impact against said upper-ribs.

12. The wind-lift-eliminating self-adjusting self-stabilizing arthritic-aiding umbrella of claim 10,
further comprising:
a plurality of cooling-funnels
respectively formed into said reversible wind-pressure-releasing and cooling-funnel canopy
for scooping and guiding wind-flow inward and downward through said cooling-funnels,
for cooling said inside under said cooling-funnels by adjusting said wind-lift-eliminating self-adjusting funnel-and-canopy-tension-adjusting springs,
for releasing air pressure from below said cooling-funnels,
for automatically adjusting to air pressure from below said cooling-funnels,
for relieving air pressure from wind gusts to stabilize said wind-lift-eliminating self-adjusting self-stabilizing arthritic-aiding umbrella,
for eliminating umbrella lift from wind gusts by neutralizing and relieving air pressure from below said cooling-funnels,
for eliminating vibration from wind by relieving air pressure from below said cooling-funnels,
for customizing wind-flow direction and pattern into and out of said inside when adjusting said wind-lift-eliminating self-adjusting funnel-and-canopy-tension-adjusting springs
to customize air pressure.

13. The wind-lift-eliminating self-adjusting self-stabilizing arthritic-aiding umbrella of claim 12,
wherein
said cooling-funnels each are formed into a triangular shape.

14. The wind-lift-eliminating self-adjusting self-stabilizing arthritic-aiding umbrella of claim 10,
further comprising:
a plurality of multi-base-connecting canopy-base plates respectively welded to canopy-base-stabilizing feet,
said multi-base-connecting canopy-base plates each having a multi-base-connecting locking slot and a bent lower connecting portion disposed below said multi-base-connecting locking slot
for slidably fitting behind adjacent multi-base-connecting canopy-base plate to secure a plurality of said wind-lift-eliminating self-adjusting self-stabilizing arthritic-aiding umbrellas together,
for slidably hooking behind adjacent multi-base-connecting canopy-base plate to increase footprint and to provide greater stability for said wind-lift-eliminating self-adjusting self-stabilizing arthritic-aiding umbrellas, and
for slidably hooking a plurality of said wind-lift-eliminating self-adjusting self-stabilizing arthritic-aiding umbrellas together
to provide a plurality of variable aesthetic and design configurations to table and lounge chair configurations on decks, patios, pool-sides, balconies, verandas, sidewalks, food courts, or in restaurants.

15. The wind-lift-eliminating self-adjusting self-stabilizing arthritic-aiding umbrella of claim 10,
further comprising:
a plurality of customizable-flow-directing chapeau control levers respectively attached to said upper-ribs
for controling air pressure and effects of wind-flow under said wind-lift-eliminating self-adjusting self-stabilizing arthritic-aiding umbrella to stabilize said wind-lift-eliminating self-adjusting self-stabilizing arthritic-aiding umbrella,
for opening or closing said customizable-flow-directing chapeau in a plurality of configurations,
for providing controls to redirect hot air to flow out and away from said underside of said wind-lift-eliminating self-adjusting self-stabilizing arthritic-aiding umbrella to cool said underside,
for providing controls to customize wind-flow direction and pattern from above said wind-lift-eliminating self-adjusting self-stabilizing arthritic-aiding umbrella to said inside of said wind-lift-eliminating self-adjusting self-stabilizing arthritic-aiding umbrella,
for providing controls to release air pressure below said wind-lift-eliminating self-adjusting self-stabilizing arthritic-aiding umbrella, and
for providing controls to customize air pressure in said inside of said wind-lift-eliminating self-adjusting self-stabilizing arthritic-aiding umbrella when opening or closing said customizable-flow-directing chapeau to regulate air pressure in said inside.

16. The wind-lift-eliminating self-adjusting self-stabilizing arthritic-aiding umbrella of claim 10,
further comprising:
a canopy hook-and-loop closure slit
formed into said reversible wind-pressure-releasing and cooling-funnel canopy for providing access to said canopy-supporting-arm intersector.

17. The wind-lift-eliminating self-adjusting self-stabilizing arthritic-aiding umbrella of claim 10,
wherein
said canopy-deploying cable is made of nylon material.

18. The wind-lift-eliminating self-adjusting self-stabilizing arthritic-aiding umbrella of claim 10,
wherein
said automatic-canopy-spring-centering crescents each are made of metallic or plastic material.

19. A wind-lift-eliminating self-adjusting self-stabilizing arthritic-aiding umbrella having an underside, an inside, and a shape, said wind-lift-eliminating self-adjusting self-stabilizing arthritic-aiding umbrella comprising:
a customizable-flow-directing chapeau,
attached to said customizable-flow-directing chapeau crown;
a cable conduit;
a upper self-centering cone
rotatably attached to said cable conduit
for preventing said wind-lift-eliminating self-adjusting self-stabilizing arthritic-aiding umbrella from radially twisting clockwise out of said shape, and
for preventing said wind-lift-eliminating self-adjusting self-stabilizing arthritic-aiding umbrella from radially twisting counterclockwise out of said shape;
a lower self-centering tube
for centering said upper self-centering cone;
a canopy-height-adjusting stanchion;
a canopy-lifting-arm intersector
bolted to said canopy-height-adjusting stanchion;
a canopy-supporting-arm intersector;
a canopy top-hub intersector;
a canopy-height-and-tilt-adjusting arthritic-hand-aiding handle slidably connected to said canopy-height-adjusting stanchion;

a canopy height-adjusting arthritic-hand-aiding trigger springably and pivotably attached to said canopy-height-and-tilt-adjusting arthritic-hand-aiding handle
for providing aid to arthritic hands to operate said canopy-height-and-tilt-adjusting arthritic-hand-aiding handle without discomfort, and
for providing means to slidably lower and raise said canopy-height-and-tilt-adjusting arthritic-hand-aiding handle to adjust said wind-lift-eliminating self-adjusting self-stabilizing arthritic-aiding umbrella;
an arthritic-hand-aiding trigger pin
molded to said canopy height-adjusting arthritic-hand-aiding trigger;
a plurality of arthritic-hand-aiding-trigger-pin holes
respectively drilled into said canopy-height-adjusting stanchion,
said arthritic-hand-aiding trigger pin lockably and unlockably inserted into one of said arthritic-hand-aiding-trigger-pin holes;
a canopy-supporting arm
pivotably attached to said canopy-lifting-arm intersector and said canopy-supporting-arm intersector;
a canopy-lifting arm
pivotably attached to said canopy-height-and-tilt-adjusting arthritic-hand-aiding handle and said canopy top-hub intersector,
said canopy-supporting-arm intersector pivotably attached to said canopy-lifting arm;
a canopy-deploying cable;
a canopy-deploying-cable spool
molded into said canopy-height-and-tilt-adjusting arthritic-hand-aiding handle, and attached to said canopy-deploying cable;
a removable arthritic-hand-aiding-canopy-deploying crank;
a removable arthritic-hand-aiding-canopy-deploying-crank paddle
rotatably connected to said removable arthritic-hand-aiding-canopy-deploying crank
for providing aid to arthritic hands
to operate said removable arthritic-hand-aiding-canopy-deploying crank without discomfort, and
for providing means to deploy and retract said wind-lift-eliminating self-adjusting self-stabilizing arthritic-aiding umbrella;
a removable-crank insertion hole
connected to said canopy-deploying-cable spool,
said removable arthritic-hand-aiding-canopy-deploying crank detachably inserted into said removable-crank insertion hole;
a reversible wind-pressure-releasing and cooling-funnel canopy,
said customizable-flow-directing chapeau attached to said reversible wind-pressure-releasing and cooling-funnel canopy by said chapeau attachment stitching strips,
for providing a cover to protect users from weather elements, and
for releasing air pressure below said wind-lift-eliminating self-adjusting self-stabilizing arthritic-aiding umbrella;
a plurality of canopy-spring mounting holes
respectively punched out of said reversible wind-pressure-releasing and cooling-funnel canopy;
a customizable-flow-directing-chapeau opening
is cut into said reversible wind-pressure-releasing and cooling-funnel canopy;
a canopy top-hub-ring,
said cable conduit respectively and rotatably attached to said canopy top-hub-ring,
said canopy top-hub intersector pivotably attached to said canopy top-hub-ring;
a canopy bottom-shuttle-hub-ring,
said lower self-centering spiral-locking cone respectively and rotatably attached to said canopy bottom-shuttle-hub-ring,
said canopy-deploying cable connected to said canopy bottom-shuttle-hub-ring;
a plurality of upper-ribs;
a plurality of wind-lift-eliminating self-adjusting funnel-and-canopy-tension-adjusting springs
for adjustably tensioning said reversible wind-pressure-releasing and cooling-funnel canopy,
for releasing air pressure below said wind-lift-eliminating self-adjusting self-stabilizing arthritic-aiding umbrella,
for stabilizing said wind-lift-eliminating self-adjusting self-stabilizing arthritic-aiding umbrella from wind gusts, by relieving air pressure from below said wind-lift-eliminating self-adjusting self-stabilizing arthritic-aiding umbrella,
for eliminating lift from wind gusts by relieving air pressure from below said wind-lift-eliminating self-adjusting self-stabilizing arthritic-aiding umbrella,
for eliminating vibration from wind by relieving air pressure from below said wind-lift-eliminating self-adjusting self-stabilizing arthritic-aiding umbrella, and
for customizing volume of pressured air below said wind-lift-eliminating self-adjusting self-stabilizing arthritic-aiding umbrella;
a plurality of cooling-funnel-and-adjustable-tension-canopy-spring eyelets respectively molded to said wind-lift-eliminating self-adjusting funnel-and-canopy-tension-adjusting springs;
a plurality of adjustable-tension-canopy-spring-eyelet washer and screws respectively screwed through said canopy-spring mounting holes to said wind-lift-eliminating-self-adjusting-spring eyelets;
a plurality of adjustable-tension-canopy-spring brackets
springably and respectively securing said wind-lift-eliminating self-adjusting funnel-and-canopy-tension-adjusting springs to said upper-ribs;
a plurality of adjustable-tension screws
respectively and adjustably screwed to said adjustable-tension-canopy-spring brackets;
a plurality of lower-ribs
respectively and pivotably screwed to said canopy bottom-shuttle-hub-ring and said upper-ribs;
a canopy-stanchion base-mounting plate,
attached to said canopy-height-adjusting stanchion;
a plurality of canopy-base-stabilizing feet
respectively bolted to said canopy-stanchion base-mounting-plate.

20. The wind-lift-eliminating self-adjusting self-stabilizing arthritic-aiding umbrella of claim 19,
further comprising:
a plurality of automatic-canopy-spring-centering crescents respectively screwed to said wind-lift-eliminating self-adjusting funnel-and-canopy-tension-adjusting springs and respectively and detachably resting against said upper-ribs for protecting said upper-ribs from being scratched, for centering said wind-lift-eliminating self-adjusting funnel-and-canopy-tension-adjusting springs on said upper-ribs, for providing spacing between said wind-lift-eliminating self-adjusting funnel-and-canopy-tension-adjusting springs and said upper-ribs, for providing dampening for said wind-lift-eliminating self-adjusting funnel-and-canopy-tension-adjusting springs when impacting said upper-ribs, for eliminating vibration from said wind-lift-eliminating self-adjusting funnel-and-canopy-tension-adjusting springs on said upper-ribs, and for eliminating noise from said wind-lift-eliminating self-adjusting funnel-and-canopy-tension-adjusting springs from impact against said upper-ribs.

* * * * *